US010730647B1

(12) United States Patent
Olson et al.

(10) Patent No.: US 10,730,647 B1
(45) Date of Patent: Aug. 4, 2020

(54) SYSTEMS AND METHODS FOR AUTOMATED FOOD PACKAGING

(71) Applicants: Paul A. Olson, Mora, MN (US); Donald W. Olson, Mora, MN (US); Eric D. Olson, Mora, MN (US); Robert D. Funk, Anoka, MN (US)

(72) Inventors: Paul A. Olson, Mora, MN (US); Donald W. Olson, Mora, MN (US); Eric D. Olson, Mora, MN (US); Robert D. Funk, Anoka, MN (US)

( * ) Notice: Subject to any disclaimer, the term of this patent is extended or adjusted under 35 U.S.C. 154(b) by 481 days.

(21) Appl. No.: 14/675,629

(22) Filed: Mar. 31, 2015

Related U.S. Application Data

(60) Provisional application No. 61/973,229, filed on Mar. 31, 2014.

(51) Int. Cl.

| | |
|---|---|
| ***B65B 1/02*** | (2006.01) |
| ***B65B 1/06*** | (2006.01) |
| ***B65B 7/02*** | (2006.01) |
| ***B65B 39/00*** | (2006.01) |
| ***B65B 43/00*** | (2006.01) |

(52) U.S. Cl.
CPC ..... *B65B 1/02* (2013.01); *B65B 1/06* (2013.01); *B65B 7/02* (2013.01); *B65B 39/00* (2013.01); *B65B 43/00* (2013.01)

(58) Field of Classification Search
CPC .. B65B 1/02; B65B 1/06; B65B 43/00; B65B 43/02–365
USPC ..... 53/452, 459
See application file for complete search history.

(56) References Cited

U.S. PATENT DOCUMENTS

| | | | | |
|---|---|---|---|---|
| 3,855,907 | A * | 12/1974 | Johnson | B65B 43/04 493/235 |
| 4,325,418 | A * | 4/1982 | Henle | B65B 1/02 141/182 |
| 4,330,288 | A * | 5/1982 | Russell | B65B 43/34 198/377.07 |
| 4,341,054 | A * | 7/1982 | Courtheoux | B65B 51/146 53/268 |
| 4,642,084 | A | 2/1987 | Gietman, Jr. | |
| 4,743,337 | A | 5/1988 | Moran et al. | |
| 4,934,993 | A | 6/1990 | Gietman, Jr. | |
| 5,518,559 | A | 5/1996 | Saindon et al. | |
| 5,814,382 | A | 9/1998 | Yannuzzi, Jr. | |
| 6,003,289 | A * | 12/1999 | McGregor | B65B 7/06 141/114 |
| 6,003,582 | A | 12/1999 | Blohowiak et al. | |
| 6,347,499 | B1 * | 2/2002 | McGregor | B65B 43/465 53/374.9 |

(Continued)

FOREIGN PATENT DOCUMENTS

| | | |
|---|---|---|
| WO | 2007/106916 A1 | 9/2007 |
| WO | 2011050354 | 4/2011 |

*Primary Examiner* — Chelsea E Stinson
(74) *Attorney, Agent, or Firm* — Underwood & Associates, LLC

(57) ABSTRACT

A food packaging system includes, in a serially coupled, operational configuration: a) an automated bag forming system; b) a bag rotator; c) a blade wheel; d) a bag top opener assembly; e) a funnel positioning system; f) a hopper system; g) an oil injection system; h) a sealing station; i) a crimping assembly; and j) an offloading assembly. A carriage conveyor system is configured to receive a bag formed by the automated bag forming system and convey the bag sequentially from component b) to component j).

20 Claims, 48 Drawing Sheets

(56) References Cited

U.S. PATENT DOCUMENTS

| | | | | |
|---|---|---|---|---|
| 6,658,821 | B2 * | 12/2003 | Townsend | B65B 43/465 53/284.7 |
| 6,974,406 | B2 | 12/2005 | Antonacci | |
| 7,611,102 | B2 * | 11/2009 | Murray | B65B 43/465 141/391 |
| 7,954,307 | B2 * | 6/2011 | Paunesku | B65B 9/087 53/284.7 |
| 8,012,076 | B2 | 9/2011 | Selle et al. | |
| 8,117,805 | B2 * | 2/2012 | Ligon | B65B 3/02 53/433 |
| 8,151,543 | B2 * | 4/2012 | Veix | B65B 43/26 141/166 |
| 9,150,315 | B2 * | 10/2015 | Vollenkemper | B65B 7/025 |
| 9,617,019 | B2 * | 4/2017 | Smith | B65B 1/02 |
| 2011/0138751 | A1 * | 6/2011 | Nakagawa | B65B 43/50 53/469 |
| 2011/0167763 | A1 * | 7/2011 | Waldherr | B29C 65/18 53/371.8 |

* cited by examiner

408

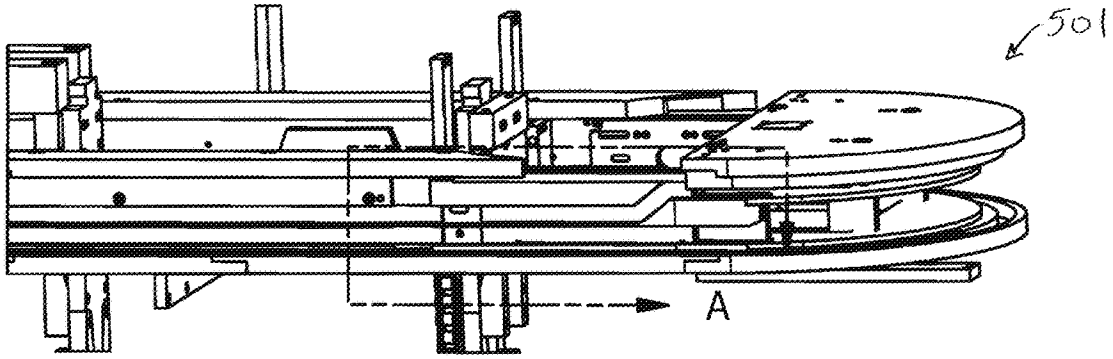
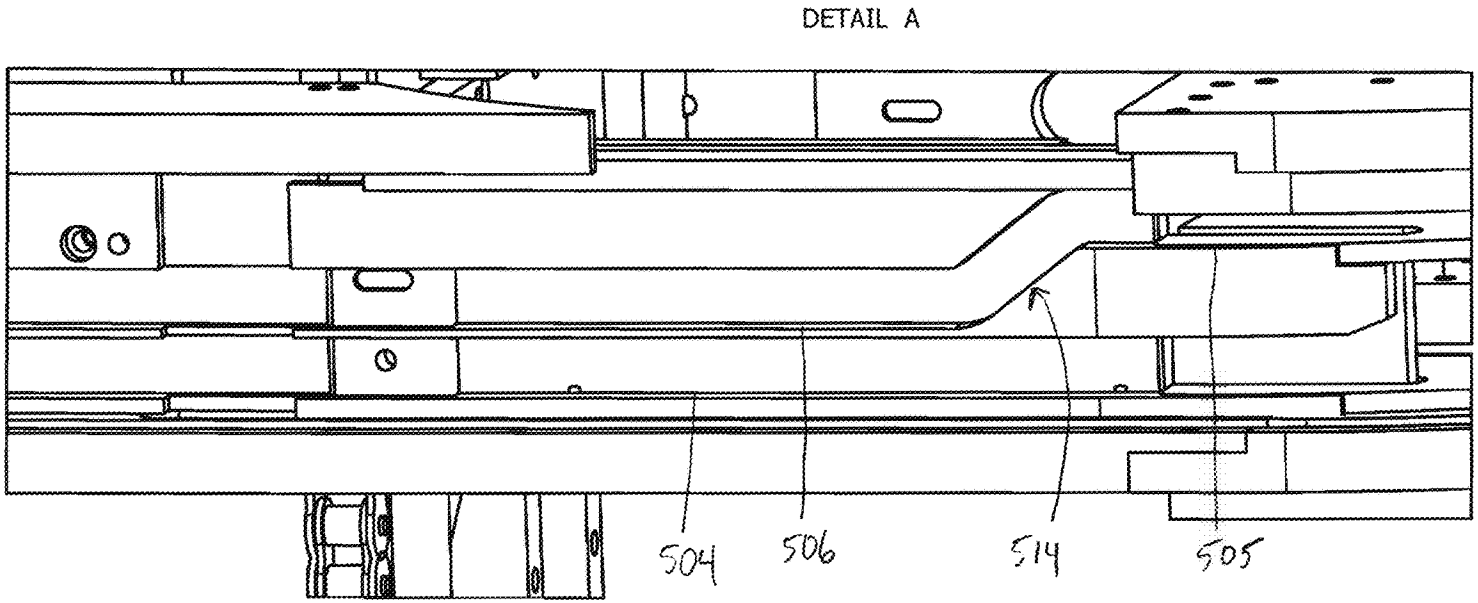
FIG. 14

I
78L
78L
78L

SECTION A (FIG. 23)

SYSTEMS AND METHODS FOR AUTOMATED FOOD PACKAGING

CROSS REFERENCE TO RELATED APPLICATIONS

This application claims priority to and the benefit under 35 USC § 119(e) of U.S. Provisional Patent Application No. 61/973,229, filed on Mar. 31, 2014, the contents of which are incorporated by reference in their entirety as if fully set forth herein.

TECHNICAL FIELD

This disclosure relates to systems and methods for the automated packaging of products such as foods. In particular, this disclosure relates to systems and methods for producing bags having a selected amount of popcorn kernels, oil, and other ingredients therein for preparation in a microwave.

BACKGROUND

Packaged products, especially packaged foods are available in thousands of grocery and convenience stores throughout the world. The type of packaging used to contain a particular kind of food can depend on the form of the food (e.g., liquid, solid, powdered, etc.), its ability to resist spoilage, and other factors. Other packaging considerations can include ease in shipping and shelf storage.

Some foods are packaged in sealed- or semi-sealed bags. Some examples include microwavable foods such as vegetables which are designed expand and form a pressurized vessel in which the food is cooked. Another example includes popcorn bags, which typically contain corn kernels, oil and other flavoring ingredients such as salt, butter, cheese, etc.

Some packaged foodstuffs are prepared in warehouses where a stock of the food item is placed in bags, sealed, and prepared for shipment to grocery stores. Generally, it can be advantageous to reduce the amount of time that foods are out in the open, thus quickness in packaging foods is generally desirable. Furthermore, supply can be kept up with demand if packaging facilities are able to package and prepare foods for delivery quickly.

SUMMARY

In general, systems and methods for the automated packaging of products such as foodstuffs are disclosed.

In one exemplary embodiment, an automated food packaging system is disclosed. The food packaging system includes, in a serially arranged, operational configuration: a) an automated bag forming system; b) a bag rotator; c) a blade wheel; d) a bag top opener assembly; e) a funnel positioning system; f) a hopper system; g) an oil injection system; h) a sealing station; i) a crimping assembly; and j) an offloading assembly. The food packaging system further includes a carriage conveyor system configured to receive a bag formed by the automated bag forming system and convey the bag sequentially from component b) to component j).

In one exemplary aspect, an automated food packaging system is disclosed. The automated food packaging system includes: a) an automated bag forming system configured to produce a plurality of individual bags in sequence; b) a bag rotator configured to receive and rotate the individual bags for placement into a carriage of a bag conveyor system; c) a blade wheel assembly configured to urge a bottom portion of the bag into the carriage; d) a bag top opener assembly configured to open a top portion of the bag; e) a funnel positioning system configured to position one of a plurality of funnels over the bag after opening; f) a hopper system configured to deliver a selected quantity of a foodstuff into the bag; g) an injection system configured to deliver a selected quantity of a flowable substance into the bag; h) a sealing station configured to seal the top portion of the bag; i) a crimping assembly configured to place one or more folds in the bag; and j) an offloading assembly configured to receive and transport the bag to a selected location. The carriage conveyor system is configured to convey the bag sequentially from components b-j in order, as listed.

In one embodiment, the bag rotator comprises first and second tapered rollers configured such that at least one tapered surface portion of the first tapered roller confronts at least one tapered surface portion of the second tapered roller; and wherein the bag rotator is configured to receive a leading corner portion of the bag from the automated bag forming system in a flat configuration to engender in-plane rotation of the bag.

In one embodiment, the blade wheel assembly comprises a plurality of circumferentially-disposed blade members about a rotatable blade wheel that are configured to plunge the bottom portion of the bag between two engagement surfaces of the carriage.

In one embodiment, the bag top opener assembly includes a rotatable wheel frame assembly comprising a plurality of circumferentially-disposed opener assemblies in communication with a vacuum source, wherein each of the opener assemblies is configured to urge a top portion of the bag into an open configuration through vacuum force. In one embodiment, the bag top opener assembly comprises two of the rotatable wheel frame assemblies configured in a mirrored-plane orientation with respect to each other; wherein the bag top opener assembly is configured to receive the top portion of the bag oriented substantially coplanar with the mirror plane.

In one embodiment, each of the opener assemblies is coupled to the wheel frame assembly by a frame coupling member, and further configured to be reversibly shiftable with respect to the frame coupling member within a plane of the wheel frame. In one embodiment, the each of the opener assemblies comprises one or more suction cups in communication with the vacuum source and configured to confront the top portion of the bag.

In one embodiment, the funnel positioning system includes a substantially oval-shaped track comprising an upper and a lower cam pathway and a plurality of linked funnels carriages. Each carriage includes a carriage frame coupled with a lower cam follower that rides in the lower cam pathway and a reversibly vertically-shiftable funnel coupled to a support arm which itself is coupled to an upper cam follower that rides in the upper cam pathway. A portion of the upper cam pathway comprises a transition to a lowered pathway portion which urges the support arm to a lowered configuration.

In one embodiment, the flowable substance is oil.

In one embodiment, the injection system includes a plurality of injection nozzles circumferentially disposed about a rotatable wheel assembly. The wheel assembly is configured to rotate at an angular velocity such that passage of the carriage holding the bag coincides with a nozzle being in a substantially lower-most configuration on the wheel assembly. In one embodiment, injection of the flowable substance into the bag occurs when the wheel is in the substantially lower-most configuration on the wheel assembly. In one embodiment, each nozzle is in fluid communication with a variable displacement pump assembly configured to both fill a nozzle cylinder with the flowable substance, and expel the flowable substance from the cylinder.

In one embodiment, the injection system further includes a cylinder cam assembly having a plurality of surfaces on which a cam follower coupled to a intake/expulsion piston is configured to ride and which is configured to engender shifting motion of the piston.

In one embodiment, the cylinder cam assembly further includes a position-adjustable drawback cam having a surface configured to shift the piston so as to draw the flowable substance into the cylinder, a stationary expulsion cam having a surface configured to shift the piston so as to expel the flowable substance from the cylinder into the nozzle, and a stop-limit cam configured to prevent the piston from shifting on an intake stroke beyond a selected limit.

In one embodiment, the variable displacement pump assemblies are configured to circumnavigate the cylinder cam.

In one embodiment, the sealing assembly comprises one or more roller assemblies, each roller assembly comprising a pair of heated rollers and configured to receive a top portion of the bag therebetween for engendering a seal to the top portion of the bag.

In one embodiment, the crimping assembly includes a first rotatable wheel assembly having a plurality of plunger assemblies circumferentially disposed thereupon, and a second rotatable wheel assembly having a plurality of circumferentially-disposed blade members thereupon. The first rotatable wheel and the second rotatable wheel are configured such that as both of the wheels rotate, a portion of each of the blade members is reversibly urged into a portion of a complimentary one of the plunger assemblies. In one embodiment, the crimping assembly is configured to receive a selected portion of the bag between each blade member and a complimentary plunger assembly as the bag bisects the first and the second rotatable wheel assembly to engender a fold in the bag.

In one exemplary aspect, a method of producing a packaged product in an automated process is disclosed. The method includes: a) forming a plurality of individual bags using an automated bag forming system; b) receiving individual bags from the automated bag forming system by a bag rotator and rotating the individual bags for placement onto a carriage of a bag conveyor system; c) urging a bottom portion of the bag into a portion of the carriage using a blade wheel assembly; d) opening a top portion of the bag using a bag top opener assembly; e) positioning one of a plurality of funnels over the bag after the bag has been opened using a funnel positioning system; f) delivering a selected quantity of the product into the bag using a hopper system; g) delivering a selected quantity of a flowable substance into the bag using an injection system; h) sealing a top portion of the bag using a sealing station; i) placing one or more folds in the bag using a crimping assembly; and j) receiving and transporting the back to an selected location using an offloading assembly. In this embodiment, the carriage conveyor system is configured to convey the bag from, in the following order: the bag top opener assembly to the funnel positioning system; to the hopper system; to the injection system; to the sealing station; to the crimping assembly; to the offloading assembly.

In one exemplary aspect, an automated packaging system is disclosed. The automated packaging system includes an automated bag forming system configured to produce a plurality of individual bags in sequence and bag processing systems and methods as described herein for filling the bags with a selected product and placing a bag seal on the bag to store the contents therewithin.

Certain advantages of the systems and methods include significant improvements in packaging speed. For example, in one disclosed embodiment, an automated food packaging system can prepare packaged microwavable popcorn pouches up to four times faster than known systems. Another advantage relates to precision in a folding process used in an automated food packaging system and method. Other advantages will be apparent by the accompanying description, figures, and claims.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings, which may not necessarily be to scale, in which like references indicate similar elements, and in which:

FIGS. 11-14 show various views and components of a funnel positioning system, according to one embodiment;

DETAILED DESCRIPTION OF ILLUSTRATIVE EMBODIMENTS

Figure 1:
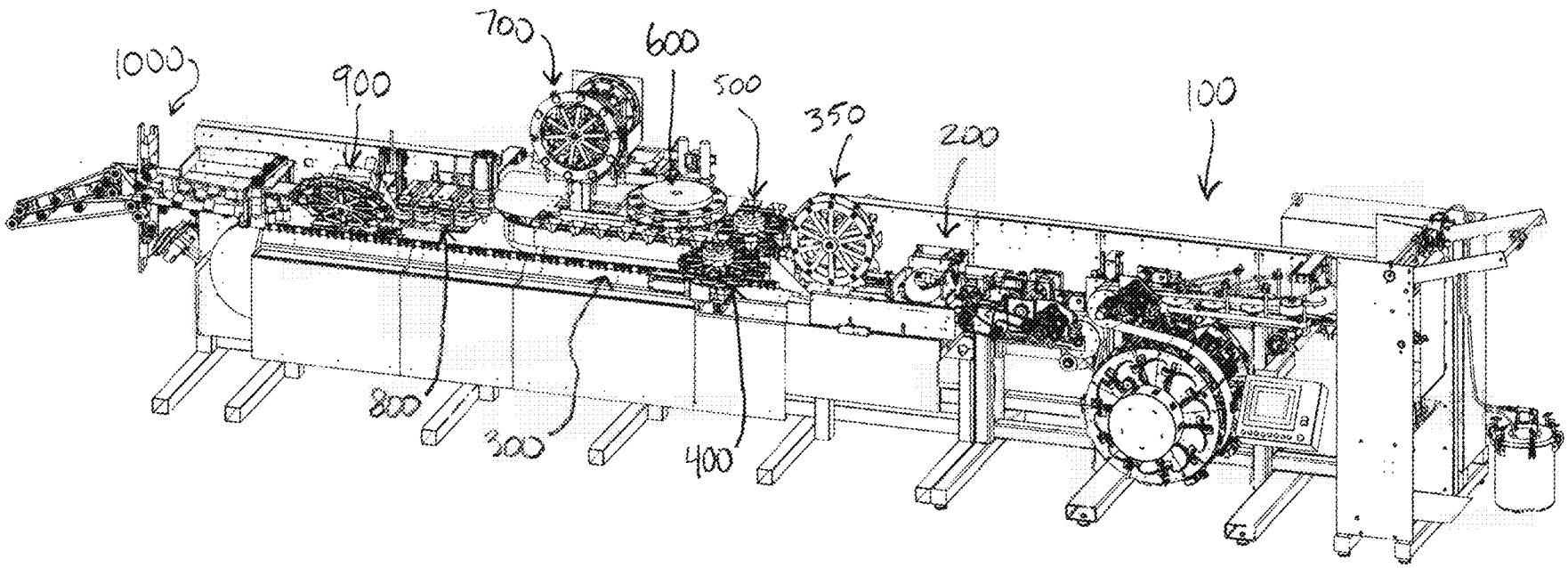
FIGS. 1-1A illustrate an automated food packaging system 1100 in isometric views according to one embodiment.
Figure 1A:
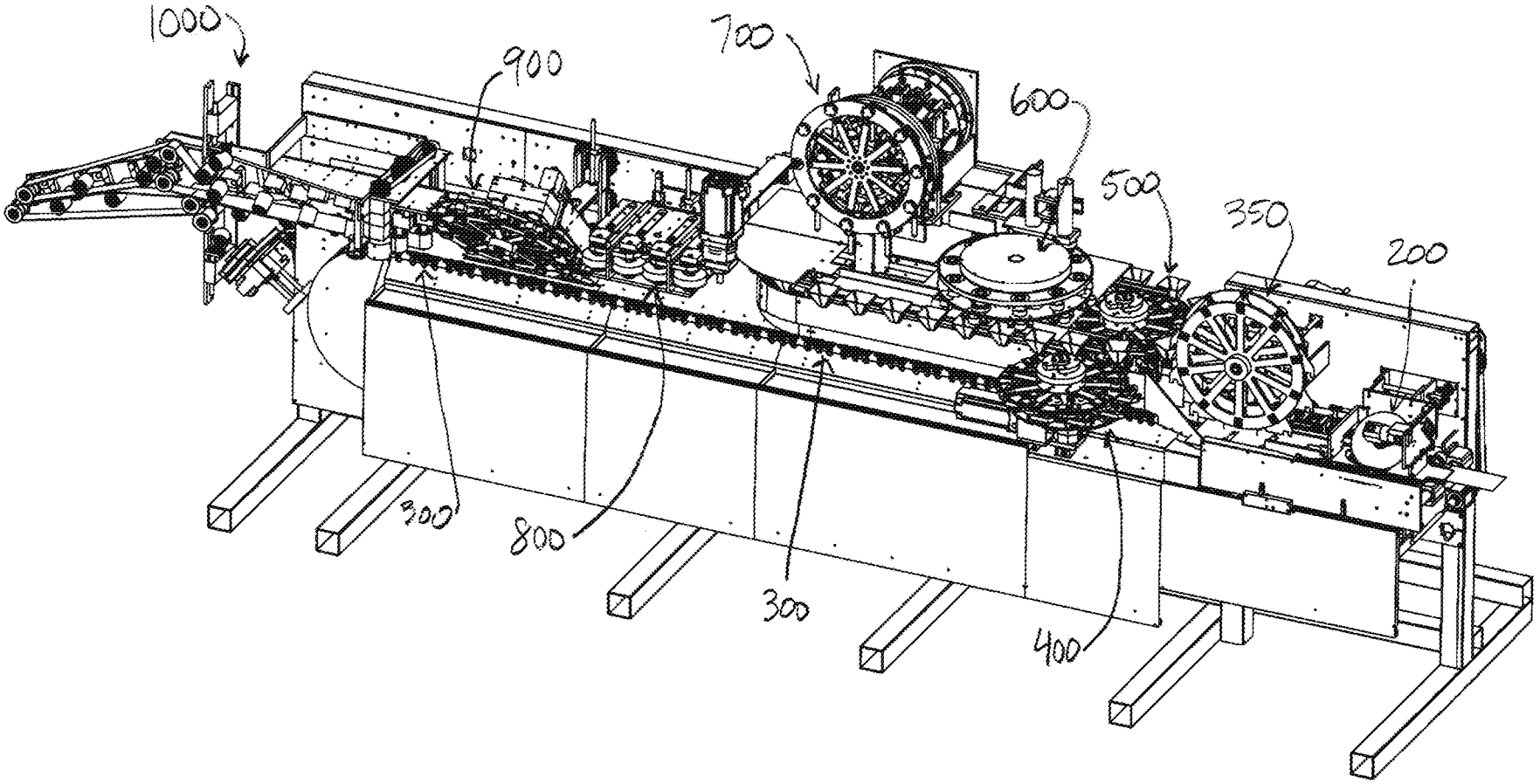

FIG. 1 is an automated food packaging system (hereinafter 'packaging system') 1100 according to one exemplary embodiment; FIG. 1A shows an enlarged view of the system 1100 absent of an automated bag former 100 to better illustrate some of the components described herein and illustrate their configuration as an assembled, operational system. In the description that follows, the packaging system 1100 is described in terms of eleven components, each of which are assembled and operably configured to form packaged food products; the components are described individually herein for readability and ease of understanding.

In this embodiment, the system 1100 provides for a completely automated food packaging process, including forming individual product bags from raw bag material (e.g., a 'web'), adding a desired amount of a food to each bag, and sealing each bag.

For simplicity, the following disclosure describes systems and processes as if applied to a single bag as it moves through the various system components. It should be understood, however, that the system 1100 is capable of running at high speeds to produce more than 400 bags of packaged food products per minute. Indeed, in this and other embodiments, the sequential production of packaged food products is limited only by the availability of raw products, e.g., raw bag material, and the foodstuffs to be disposed therein. Furthermore, while the following system 1100 is configured for adding microwavable popcorn ingredients into bags, it should be understood that the system can be modified or adapted to accommodate any type of packageable foodstuffs or non-food items.

Referring to FIG. 1, in this embodiment, first, an individual bag is formed from a web of bag material by an automated bag forming system 100. The individual bag includes a sealed end and an open end for receiving microwavable popcorn ingredients. Next, the bag is rotated into a processing orientation by a bag rotator 200. The sealed end of the bag is then urged into a carriage member of a carriage conveyor system 300 (not shown in FIG. 1 for figure clarity) by a blade of a blade wheel 350. In doing so, the bag is translated from a horizontal orientation to a substantially vertical orientation. The carriage member is integral with a conveyor system that is configured to translate the bag downstream for further processing as described in greater detail herein. Next, the bag is conveyed to a bag top opener assembly 400 that opens the top of the bag using oppositely-disposed suction cup members. The suction cup members are configured to provide suction force to an upper surface portion of the bag, thereby drawing opposite sides of the bag top in opposite directions.

Next, as the bag is conveyed further, a funnel is positioned within the opened, top portion of the bag by a funnel positioning system 500. The funnel positioning system 500 includes a plurality of funnels in a racetrack configuration and is driven so that the funnels translate around the racetrack in an oval pattern as illustrated. The funnel positioning system 500 is configured so that the carriage member (and hence the bag) and the funnel travel in tandem formation, at substantially the same speed along a straight-away portion of the track. Next, a pre-selected amount of corn kernels are deposited through the funnel and into the bag by a hopper system 600. The bag is further conveyed to an oil injector system which dispenses a pre-selected amount of oil into the bag. While not illustrated in FIG. 1, in this and other embodiments, other ingredients can be added to the bag to provide a desired taste of the finished popcorn product. For example, the hopper system 600 can dispense corn kernels and flavored ingredients such as powdered additives to provide different flavored popcorn. Similarly, the oil injection system 700 can inject oils having flavored additives for the same or other reasons. Furthermore, system 1100 can include other ingredient additive systems, e.g., additional hoppers, oil injection systems or other types of dispensing systems to allow any type of flavoring or additive to be added to the bag.

Next, the bag is conveyed to a sealing assembly 800 where a seal is applied to the top portion of the bag. A crimping assembly 900 applies a fold to the sealed bag at a desired location, e.g., such that the bag can be folded in half, into thirds, etc. Next, the bag is received by an offloading assembly 1000 that is configured to transport the food package to a storage container or to other systems for further processing, e.g., to apply product wrappings.

This disclosure provides, inter alia, bag processing systems and methods for filling bags with a selected product and placing a bag seal on the bag to store the contents therewithin. In one such example, a bag processing system includes the following components arranged in an operable configuration: a) an automated bag forming system; b) a bag rotator; c) a blade wheel; d) a bag top opener assembly; e) a funnel positioning system; f) a hopper system; g) an oil injection system; h) a sealing station; and i) a carriage conveyor system configured to convey the bag sequentially from component b) to component h) in order, each of which are described in greater detail herein.

Sub-systems of the system 1100 are now described in greater detail. It should be understood, however, that various substitutions, modifications, and additions can be made to accommodate different packaging, bags of differing size, or packaging of different food products as desired.

Automated Bag-Forming System 100

In this embodiment, the packaging system 1100 includes an automated bag-forming system 100. The automated bag-forming system 100 can be a system as described in U.S. patent application Ser. No. 14/203,509, filed on Mar. 10, 2014, which is incorporated herein by reference in its entirety. In the description that follows, the 'bag-forming system 100' refers to the automated bag-forming system described in Ser. No. 14/203,509; however, it should be understood that the packaging system 1100 can be configured for use with other bag formers as desired. In general, the bag-forming system 100 can prepare individual bags from a substantially continuous web of bag material. The bag-forming system 100 is capable of placing seals in the web which define a closed end of a bag once the web is cut. In this embodiment, the bag-forming system 100 produces a continuous supply of individual bags for processing as described herein.

Bag Rotator 200

In this embodiment, the bag rotator 200 receives individual bags that are in a substantially flat orientation from the automated bag-forming system 100. Although the bag-forming system 100 can be configured to produce square bags, it is often the case that packaged food bags have a height that is greater than their width. In this embodiment, the bag rotator 200 rotates the flat bags about an axis (the z-axis in FIG. 2) that is perpendicular to their flat surface for further downstream processing.

Figure 2:
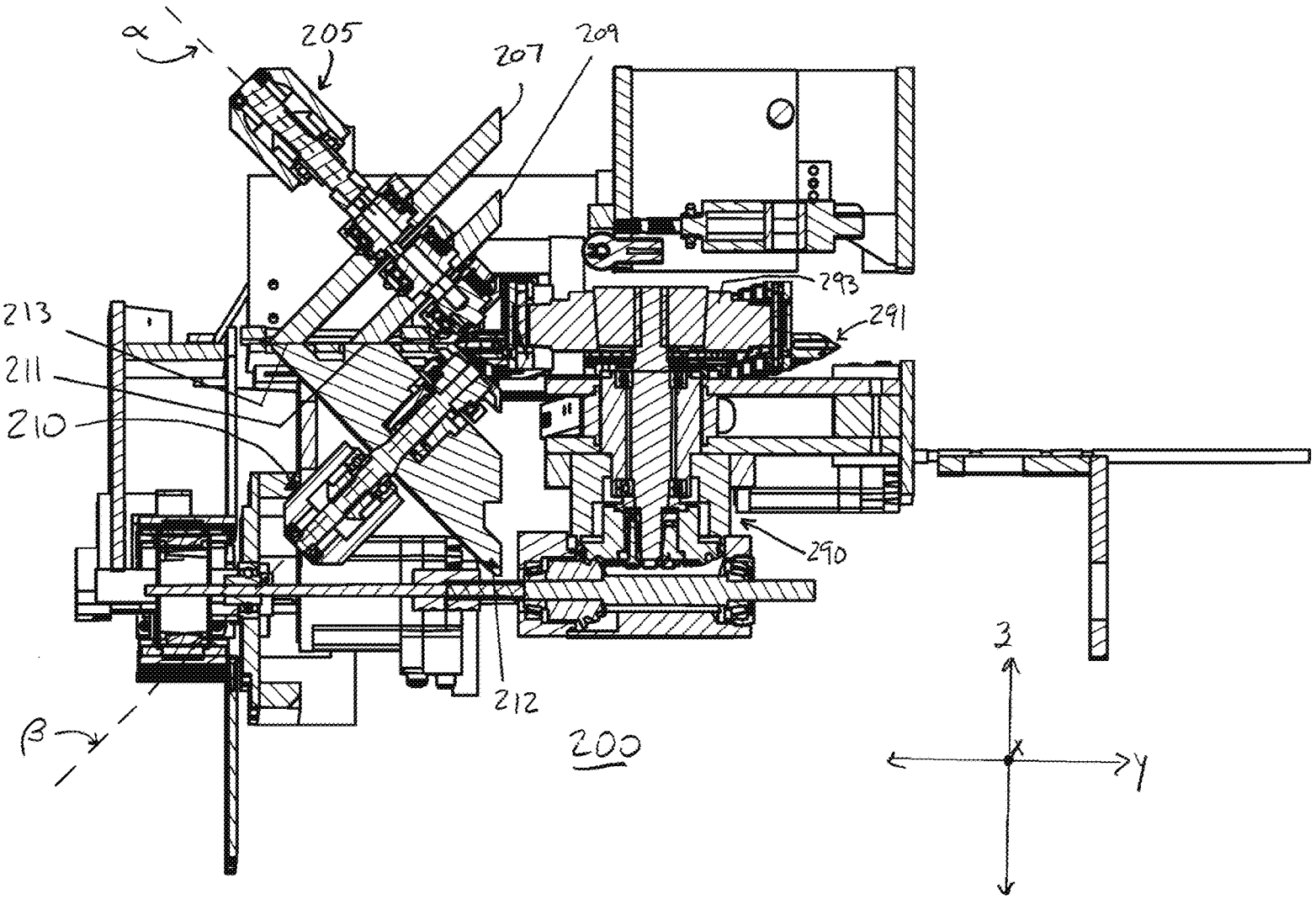
FIGS. 2-3A show various views of a bag rotator, according to one embodiment.
Figure 3:
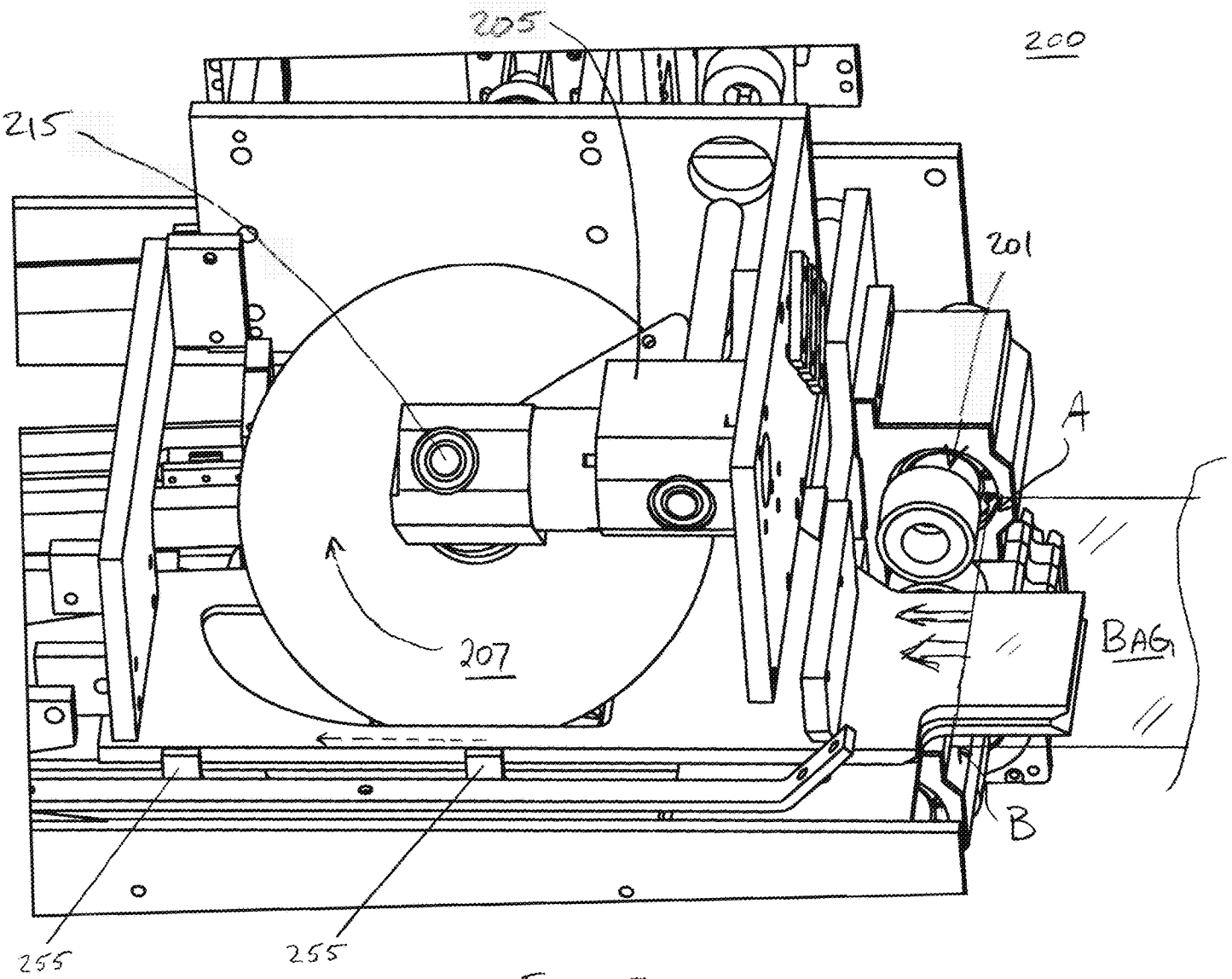

Referring now to FIGS. 2 and 3, the bag rotator 200 is shown in side-elevation and isometric views, respectively, according to one embodiment. In this embodiment, a pair of powered rollers 201 is configured to receive individual bags from the automated bag former 100 and guide it toward the bag rotator 200. In this embodiment, the distance between the rollers 201 and the theoretical intersection of axes α and β (described below) is configurable and generally set to be approximately equal to the length of the bag being processed. The ability to set the distance between rollers 201 and the theoretical intersection of the two axes α, β provides the ability to maintain precise control of the bag during the rotation process.

In this embodiment, the bag rotator includes first and second motor assemblies 205, 210, respectively. The first motor assembly 205 rotationally drives first (207) and second (209) tapered rollers about a first axis α; the second motor assembly 210 rotationally drives a third tapered roller 212 about a second axis β. The second tapered roller 209 includes two surfaces 211, 213 that confront the tapered portions of the first (207) and second (209) tapered rollers respectively, as illustrated. In this embodiment, the first (a) and second ((3) axes are substantially orthogonal. The first and second motor assemblies are configured to rotate each roller 207, 209 in opposite directions to achieve bag rotation as described herein.

In this embodiment, the angled orientation of the confronting tapered roller surfaces provides an acceleration force that increases radially from the theoretical intersection of the two axes α, β to the outer-most edge where the first tapered roller (207) and surface 213 of the third tapered roller (212) confront. Referring specifically to FIG. 3, the bag rotator 200 is oriented and configured so that as the bag approaches the confronting tapered roller surfaces, the right leading corner (denoted A in FIG. 3) intersects the theoretical intersection of the two motor axes; the left leading corner (denoted B in FIG. 3) passes between the confronting tapered rollers.

Thus, because the acceleration is greatest near the outside of the tapered rollers, the bag experiences an in-plane rotational urging force near corner B and substantially no rotational urging force at corner A; this configuration results in the bag rotating ninety degrees in the x-y plane (about the z-axis as denoted in FIG. 2).

In this and other embodiments, the position of the bag rotator components can be configured to accommodate various sizes of bags, such that each bag is cleanly rotated for further processing as described below. Furthermore, in this and other embodiments, walls and other alignment aids can be employed to assist in orienting bags for the subsequent processing steps.

Figure 3A:
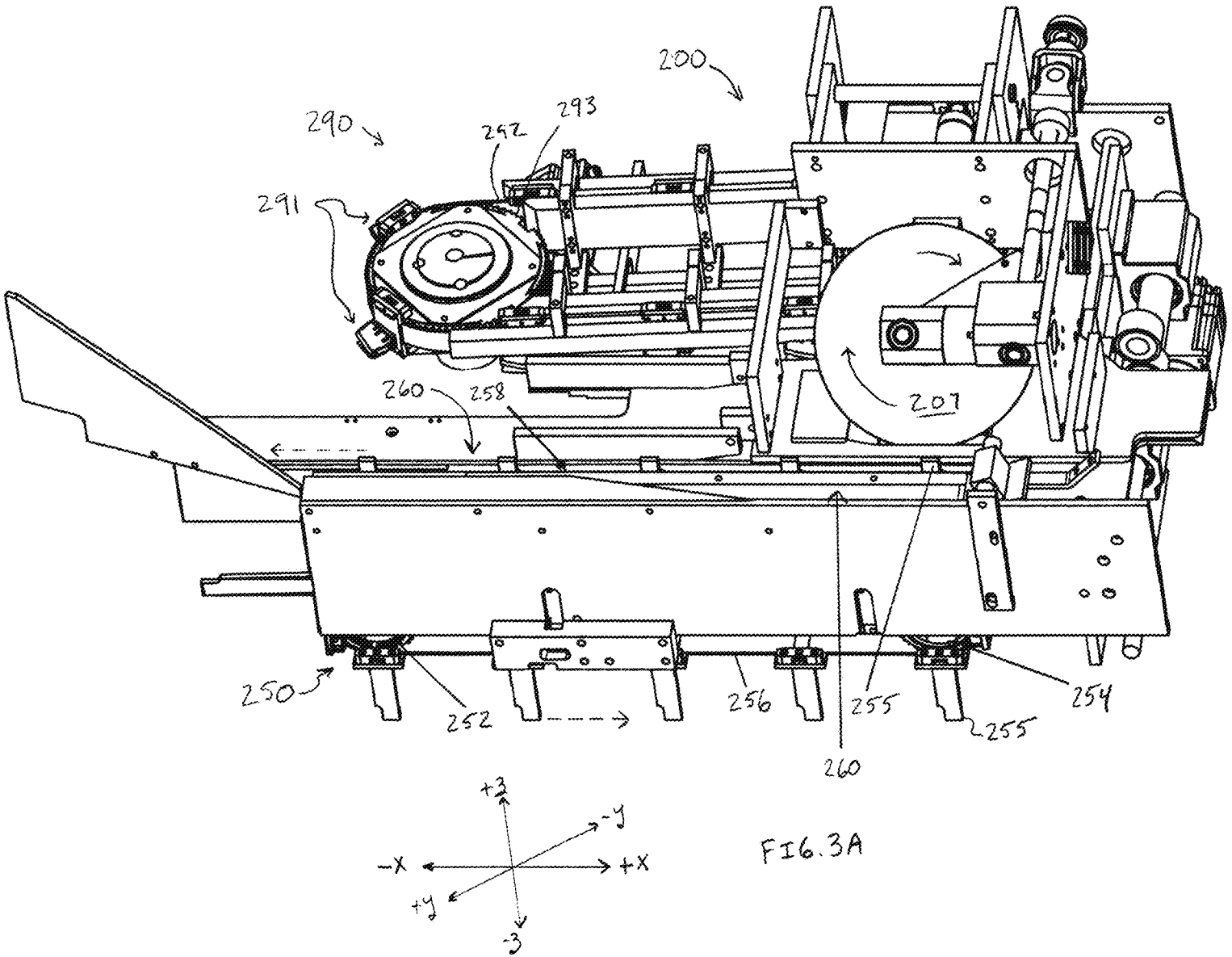

Referring to FIGS. 3 and 3A, in this embodiment, a lug belt conveyor system 250 includes first (252) and second (254) rotationally-driven sprocket assemblies for driving a lug belt 256. In this embodiment, lug belt 256 is driven in a counter-clockwise direction according to the view provided in FIG. 3A. In this embodiment, a plurality of arm pushers 255 are connected to the lug belt 256 and are configured to extend through elongate slot 258 of chute 260. Chute 260 is configured to receive bags after they have been rotated by the bag rotator 200, and the lug belt conveyor system 250 is configured to push each bag downstream (in the −x direction as illustrated in FIG. 3A) via an arm pusher 255. In this embodiment, lug belt 256 is continuous so that as subsequent bags are rotated onto chute 260, an arm pusher 255 immediately conveys each bag downstream. It should be understood that the rotational velocity of the lug belt 256 can be selectively synched with the bag rotator 200 and the speed in which bags are fed from the automated bag forming system 100, so that after rotation, each bag is inserted onto chute 260 in-between successive arm pushers 255.

In this embodiment, a second pusher assembly 290 includes a plurality of pusher cups 291 coupled to a motor-driven belt loop 292. The belt 292 is continuous and configured such that when driven, the pusher cups 291 travel through the area where axes α and β intersect and around belt drive sprocket 293. The rotation of belt 292 is timed such that a pusher cup 291 arrives at the intersection of axes α and β after a bag has been rotated, and serves to push the bag in cooperation with arm pusher 255 down chute 260.

In this embodiment, the bag rotator 200 and lug belt conveyor system 250 can be adjusted to accommodate various bag sizes while remaining optimally timed to cooperate with a carriage conveyor system 300 and blade wheel 350 (described in greater detail herein). In this embodiment, the position of the lug belt conveyor 250 can be adjustable to control placement of subsequent folds in the bag by the blade wheel 350. For example, the lug belt conveyor system 250 can be mounted on a platform that allows the entire assembly to be translated along the ±y axis direction, which can control where, e.g., a bottom fold is placed on each bag by the blade wheel 350.

Carriage Conveyor System 300

Figure 4:
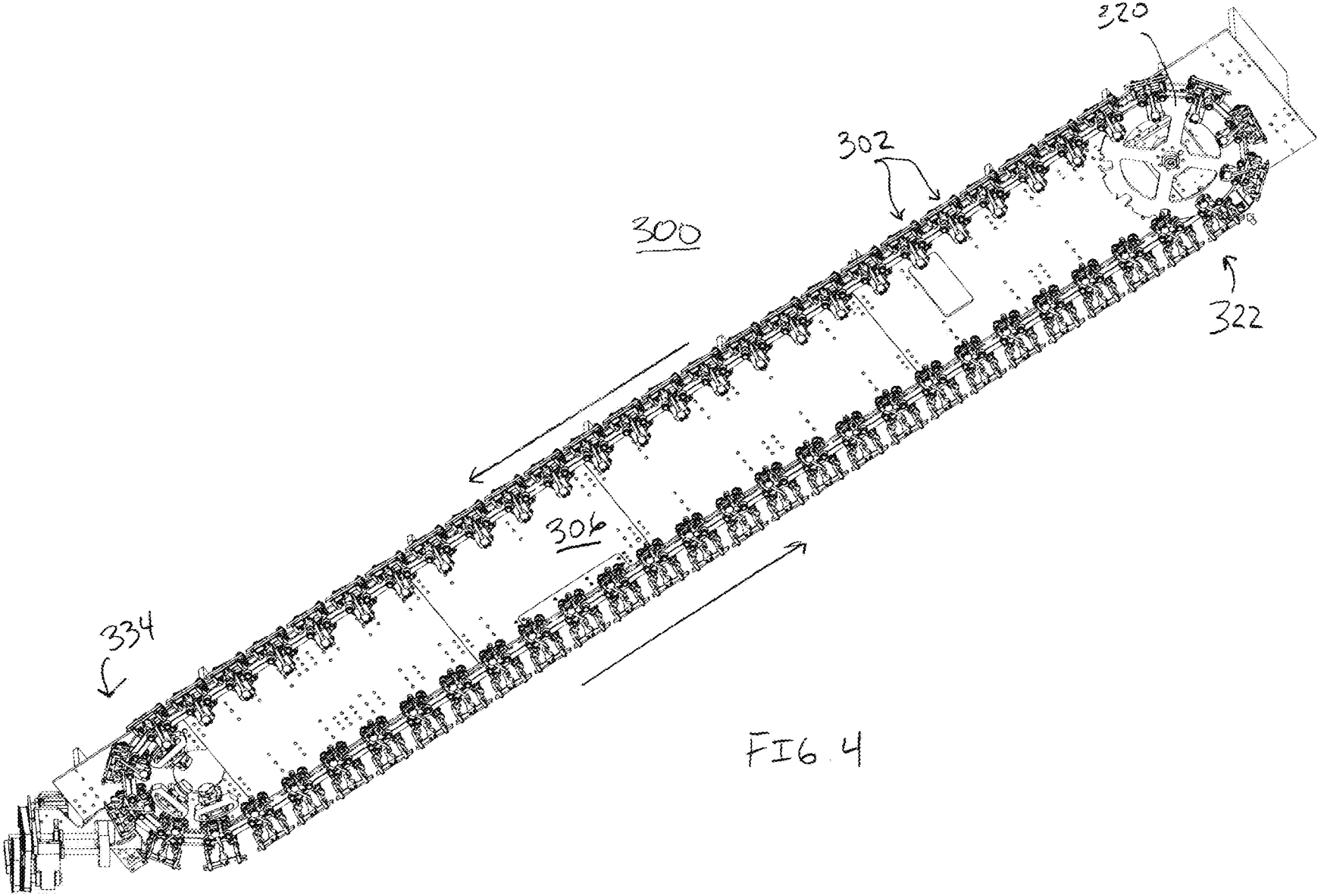
FIGS. 4-6 show various views and components of a carriage conveyor system, according to one embodiment.
Figure 5:
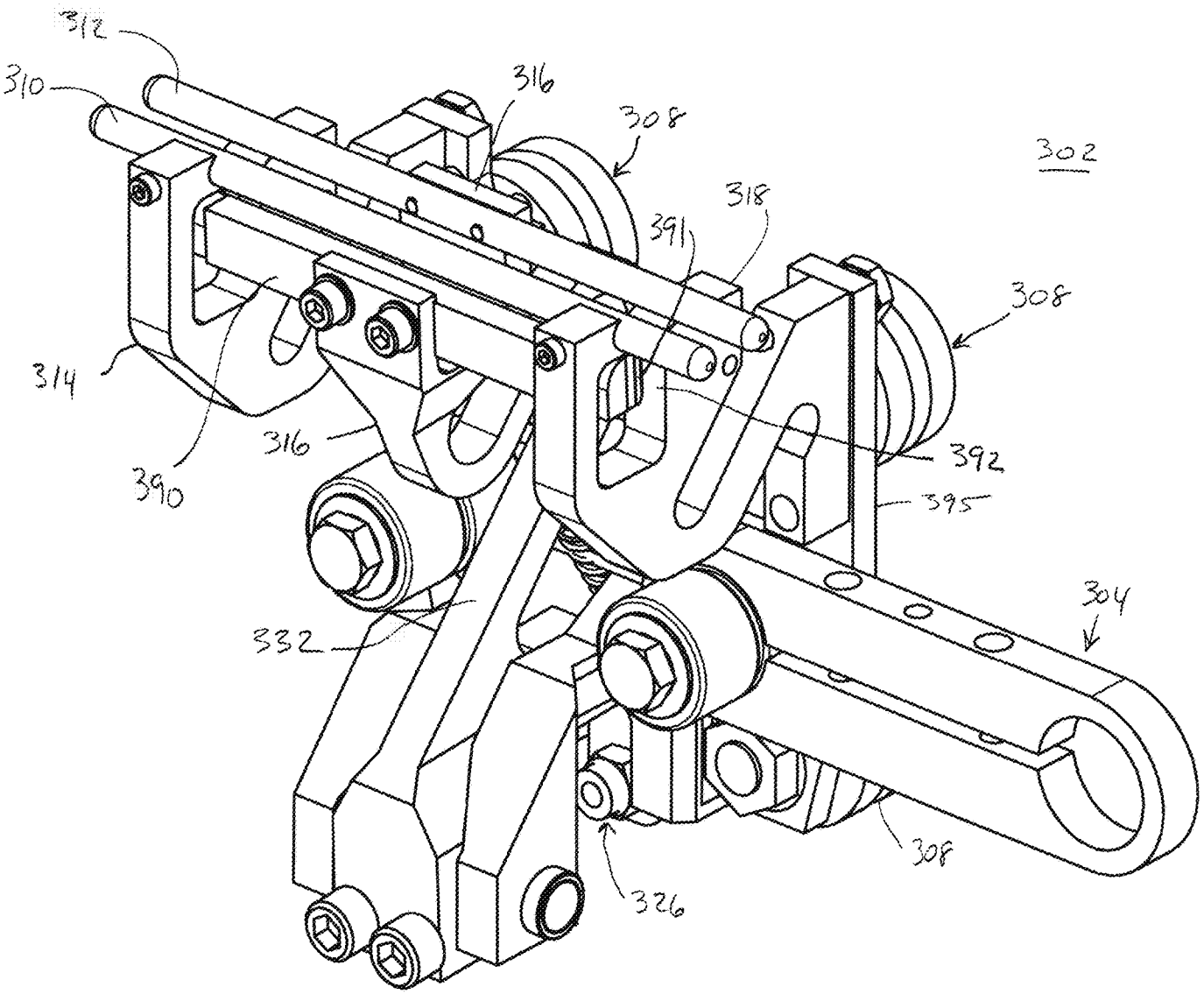
Figure 6:
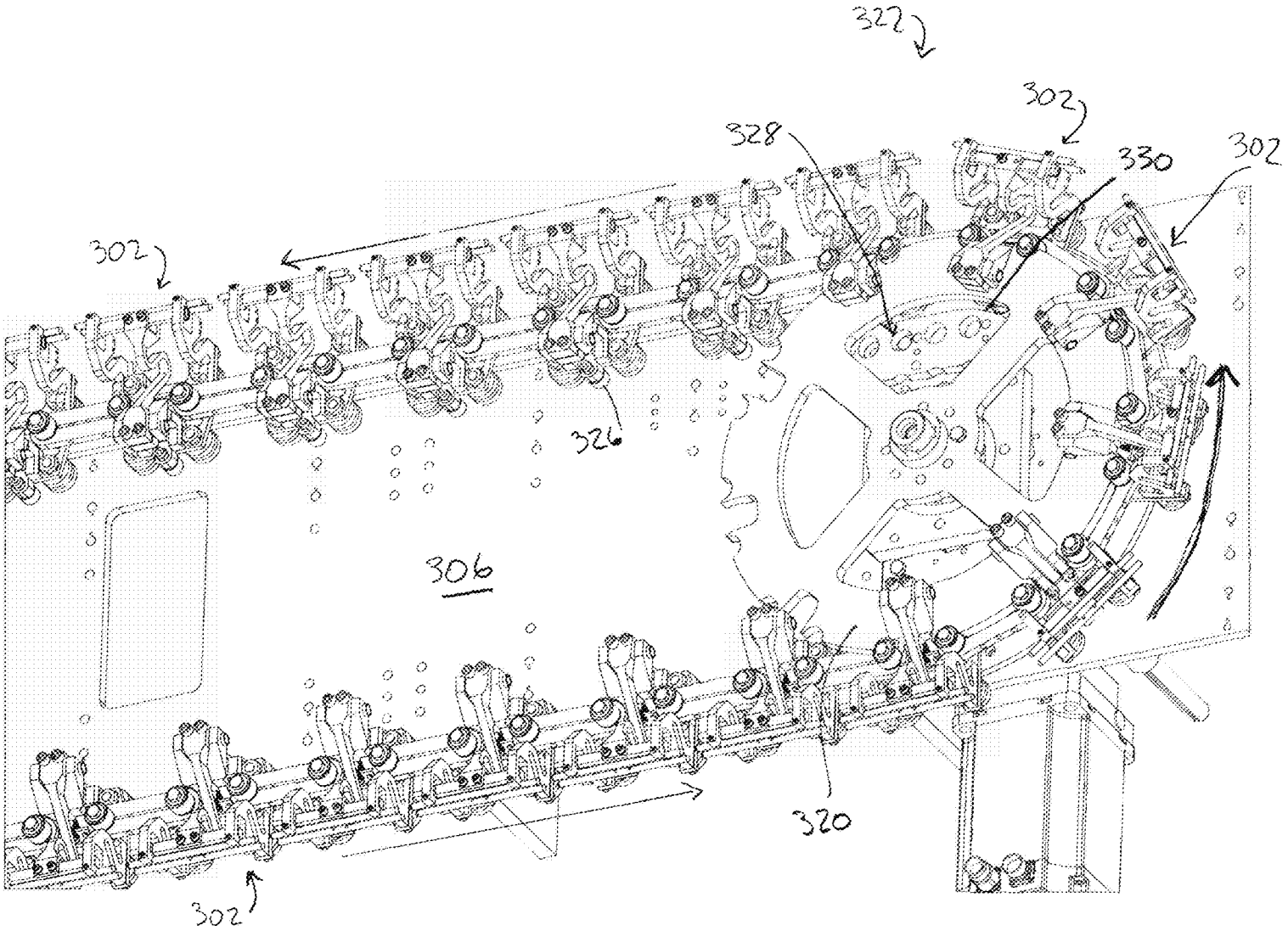

Referring now to FIGS. 4-6, components of the carriage conveyor system 300 are shown in various views according to one embodiment. In this embodiment, bags are conveyed from the bag rotator 200 to the offloading assembly 1000 via the carriage conveyor system 300 which is not visible in FIG. 1 for figure clarity. In this embodiment, the carriage conveyor system 300 includes a plurality of carriages 302; each carriage 302 includes a linkage member 304 to allow the plurality of carriages to be linked together in a chain-like fashion so as to be capable of translating around an elongate, racetrack-shaped beam member 306. In this embodiment, each carriage includes a plurality of rollers 308 configured to engage a V-track that extends circumferentially about the beam 306 which defines the substantially oval path of the carriage members as illustrated by the arrows in FIG. 4.

Figure 5A:
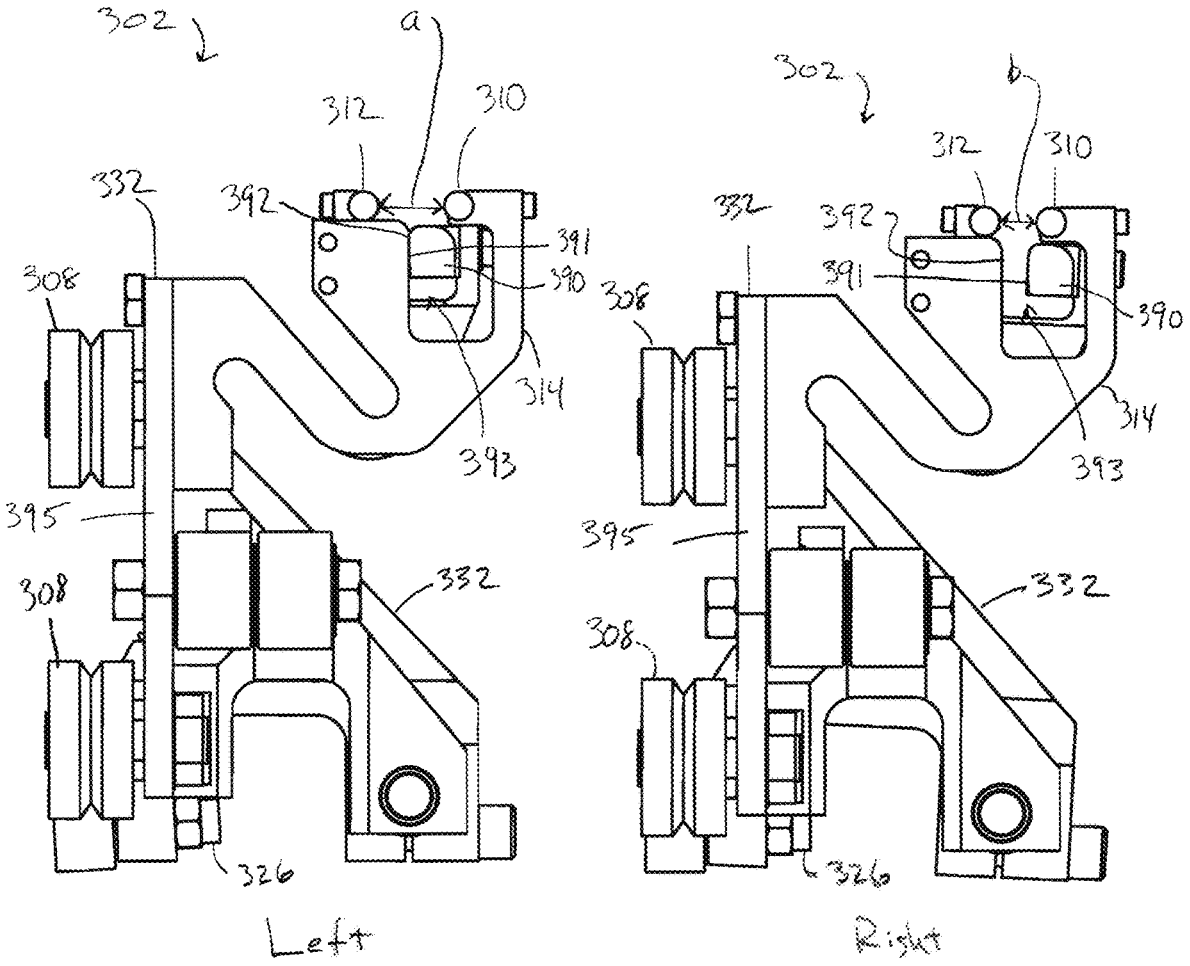

Referring to FIGS. 5 and 5A, a carriage member 302 is illustrated according to one embodiment. In this embodiment, rollers 308 are coupled to a main frame body 395 that allow the carriage 302 to ride along the track in a substantially vertical orientation, e.g., as illustrated in FIG. 5A. The carriage includes first and second stationary support arms 314, 318 which support bar member 310. A third, pivotable support arm 316 supports bar member 312 and is integral with a linkage arm 332 which itself is coupled to cam follower 326. Pivotable support arm 316 is also coupled to engagement body 390 which has an engagement surface 391 as illustrated. Pivoting motion of the support arm 316 is engendered by the movement of the cam follower 326 as described in greater detail herein.

Referring specifically to FIG. 5A, the left and right illustrations show movement of the engagement body 390 relative to engagement side portion 392 of support arms 314 and 318 (only engagement side portion 392 of support arm 318 is illustrated in FIG. 5A for clarity). Referring first to the left side illustration, the cam follower 326 is in a first position which corresponds to a confronting relationship between the engagement body 390 and the engagement side portion 392, and an open (maximally displaced) distance a between bar members 310 and 312. The right side illustration shows the cam follower 326 in a second position which corresponds to an open relationship between the engagement body 390 and the engagement side portion 392, and a closed (minimally displaced) distance b between bar members 310 and 312.

Referring to FIGS. 5 and 6, in this embodiment, the bar members 310, 312 and the engagement body 390 can be shifted between open and closed configurations by an urging force engendered by cam follower 326 engaging a cam bar 328 having a curved engagement surface 330. Referring to FIG. 6 in particular, in this embodiment, as the carriage translates in a counter-clockwise direction (as illustrated by the arrows) the cam follower 326 engages the engagement surface 330 as the carriage transitions from a vertical to horizontal direction. The engagement surface 330 urges the cam follower 326 in an upward direction which causes the linkage arm 332 to shift. Shifting of the linkage arm 332 causes synchronous shifting of the engagement body 390 and bar member 312, e.g., to open or close depending on the engagement of the cam follower 326 against the cam bar 328. Thus, the bar members 310, 312 and the engagement of engagement body 390 against the engagement side portion 392 cooperate in a clip-like fashion and are configured to hold a bag in a substantially vertical orientation as the bag is translated downstream in the system 1100. In this embodiment, the bag is held in a vertical orientation by a bottom portion of the bag being sandwiched between the engagement body 390 and the engagement side portion 392. In this and other embodiments, the amount of spring resistance between bar members 310, 312 can be adjusted as needed to provide a secure carriage system for any type of bag being processed by the system 1100.

In this embodiment, carriages 302 of the conveyor system 300 are driven by a drive socket 320 at a proximal end portion 322 of the beam member 306. A drive socket is disposed at distal end portion 334 of beam member 306; however it has been omitted from FIG. 4 for clarity of the illustration.

Blade Wheel Assembly 350

Figure 7:
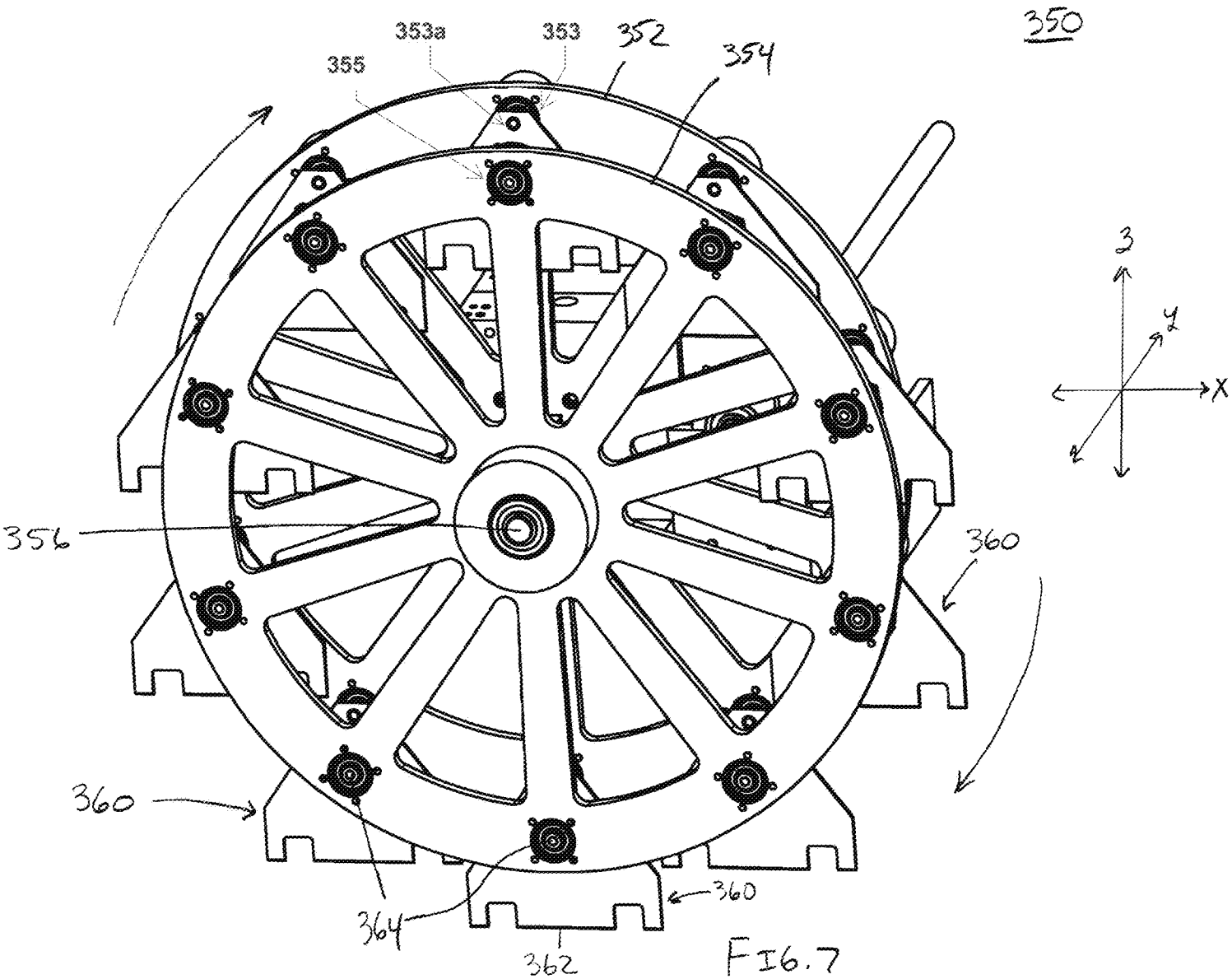
FIG. 7 illustrates a blade wheel, according to one embodiment.

Referring now to FIG. 7, blade wheel assembly 350 is illustrated according to one embodiment. In this embodiment, the blade wheel assembly 350 includes two rotatable, offset wheels 352, 354 that, in this embodiment, rotate in the clockwise direction as illustrated by the arrows. A motor (not illustrated) controllably drives a hollow-bore gear box which, in turn, drives a hollow shaft onto which wheel 352 is coupled to engender rotation of the wheel 352. Wheel 354 rotates about axis 356 of an offset block which is coupled to the hollow shaft. The offset block lowers wheel 354 with respect to wheel 352 a selected distance, e.g., one and a half inches.

In this embodiment, a plurality of blades 360 are circumferentially disposed about wheel 352 and coupled thereto using a bearing assembly 353. An axle of the bearing assembly 353 extends through an upper aperture 353*a* of the blade 360. Each blade 360 also includes a lower aperture 355*a* (illustrated in FIG. 7A) which receives an axle from a second bearing assembly 355 disposed on wheel 354. In this configuration, wheel 354 acts as an idler roller and operates to maintain bottom surface 362 of the blade(s) 360 in a downward orientation (e.g., in the −z direction as illustrated) as the blade wheel assembly 350 rotates. In other words, as the blade wheel assembly 350 rotates, the orientation of the blades 360 remains the same.

In this embodiment, the blade wheel 350 is disposed downstream of the bag rotator 200 and in close proximity to the proximal end portion 334 of the carriage conveyor system 300. Rotation of the blade wheel assembly 350 is configured to be synchronized with the carriage conveyor system 300. In particular, the blade wheel assembly 350 is configured to rotate an angular velocity such that as a bag is offloaded from chute 260 to the carriage conveyor system 300, a bottom portion of the bag is confronted on opposite (bottom and top, −z and +z) sides by a carriage 302 of the carriage assembly and a blade 360 of the blade wheel 350, respectively. At this point, the bar members 310, 312 of the carriage are in an open configuration to receive the bottom portion of the bag in the U-shaped cavity of the carriage 302.

The blade wheel 350 is configured such that as the carriage 302 and the bag passes beneath the wheel, the blade 360 plunges the bottom portion of the bag into the U-shaped cavity of the carriage. As the bag and the carriage 302 continue downstream, cam follower 326 disengages from the curved engagement surface 330 of the cam bar 328, shifting bar member 310 to a closed configuration which asserts a clamping force unto the bottom portion of the bag. As the blade wheel 350 continues to rotate away from the lower-most position on the wheel, the blade 360 lifts away from the carriage, leaving the bottom portion of the bag reversibly clamped therein. In this manner, each bag exiting the bag rotator 200 has a bottom portion clamped into a carriage of the carriage conveyor system so that it can be transported downstream for further processing by the system 1100. As the carriage begins to transport the bag downstream, it is first urged into a vertical orientation by a stationary frame member (not shown in FIG. 7).

In this and other embodiments, the blade wheel 350 can be phased relative to various upstream components of the system 1100 so that as a bag exits the bag rotator 200, the bottom portion of the bag, e.g., the targeted portion of the bag where a fold is desired, is optimally confronted on opposite sides by a carriage 302 and a blade 360 as described previously. In particular, in this embodiment, the blade wheel 350 is phased with the carriage conveyor system 300 such that, during operation, blades 360 confront carriages 302 in an orientation where each component is substantially centered with respect to the other. For example, the timing between the formation of a bag, e.g., when the cut is made by the automated bag forming system 100 and the point at which the blade plunges the bottom portion of the bag into the carriage can be optimally phased by introducing an appropriate spatial separation between components, by adding a translation delay, by adjusting servo motors that feed the bag rotator at a selected velocity or frequency, or by other methods. Such adjustments can also be made to accommodate bags of varying length or other size dimensions.

Figure 7A:
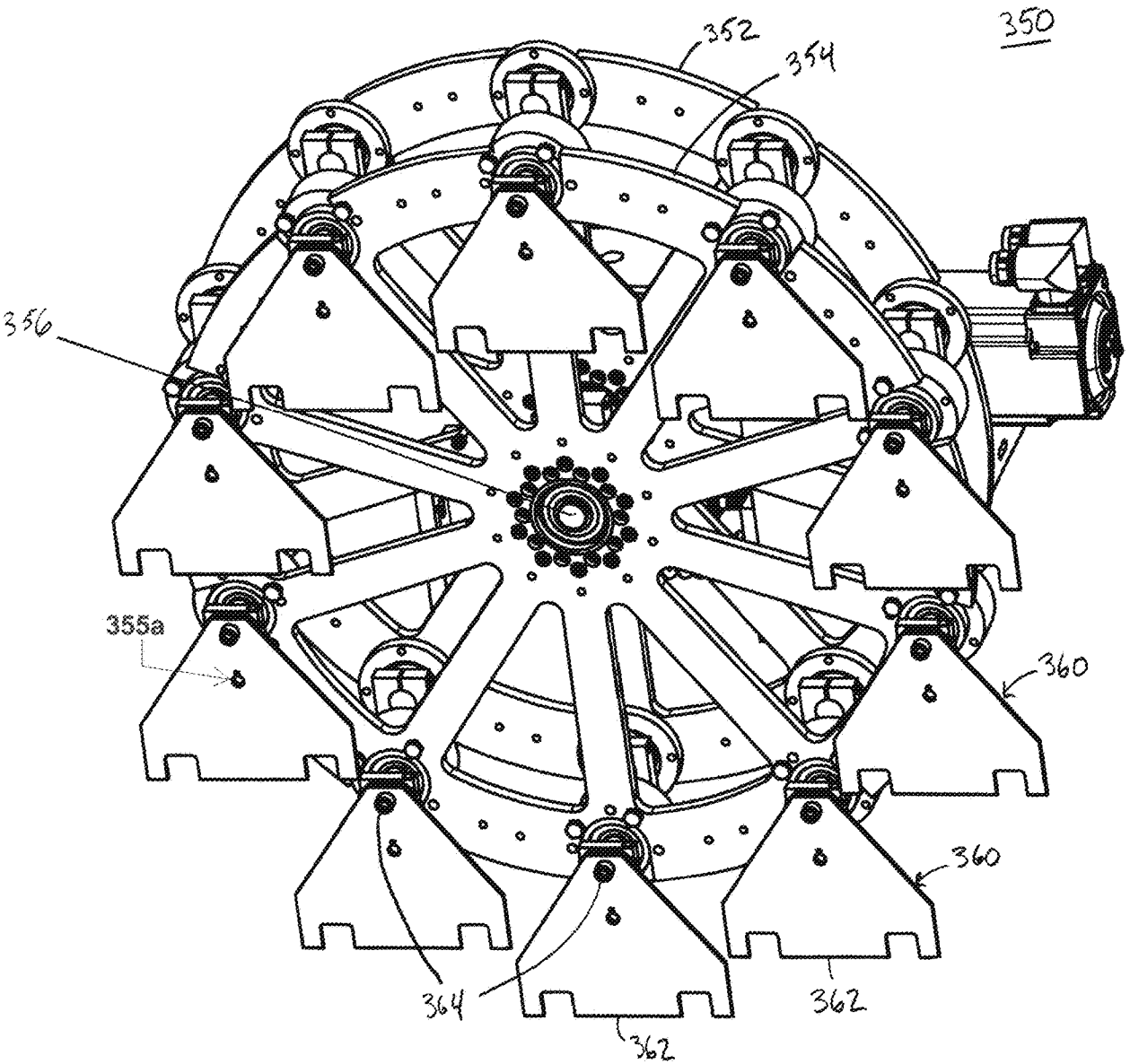
FIG. 7A illustrates a blade wheel according to one alternative embodiment.

FIG. 7A illustrates blade wheel 350 configured according to an alternative embodiment. In this embodiment, each blade 360 is disposed on an outside portion of wheel 354 as opposed to between wheels 352 and 354. In this embodiment, the entire blade wheel 350 assembly is shifted slightly such that the orientation of the blades 360 are aligned with carriages 302 and perform the same function as described with respect to FIG. 7. The instant embodiment can be advantageous in circumstances where it is desired to reduce the likelihood of grease (e.g., food-grade grease) inadvertently dripping from a blade axle bearing into a bag.

Bag Top Opener Assembly 400

Figure 8:
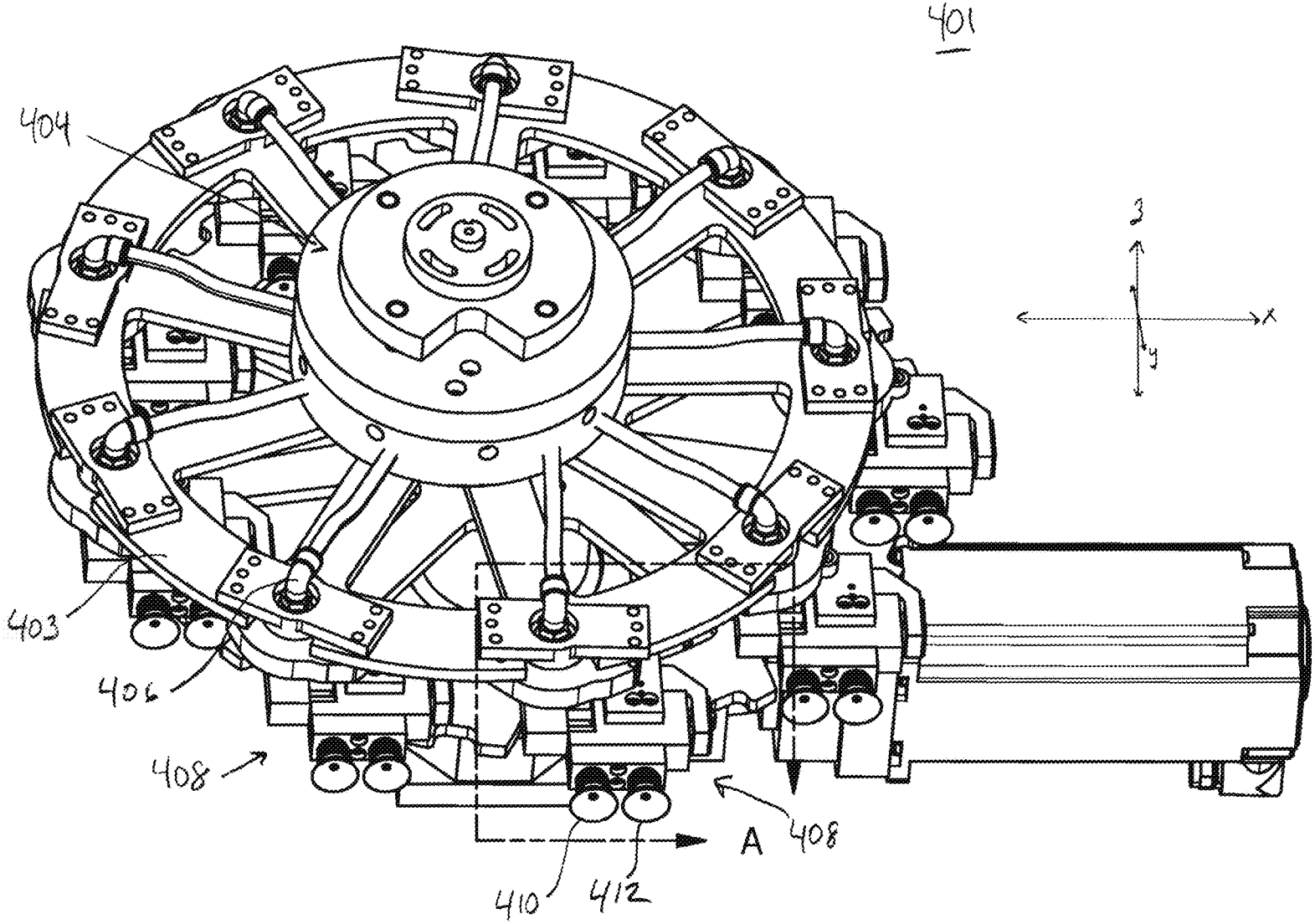
FIGS. 8-10B show various views and components of a bag top opener assembly, according to one embodiment.
Figure 9:
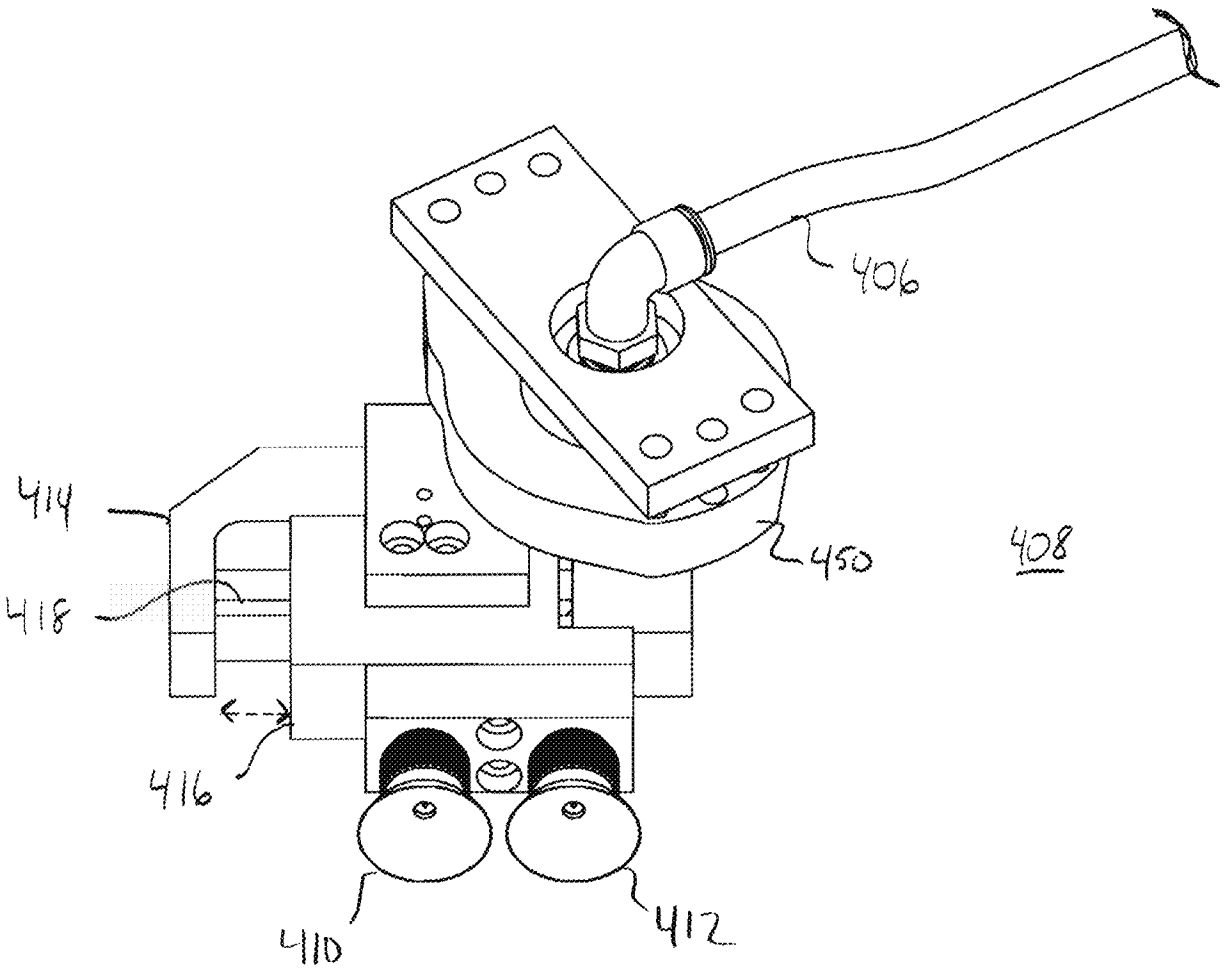
Figure 10:
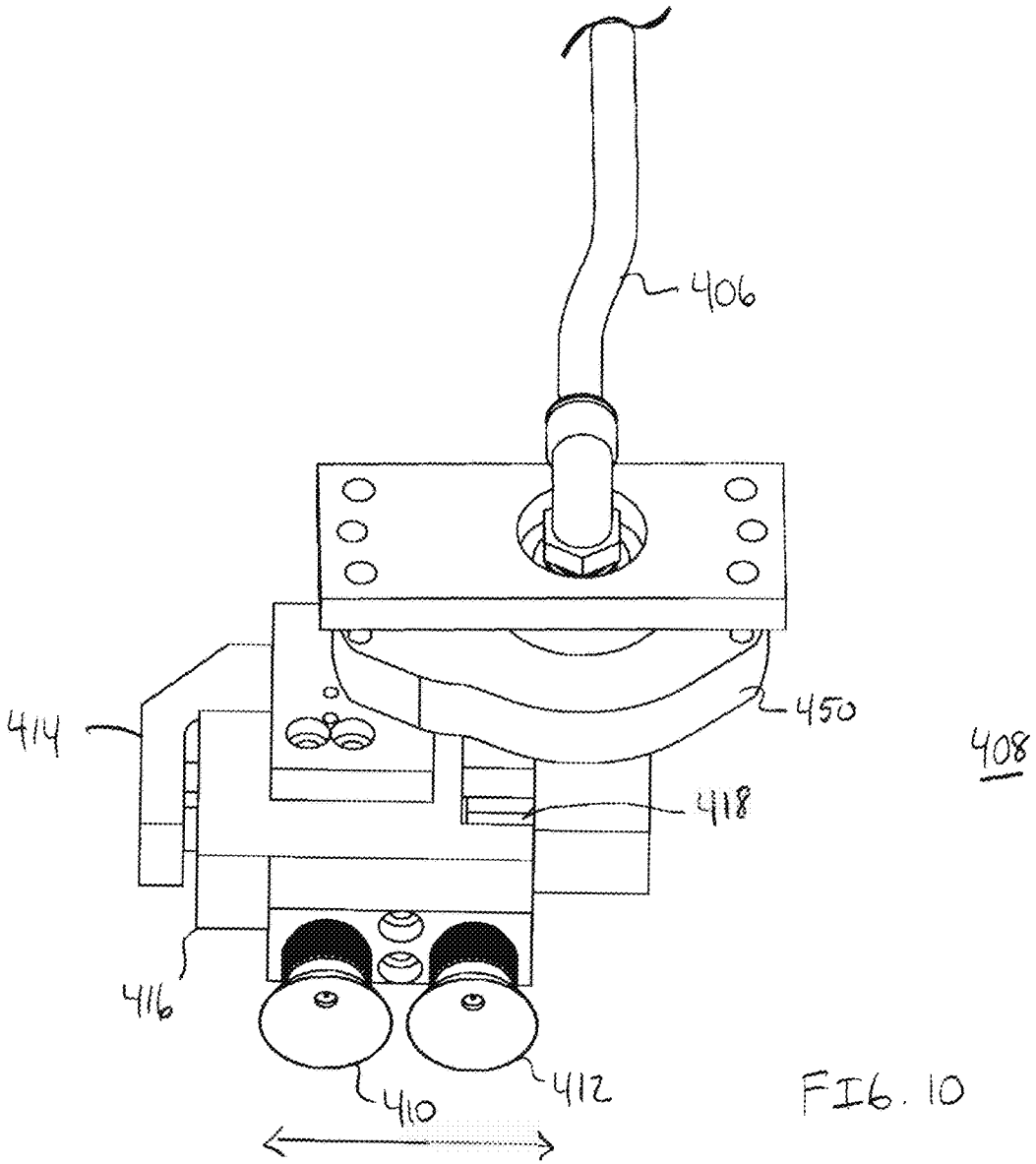

Referring now to FIGS. 8-10, a first bag top opener 401 of the bag top opener assembly 400 is illustrated according to one embodiment. It should be understood that, in this embodiment, the bag top opener assembly 400 includes first and second bag top openers 401, 402, respectively. The second bag top opener 402 is substantially the same as the first bag top opener 401 and is configured opposite the first bag top opener 401 in a mirror of the x-z plane as illustrated, e.g., in FIG. 11A. The second bag top opener 402 is not illustrated in FIG. 8 for the sake of drawing clarity. It should be understood, however, that the second bag top opener 402 is configured and positioned such that as each bag top opener rotates, the complimentary suction cups 410, 412 from each opener assembly 408 (described below) are brought to a substantially confronting relationship (ignoring the spacing between complimentary suction cups for receiving the top portion of a bag). As such, in this embodiment, the first bag top opener 401 rotates clockwise, and the second bag top opener 402 rotates counterclockwise, each about a z-axis.

In this embodiment, the first and second bag top openers 401, 402 cooperate to open the top of the vertically-oriented bag by pulling opposite top side portions of the bag in opposite directions. FIG. 8 shows an isometric view of the first bag top opener 401, which includes a rotatable wheel frame 403. Vacuum hub 404 is concentrically aligned with the wheel frame 403 and provides vacuum via individually-dedicated vacuum conduits 406 to a plurality of opener assemblies 408 circumferentially disposed on the wheel frame 403. In this embodiment, each opener assembly 408 includes two suction cups, 410, 412 in vacuum communication with the vacuum conduit 406.

Referring to FIGS. 9 and 10 in particular, in this embodiment, the suction cups 410, 412 are coupled to a slidable platform 416 capable of reversibly shifting laterally (in the +x and −x directions, as indicated by the double-headed arrow) along shaft 418, which itself is coupled to stationary frame coupling member 414. Frame coupling member 414 is rotationally coupled to cam follower housing 450 which is described in greater detail with respect to FIGS. 10A and 10B. FIG. 9 illustrates the slidable platform 416 in a first shifting configuration, disposed more toward the +x travel limit, and FIG. 10 illustrates the slidable platform 416 shifted in the −x direction. In an alternative embodiment, slidable platform 416 can be coupled to frame member 414 via a linear bearing assembly (not illustrated in FIGS. 9-11) which can be advantageous in reducing friction wear between the two components.

In this embodiment, the first and second bag top openers 401, 402 are driven by motors that engender rotation of the openers 401, 402 in opposite directions, e.g., clockwise and counter-clockwise, respectively. The openers 401, 402 are configured such that the plane of each respective wheel assembly (e.g., wheel assembly 403) is parallel and co-planar with the other wheel assembly. Furthermore, the first and second bag top openers 401, 402 are configured such that as each wheel rotates, the suction cup pair (410, 412) of an opener assembly on the first bag top opener 401 is brought into a substantially confronting, mirrored orientation with the suction cup pair of an opener assembly on the second bag top opener 402 at the juxtaposition of the two wheel assemblies.

In this embodiment, carriages 302 of the carriage conveyor system 300 are configured to convey a top portion of the vertically-oriented bag through the juxtaposition of the first and second bag top openers 401, 402 as the bag is conveyed downstream. As this occurs, the suction cups 410, 412 are brought into confronting relationships with, and are coupled to opposite sides of the top portion of the bag by vacuum force.

Since the downstream speed of the carriage 302 is constant in this embodiment, the slidable platform 416 allows the suction cups 410, 412 to remain coupled to the side of the bag as the bag passes through the juxtaposition of the bag top openers 401, 402 without creating a drag force. For example, the opener assemblies 408 travel in a circular motion, and confront the bag substantially along the tangent of the juxtaposition of the openers 401, 402. As the bag is conveyed downstream, the opener assembly could introduce a drag force as the velocity component of each opener in the +/−x direction (along the tangent) is transferred to a +/−y component if it were not allowed to shift along the x-axis. Thus, the slidable platform 416 provides the capability for the suction cups 410, 412 to shift in the downstream direction (along the x-axis) as the bag is conveyed through the juxtaposition of the bag top openers 401, 402 for an ample period of time to create sufficient vacuum force to pull opposing top side portions of the bag apart. Rotation of the wheel assembly 403 naturally shifts each opener assembly 408 away from one another after the point at which they are brought to a substantially confronting relationship. Because each opener assembly 408 is coupled to an opposite side of the bag through vacuum force at or near this point, such shifting pulls opposing sides of the top portion of the bag into an open configuration ready to receive its intended contents.

Figure 10A:
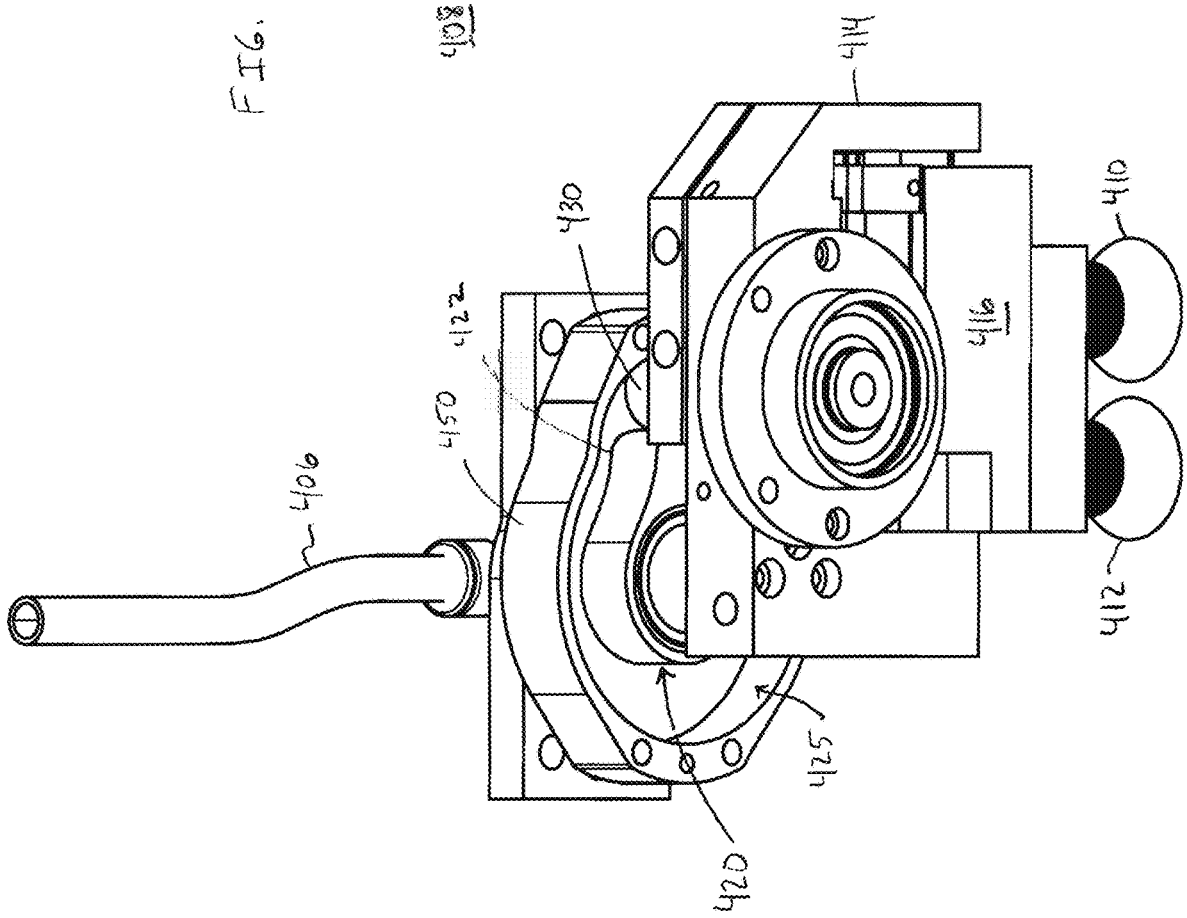
Figure 10B:
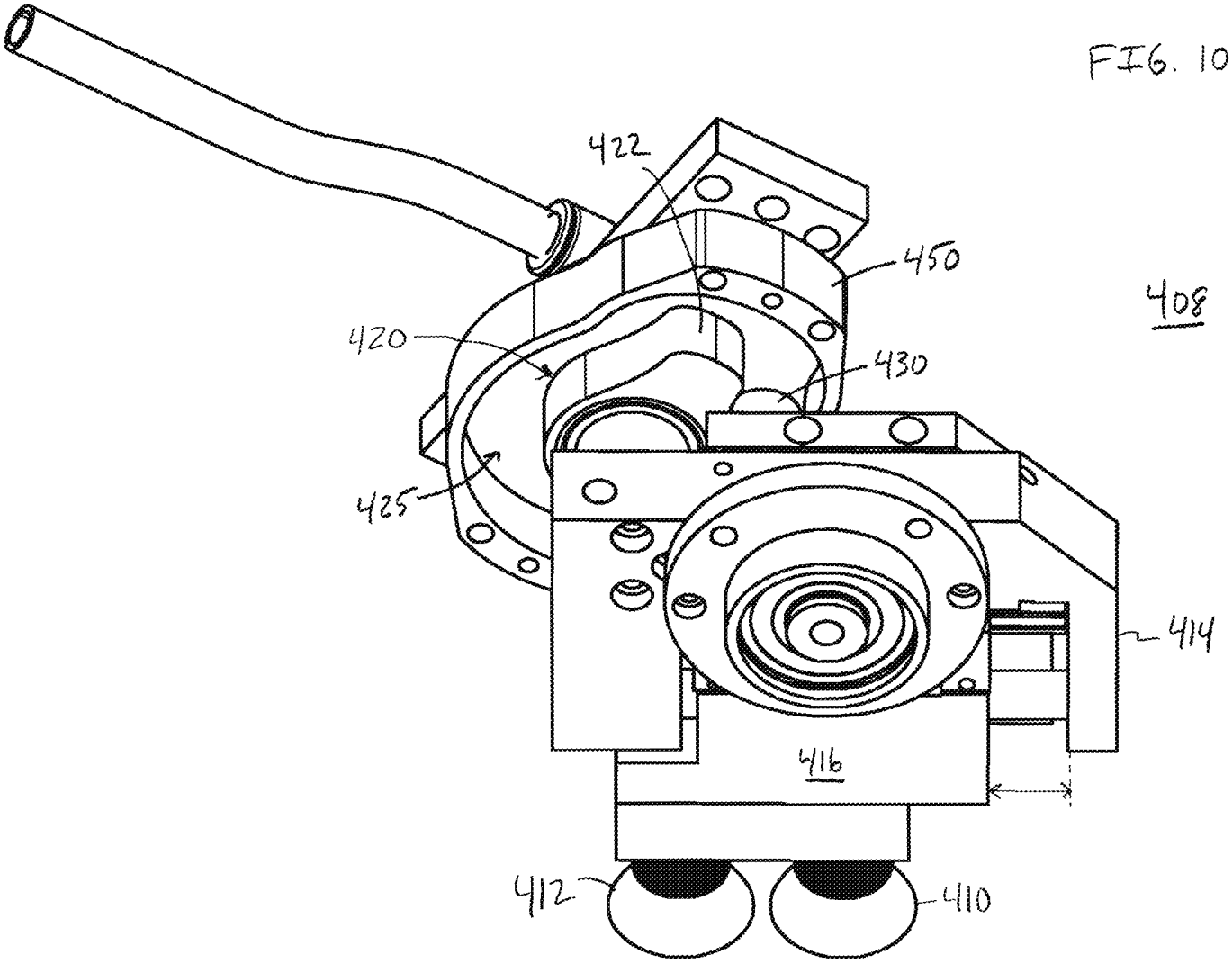

FIGS. 10A and 10B illustrate a bottom view of an opener assembly 408 according to one embodiment. In this embodiment, FIG. 10A corresponds to the configuration of the opener assembly shown in FIG. 9, and FIG. 10B corresponds to the configuration of the opener assembly shown in FIG. 10. In this embodiment, the underside of cam follower housing 450 is substantially hollow and includes a substantially teardrop-shaped hub 420. The space between hub 420 and the outer wall of the cam follower housing defines a track 425 within which bearing 430 of slidable platform 416 rides, and serves to laterally shift platform 416 as previously described as opener assembly is circumferentially translated by rotating wheel assembly 403.

Funnel Positioning System 500

Figure 11:
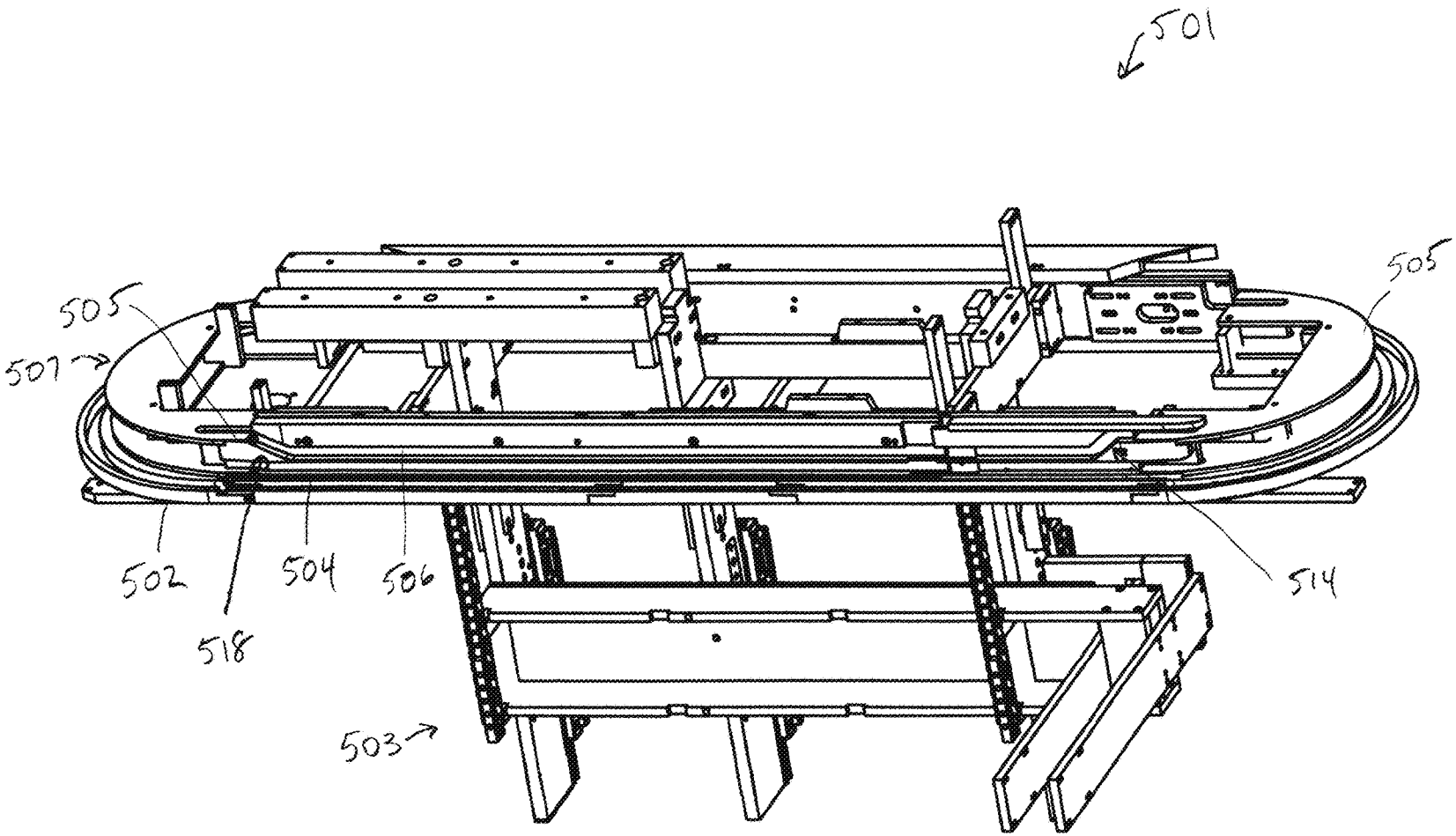
Figure 11A:
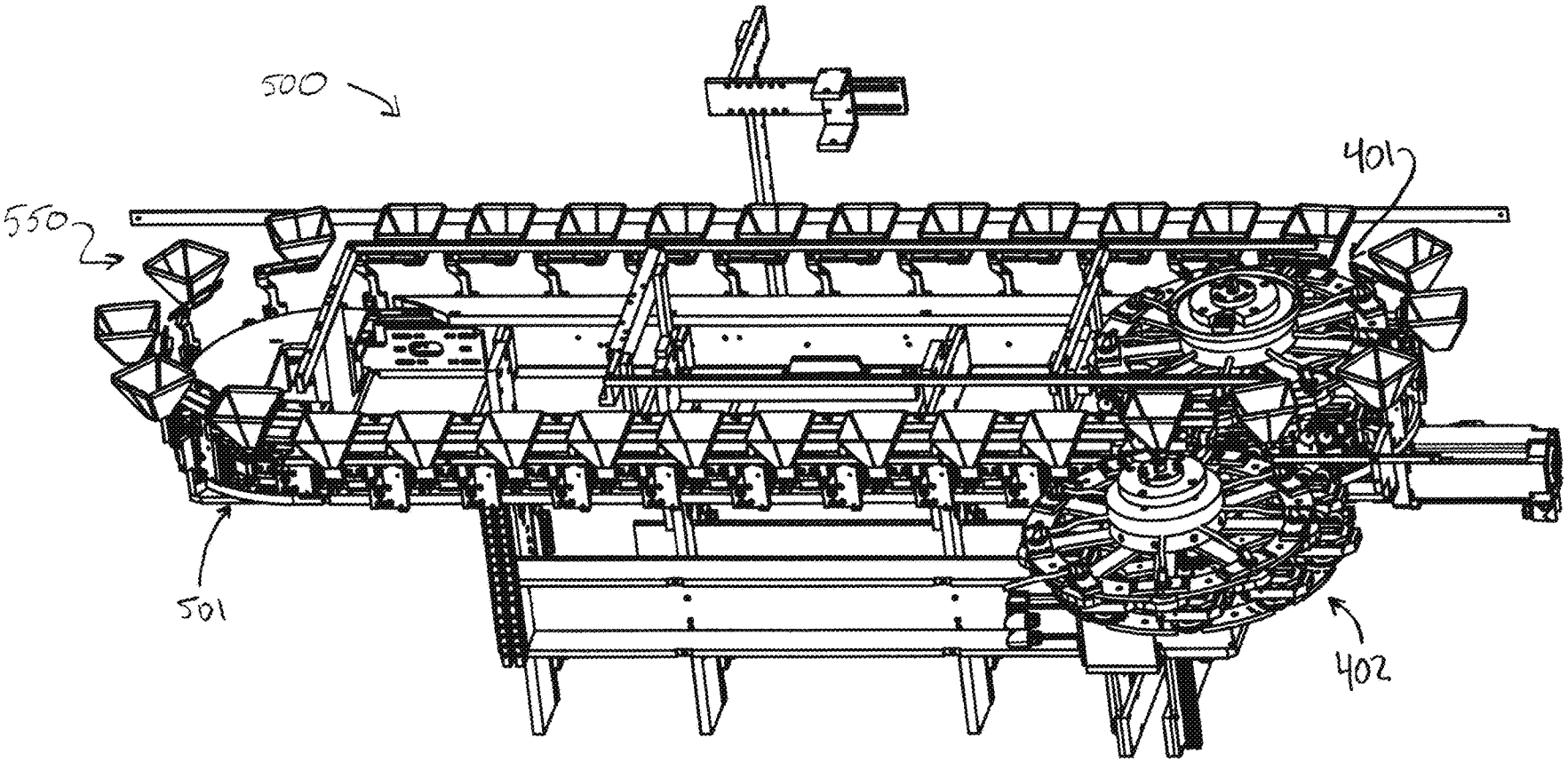
Figure 12:
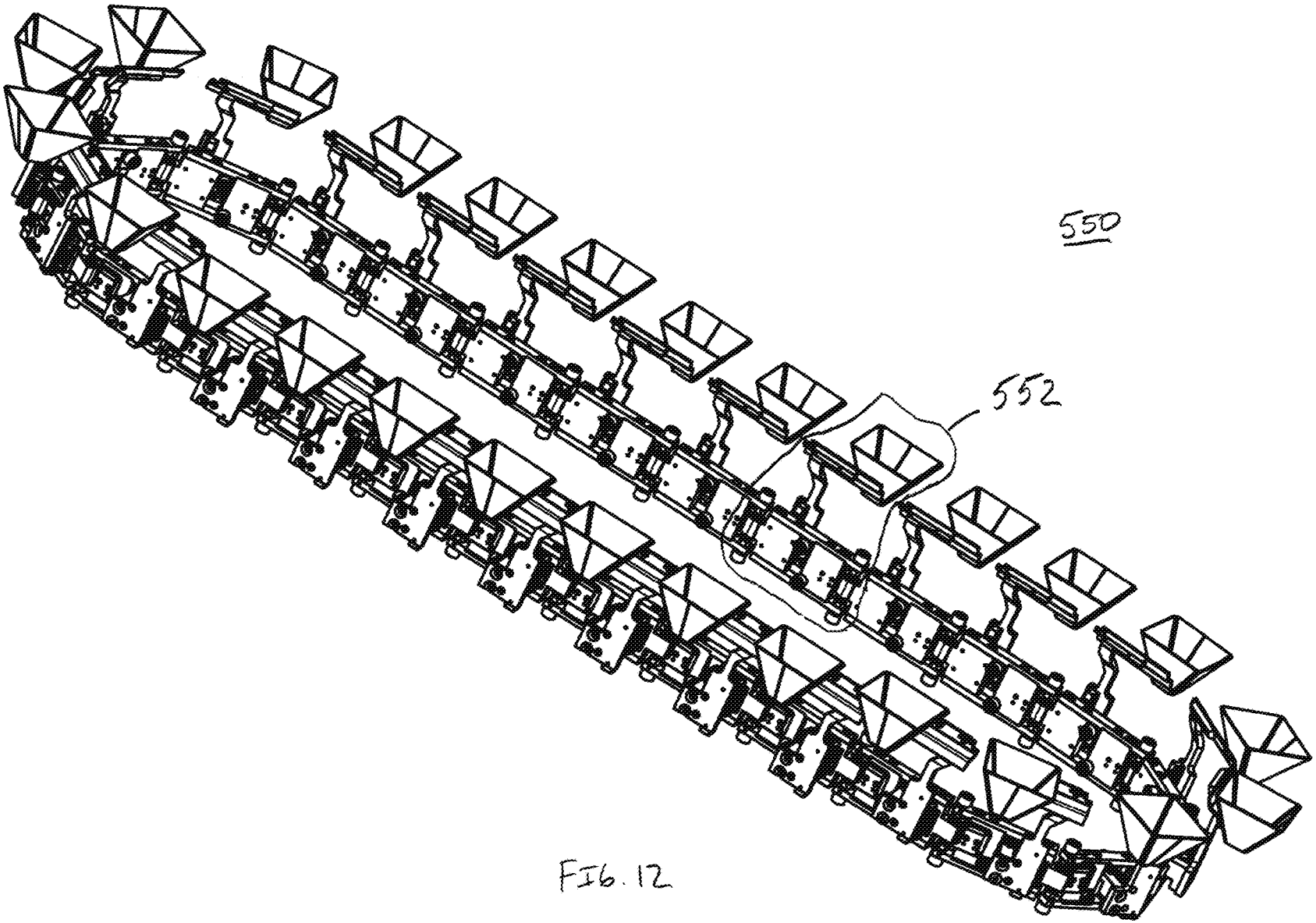
Figure 13:
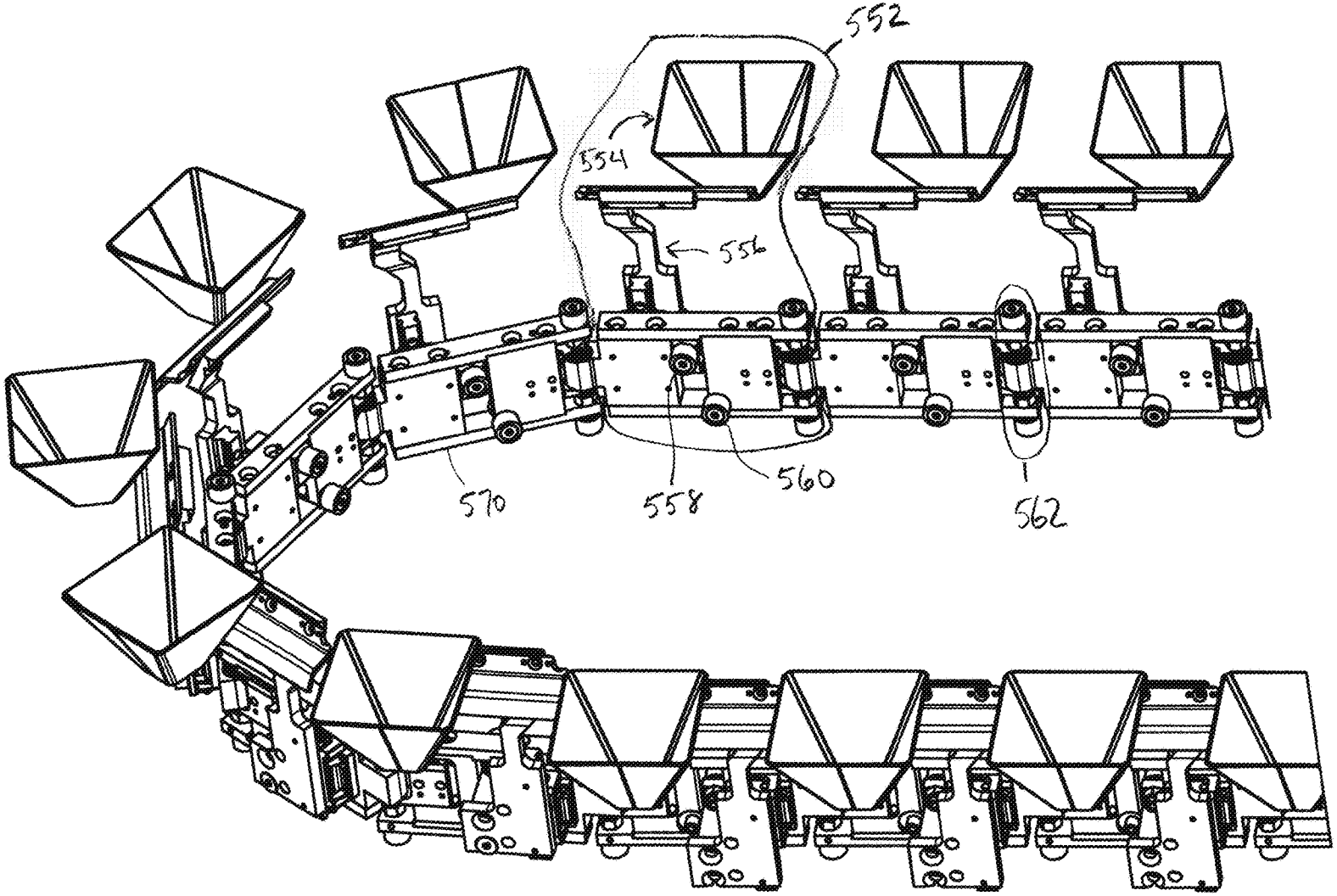

Referring now to FIGS. 11-14, the funnel positioning system 500 is illustrated according to one embodiment. An overall view of the funnel positioning system 500 is illustrated in FIG. 11A which also shows its position relative to bag top opener assembly 400. In the interest of drawing clarity, two main components of the funnel positioning system 500 are separately illustrated: a funnel track system 501 is shown in FIG. 11, and a continuous chain of funnel carriages 550 is illustrated in FIGS. 12 and 13. The funnel positioning system 500 is configured to lower a funnel into the top portion of the bag after being opened by the bag top opener assembly 400. The chain of funnel carriages 550 is configured such that its pathway passes over the juxtaposition of the first (401) and second (402) bag top openers as illustrated, e.g., in FIG. 1, so that a funnel can be lowered into the opened bag immediately after being opened. The funnel proceeds downstream at a speed substantially equal to the speed of the carriage 302 conveying the bag. Food ingredients are added as described in greater detail below; subsequently, the funnel is lifted from the bag before it loops around to begin the circuit again.

In this embodiment, the chain of funnel carriages 550 is configured to travel around the track system 501 and is rotationally powered by the rotation of the first bag top opener 401.

Referring to FIG. 11 in particular, the track system 501 includes a track assembly 502 and a support assembly 503. The track assembly 502 includes an upper track 505 and a subjacent lower track 504, both of which extend continuously and circumferentially around the track assembly 502. A straightaway portion of the track assembly 507 (hereinafter 'straightaway') includes a lowered track portion 506 between a declined track portion 514 and an inclined track portion 518 for the purpose of lowering a funnel into a bag as it travels downstream, then lifting the funnel from the bag after food contents have been placed therein, as described in greater detail below.

Referring now to FIGS. 12 and 13 in particular, the chain of funnel carriages 550 includes a plurality of linked carriage assemblies 552. FIG. 12 illustrates the chain of funnel carriages 550 in a configuration as if it were riding on the track assembly 502; however, that assembly is not shown in FIGS. 12 and 13 for clarity of the illustration. In this embodiment, each carriage assembly 552 includes a carriage frame 570 that is hingedly coupled to a neighboring carriage frame by hinge assemblies 562. The hinged frames 570 of the carriage assemblies allow the carriages to travel around the track assembly 502 in the racetrack shape as illustrated.

In this embodiment, each carriage assembly 552 includes an upper cam follower 558 and a lower cam follower 560. The upper cam follower 558 is vertically shiftable (along the z-axis) relative to the carriage frame 570 and rides along the upper track 505 of the track assembly 502. The lower cam follower 560 rides along the lower track 504 of the track assembly 502.

In this embodiment, the lower cam follower 560 rides substantially within a plane around the lower track 504; it does not shift in the vertical direction. The upper cam follower 558, however, shifts in the vertical direction relative to the carriage frame 570 as it transitions between riding on the upper track 505 and the lowered track portion 506 of the straightaway 507.

In this embodiment, the upper cam follower is coupled to L-shaped arm member 556 which is coupled to a funnel 554 as illustrated. In this embodiment, the track system 501 is oriented and configured such that the declined track portion 514 is disposed substantially beneath the juxtaposition of the first and second bag top openers 401, 402. When the track system 501 and the chain of funnel carriages 550 are assembled in an operational configuration, i.e., such that the chain of funnel carriages 550 is configured to travel around the track assembly 502 as described, the funnel positioning system 500 is capable of lowering a funnel 554 into the bag as the upper cam follower 558 encounters the declined track portion 514 and correspondingly shifts the L-shaped arm member 556 downward, in the −z direction. In this embodiment, lowering of a funnel 554 into a bag occurs as the bag is being conveyed by carriage 302, immediately after the bag top opener assembly 400 has opened the top portion of a bag as described herein.

In this embodiment, the funnel positioning system 500 is configured such that the speed of a funnel 554 along the straightaway 507 substantially matches the speed of a carriage conveying the bag along the same downstream path. As the bag travels downstream, the funnel remains inserted into the top portion of the bag for receiving food ingredients. It should be noted that the funnel can be positioned wholly or partially within the top portion of the bag as desired; e.g., the vertical drop between the upper track portion 505 and the lowered track portion 506 can dictate the degree of funnel insertion into the bag opening. After the food ingredients have been added, the funnel is lifted from the bag opening as the upper cam follower 558 encounters the inclined track portion 518 causing arm member 556 to shift upward (in the +z direction). The funnel carriage assembly 552 continues its path around the track assembly 502 to repeat the process in a new bag.

Hopper System 600

Figure 15:
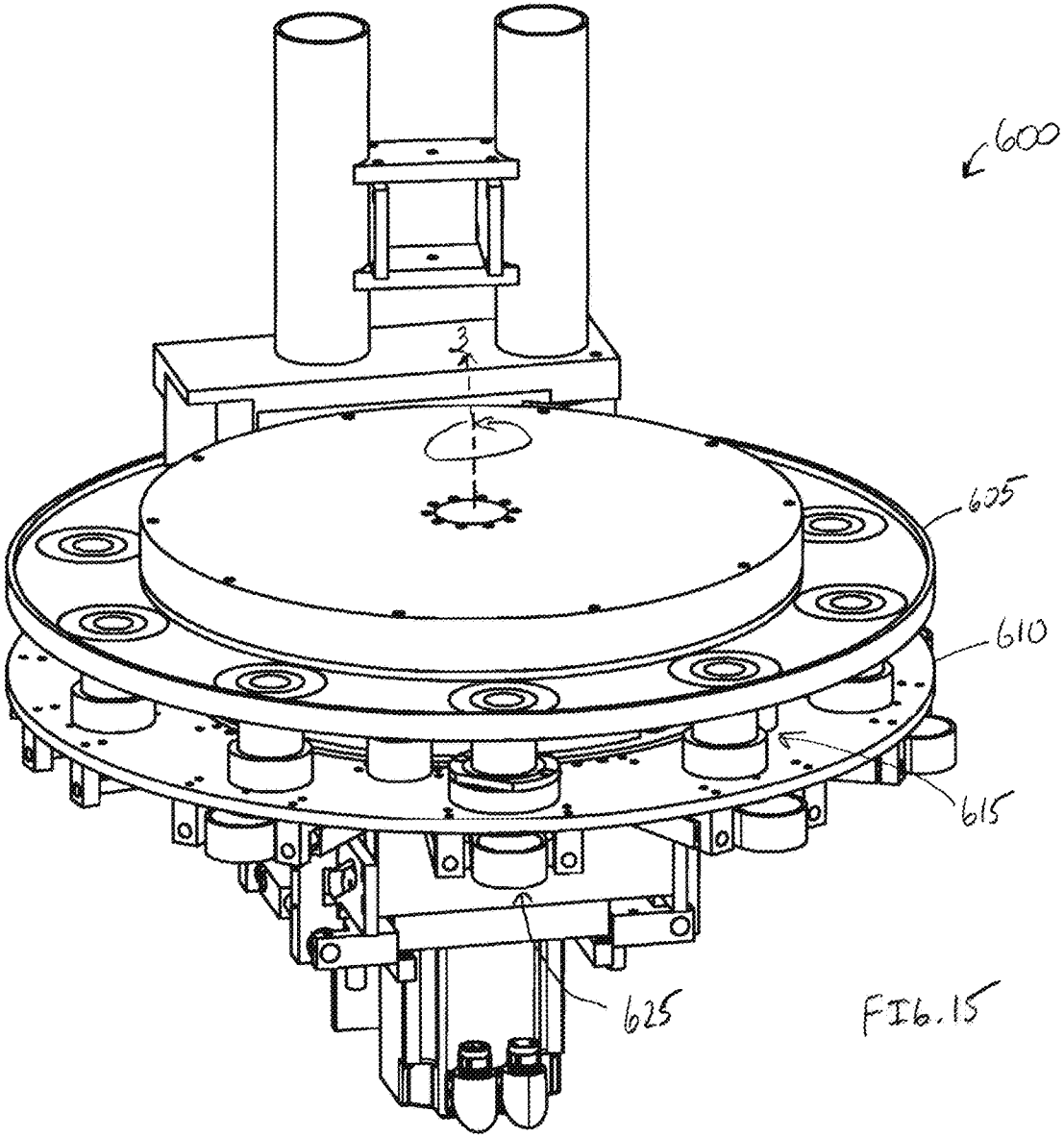
FIG. 15 illustrates a hopper system according to one embodiment.
Figure 16:
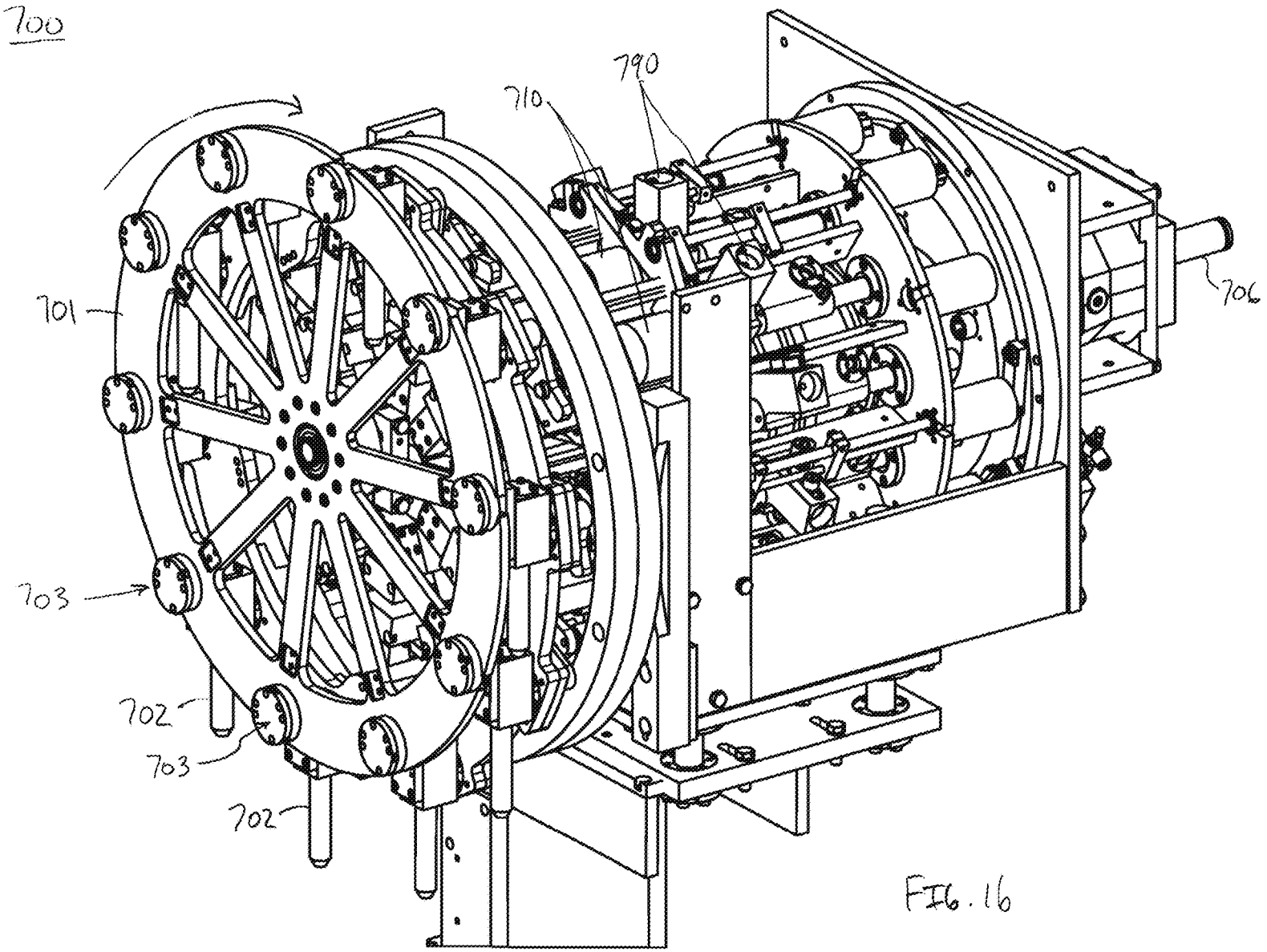
FIGS. 16-24 show various views and components of an oil injection system, according to one embodiment.

Referring now to FIG. 15, the hopper system 600 is illustrated according to one embodiment. In this embodiment, the hopper system 600 is configured to dispense a selected amount of corn kernels into the bag, through a funnel as placed by the funnel positioning system 500 described herein. In this embodiment, the hopper system 600 is configured to rotate about the z-axis as illustrated at an angular velocity such that the selected amount of corn kernels can be disposed into the bag at a chosen location as it is being conveyed downstream. In this embodiment, the hopper system 600 is oriented and configured to dispense corn kernels subsequent to the process of lowering a funnel into the opened top portion of the bag as previously described.

In this embodiment, the hopper system 600 includes a top plate 605 and a bottom plate 610 and a plurality of dispenser cups 615 circumferentially disposed therebetween as illustrated. The desired dispensing amount of corn kernels can be set, e.g., by varying the distance between the top and bottom plates which correspondingly varies the occupiable volume of each dispenser cup 615. Such hopper systems are known in the art; for example, U.S. Pat. No. 6,612,347 entitled "Apparatus for metering and packaging bulk particulate material" by Spee-Dee Packaging Machinery, Inc. describes such an apparatus and is incorporated by reference in its entirety herein as one non-limiting example of a hopper system 600 that can be incorporated into the system 1100.

Oil Injection System 700

Referring now to FIGS. 16-20, the oil injection system 700 is illustrated according to one embodiment. Some illustrations in FIGS. 16-20 are shown absent of connecting or surrounding structure for clarity of the figure. In this packaging system 1100 embodiment, the oil injection system is configured and oriented to dispense a pre-selected amount of oil into the opened top portion the bag after receiving corn kernels from the hopper system 600 described herein. In this embodiment, the oil injection system is configured to dispense a pre-selected amount of oil into each bag.

In this embodiment, the oil injection system 700 includes a plurality of nozzle assemblies 702 (hereinafter "nozzles) circumferentially disposed about a rotatable wheel assembly 701. Each nozzle is coupled to the wheel assembly by a nozzle axis 703 that allows the wheel assembly 701 to rotate while the nozzle is maintained in a vertical orientation as illustrated. The system 700 is configured such that a predetermined amount of oil is dispensed from a nozzle into the open portion of the bag when the nozzle is positioned at or near the bottom of the wheel assembly 701 as it rotates.

Furthermore, the wheel assembly 701 is configured to rotate at an angular velocity such that it is timed with the passing of the bag as it is conveyed downstream by the carriage 302. In other words, the wheel assembly 701 is timed so that as it rotates, a nozzle 702 injects oil into the bag as the bag passes by the oil injection system 700.

Figure 18:
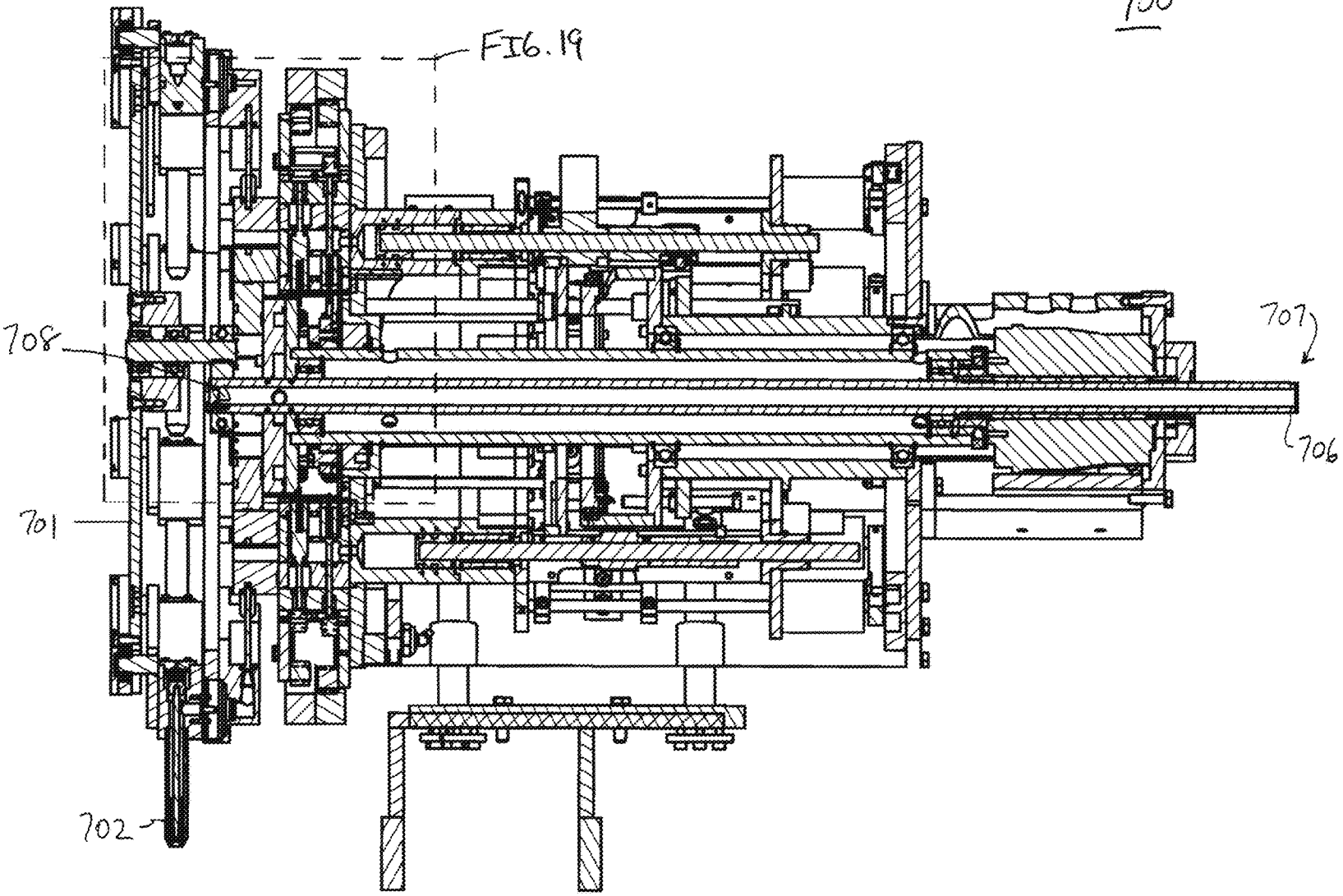
Figure 19:
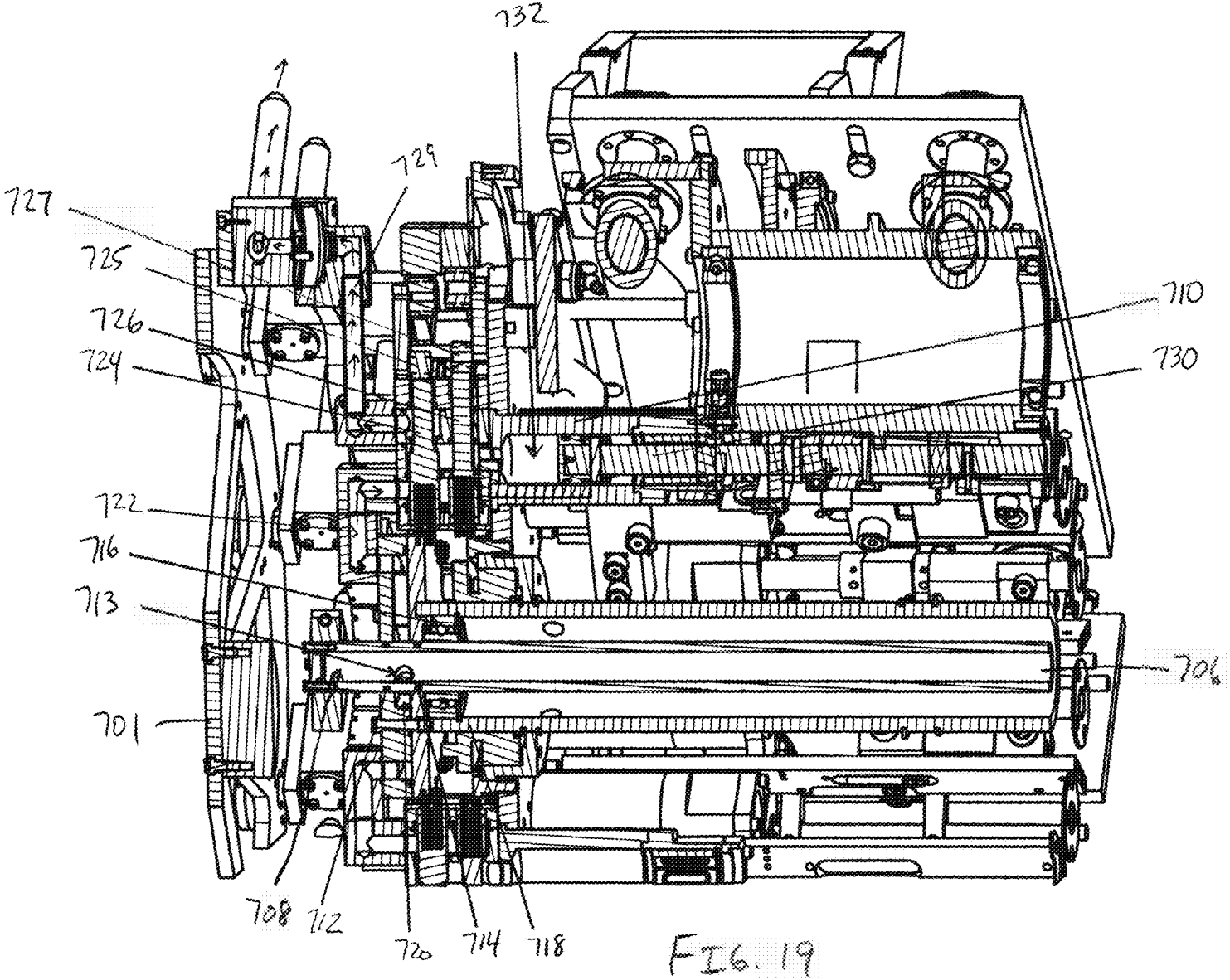

Referring in particular to FIG. 18, a cross-sectional view of the oil injection system 700 is illustrated according to one embodiment. In this embodiment, the system 700 includes an oil supply conduit 706 in fluid communication with a supply of oil (not shown). In this example, the oil is popcorn popping oil; however, other types of oil can be substituted in alternative embodiments or arrangements. Oil enters the oil supply conduit 706 at a distal end 707 and flows to a proximal end 708. Oil is flowed to each nozzle 702 by a plurality of variable-displacement pump assemblies in fluid communication with oil in the proximal end 708 of the supply conduit 706. In this embodiment, each nozzle 702 receives oil from its own dedicated variable-displacement pump assembly. For example, in this embodiment, there are ten nozzles 702 in fluid communication with 10 variable-displacement pump assemblies, respectively.

In this embodiment, the variable-displacement pump assemblies are circumferentially disposed, and rotatable about a rotation axis defined by the oil supply conduit 706. Each variable-displacement pump assembly includes a cylinder 710 for receiving oil from the oil supply conduit 706 and expelling oil out to its dedicated nozzle 702. Oil is transferred to the cylinder 710 through passageways in manifold 718 as described below. Manifold 718 is rotatable about the oil supply conduit 706 by ball-and-bearing assembly 716; a seal between the manifold 718 and the oil supply conduit 706 is provided by O-rings 712 and 714.

In this embodiment, the proximal end 708 of oil supply conduit 706 includes an orifice 713 through which oil can pass to enter chamber 720. Chamber 720 is in fluid communication with passage 722 by a radial vein, which is not shown for clarity of the illustration. Oil flows in the direction of the dashed arrow through passage 722 to first (724) and second (726) valve members.

Figure 17:
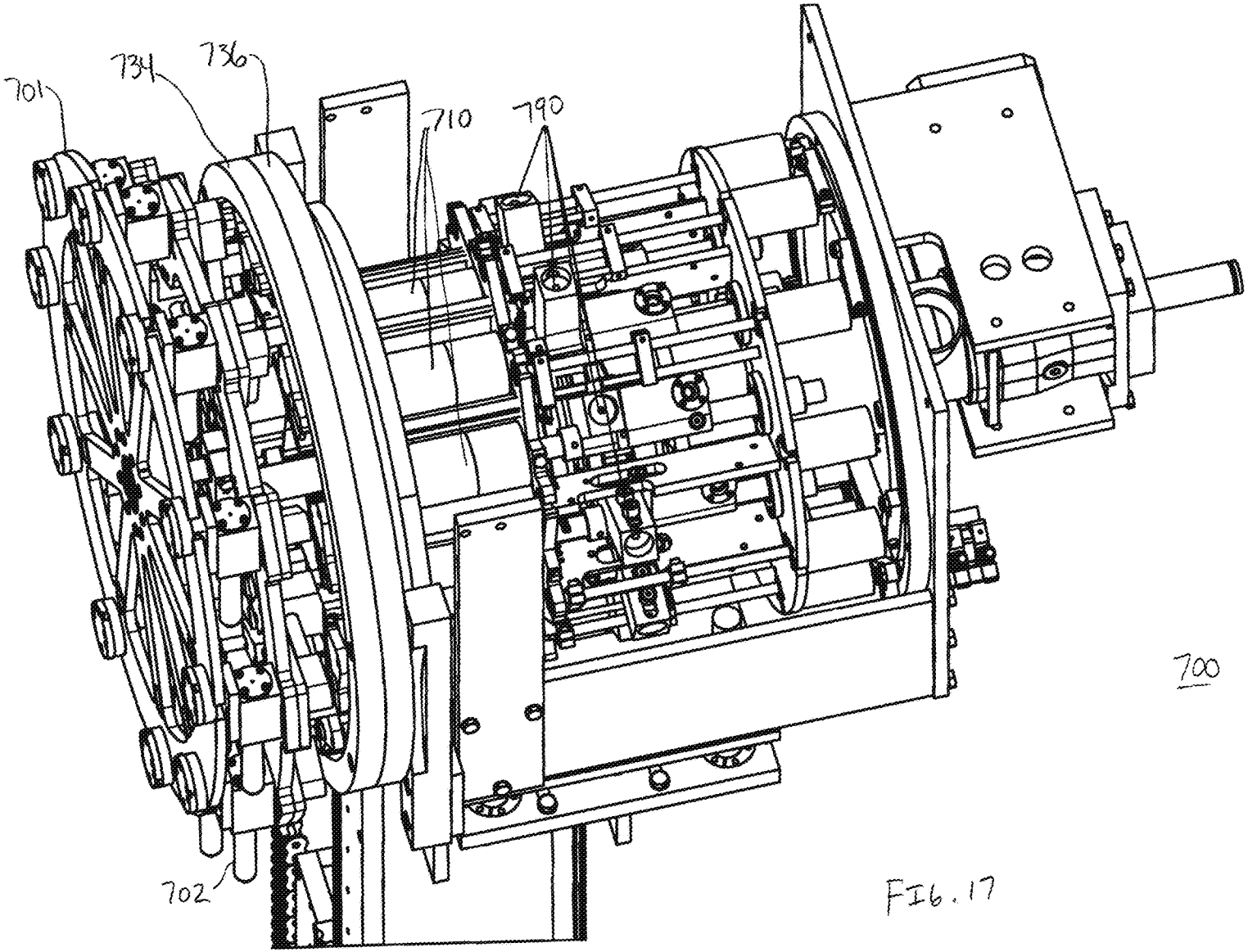

In this embodiment, the first (724) and second (726) valve members are spring-loaded valves configured to shift between open and closed configurations to control the flow of oil into, and out of the cylinder 710. Other alternative approaches can be utilized; for example, the first (724) and second (726) valve members can be fully cam operated instead of a spring and cam combination. The first (724) and second (726) valve members are shifted between open and closed configurations by first (725) and second (727) yoke rollers that ride along inner circumferential surfaces of first (734) and second (736) stationary disk cams, respectively (FIG. 17). The inner circumferential surfaces of the first (734) and second (736) stationary disk cams include peak and valley structures to open and close the first and second valves 724, 726 so as to control the intake and expulsion of oil from the cylinder 710 as described below. In this embodiment, down-shifting the second valve 726 opens the valve so that oil can flow from chamber 722 into the cylinder 710.

Figure 20:
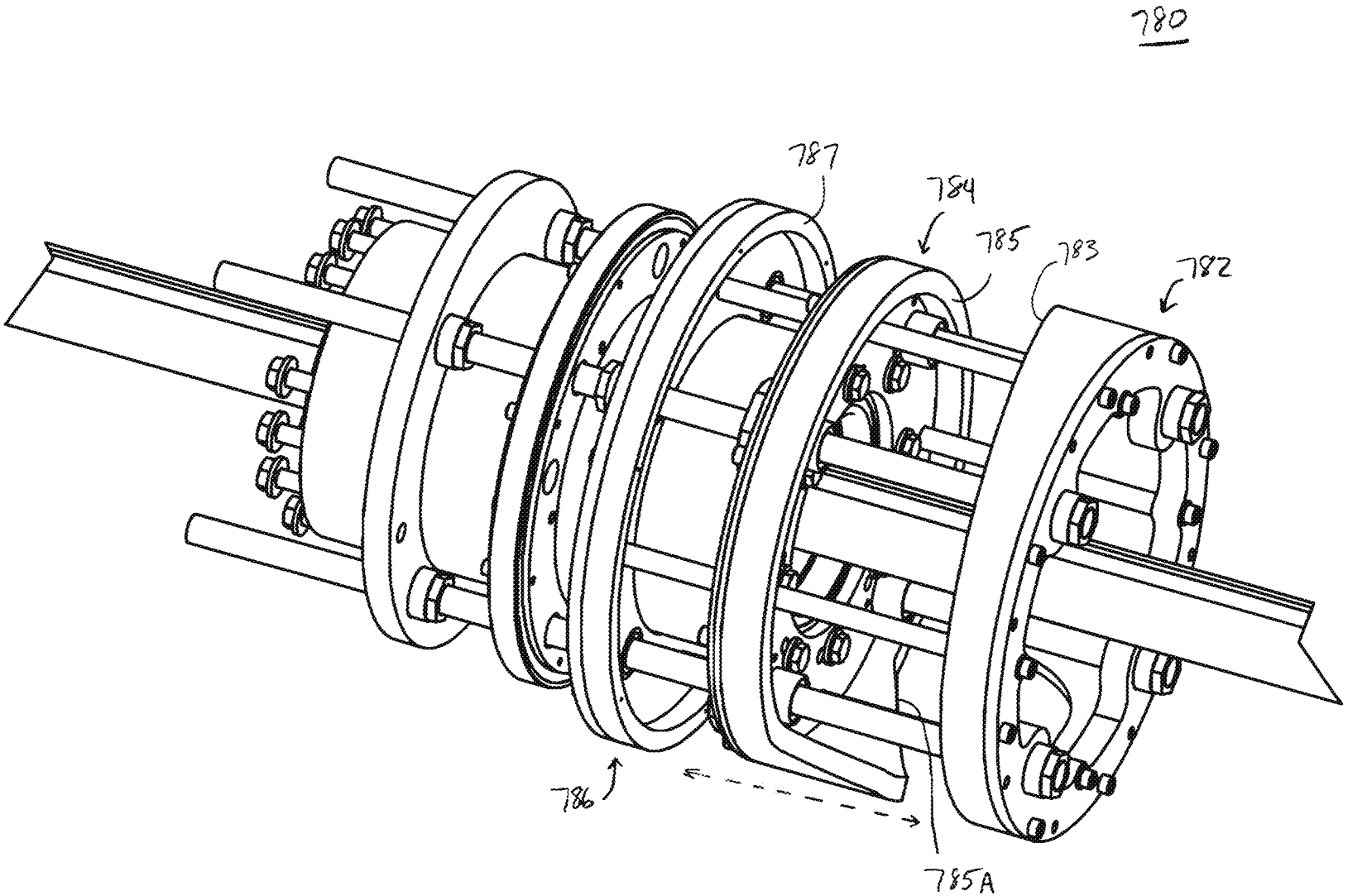
Figure 21:
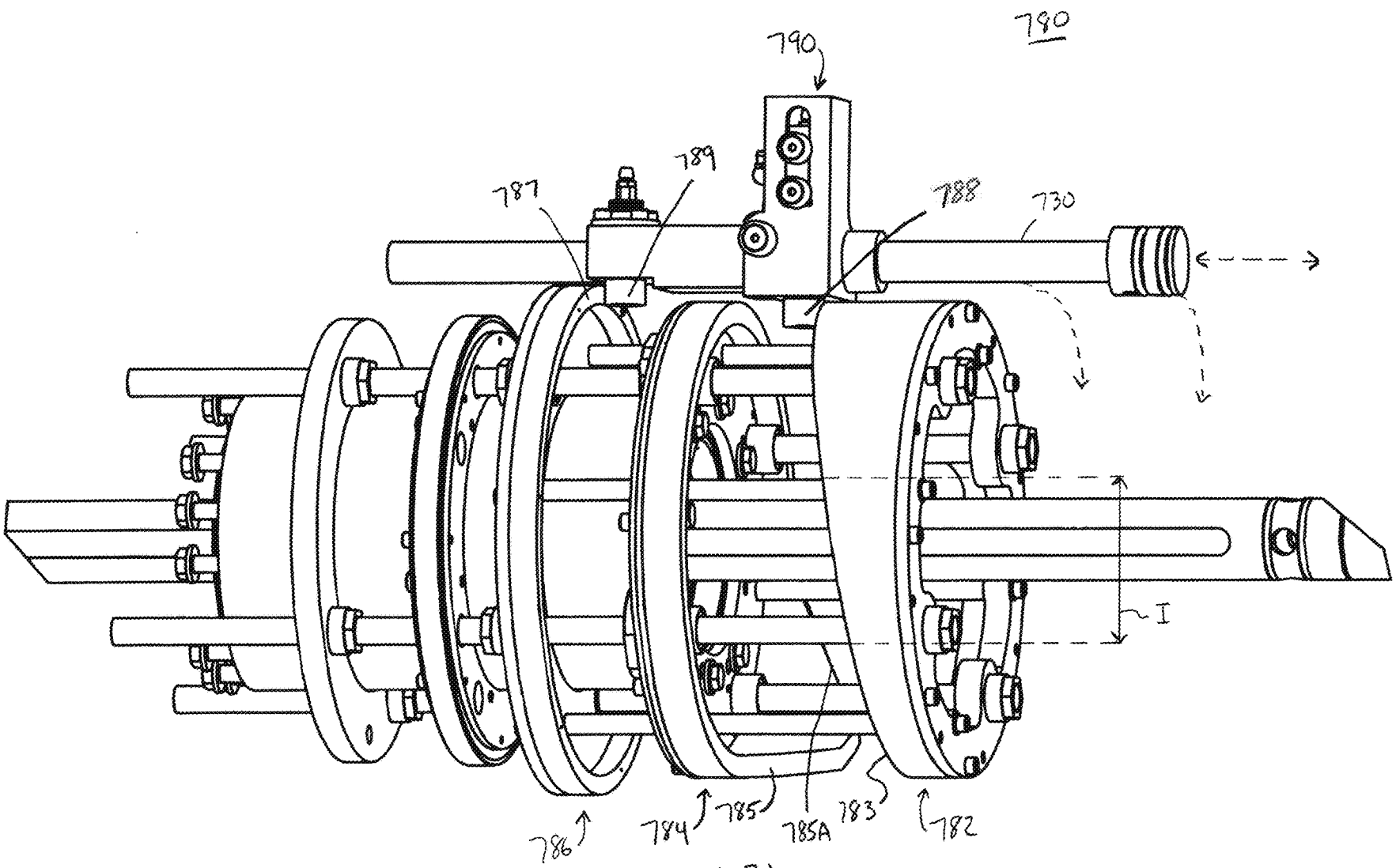
Figure 22:
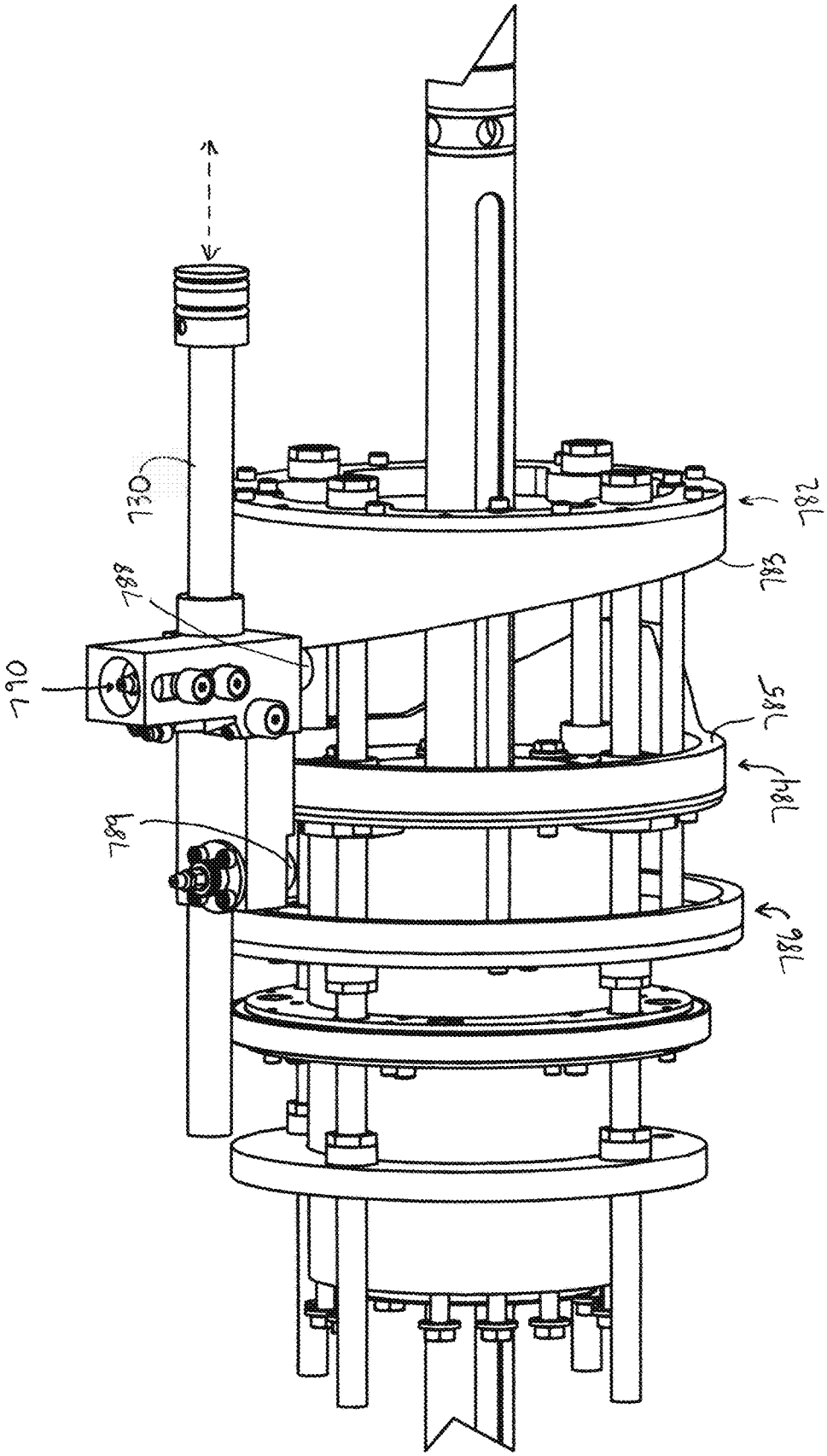

Referring to FIGS. 20-22, in this embodiment, oil is drawn into the cylinder 710 by way of a cylinder cam assembly 780 in cooperation with a plurality of cam followers coupled to the piston 730. FIG. 20 illustrates the cylinder cam assembly 780 without piston 730 for clarity of the drawing; however, in implementation, the cam assembly 780 is configured and oriented coaxially with the oil supply conduit 706 such that the plurality of cylinders 710 are concentrically oriented and proximal to the outer circumference of the cylinder cam assembly 780, e.g., as illustrated in FIG. 21. (FIG. 21 shows only the piston 730 of one cylinder 710 for figure clarity.) In this embodiment, the cylinder cam assembly 780 includes a position-adjustable drawback cam 782, a stationary expulsion cam 784, and a stop-limit cam 786. In this embodiment, drawback cam 782 and stop-limit cam 786 are coupled such that the distance therebetween remains constant.

In this embodiment, piston 730 is capable of shifting axially as illustrated by the double-headed arrow according to the movement of cam follower 788. As the cylinder 710 rotates about the cylinder cam 780, the cam follower 788 alternates between riding on the intake cam surface 783 and the expulsion cam surface 785. Both surfaces 783, 785 have sloped sections, which engenders axial translation of the piston 730 inwardly or outwardly depending on the position of the cam follower and the surface on which it is riding at any given moment.

For example, referring specifically to FIG. 21, as the cylinder rotates in the clockwise direction (as illustrated by the dashed curved arrow), piston 730 will be drawn inward into the cylinder 710 as the cam follower 788 traverses the path denoted "I". As the cylinder 710 continues to rotate, the cam follower 788 will transition from the intake cam surface 783 to the upward-sloping expulsion cam surface 785A, which is drives the piston 730 in an outward direction, causing oil to be expelled from the cylinder 710.

Referring to FIG. 22 in particular, in this embodiment, the amount of oil drawn into the cylinder 710 can be controlled by adjusting the spacing between the intake cam 782 and the expulsion cam 784, which is denoted by the double-headed arrow. An exteriorly-accessible control mechanism, in this case, a screw assembly is configured to shift the expulsion cam axially toward or away from the intake cam 782 as desired, which limits the distance that the piston 730 can travel into the cylinder, and therefore controls the volume of the void space 732 (FIG. 19) that can be filled by oil.

In this embodiment, a sensor (described in greater detail below) can detect whether a carriage is holding a bag or not, and as the carriage approaches the oil injection system 700, it is indexed to a particular nozzle 702. If a carriage is missing a bag, an actuator 790 retracts the cam follower 788 so that it does not contact either cam surface 783, 785 until the empty carriage passes the oil injection system 700. This prevents oil from being disposed onto, e.g., the carriage and creating a mess. After the empty carriage has passed, the actuator re-engages the cam follower 788 to function as described above. Referring back to FIG. 17, the position of the actuator 790 can indicate the position of the cam follower 788 on cam 782 or 784; thus, FIG. 17 illustrates, via several adjacent actuators 790, the gradual draw-back of the piston 730 as the cylinders 710 rotate.

In this embodiment, cam follower 789 in cooperation with stop-limit cam 786 prevents piston 730 from shifting beyond a predetermined set point (e.g., too far backward on an intake draw). Such a situation could arise, e.g., if the oil pressure entering the cylinder was great enough to cause the piston 730 to shift independently of the action of the cam follower on the intake cam 782 and provides a safety mechanism to prevent too much oil from being drawn into the cylinder 710.

Figure 23:
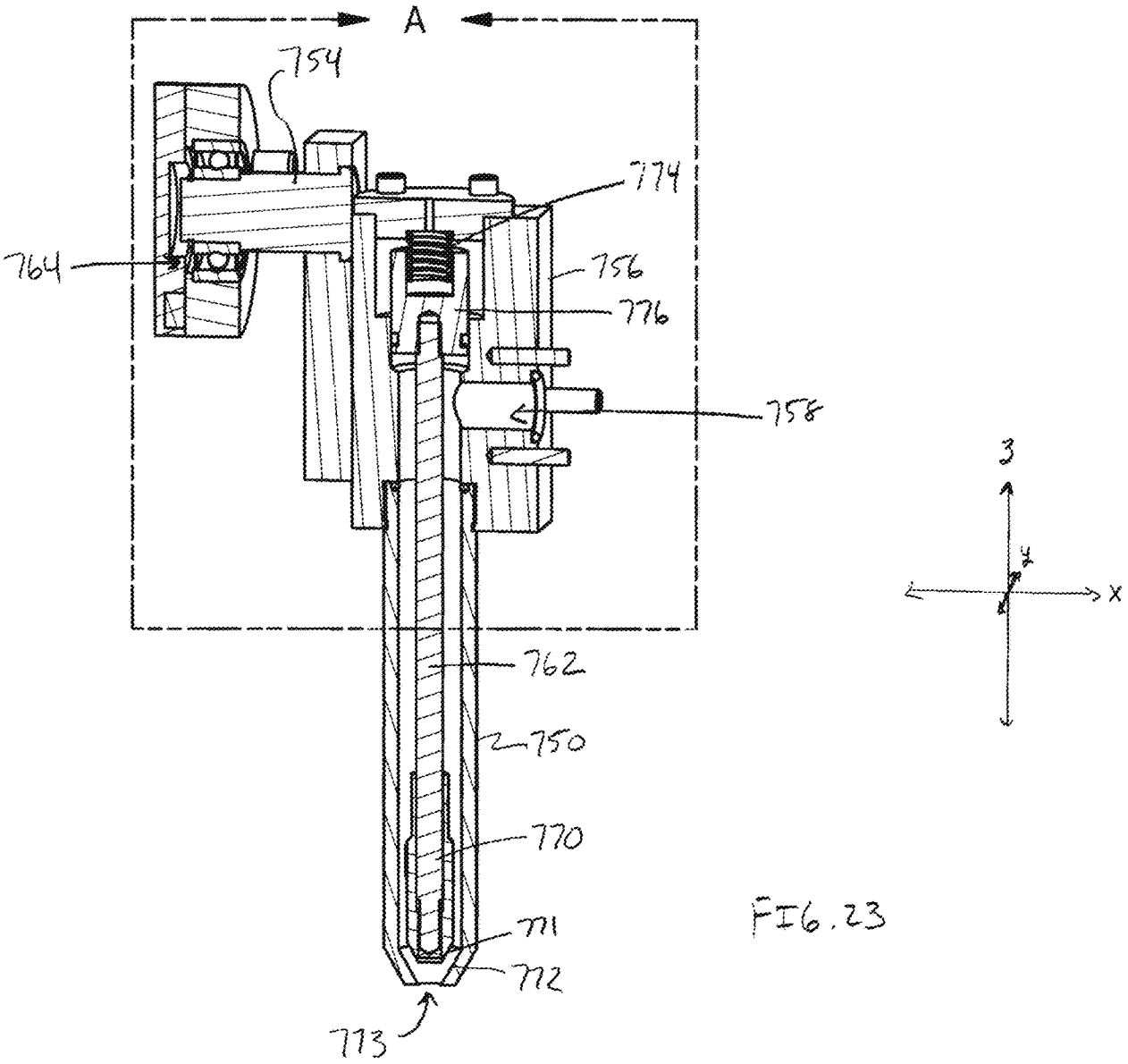
Figure 24:
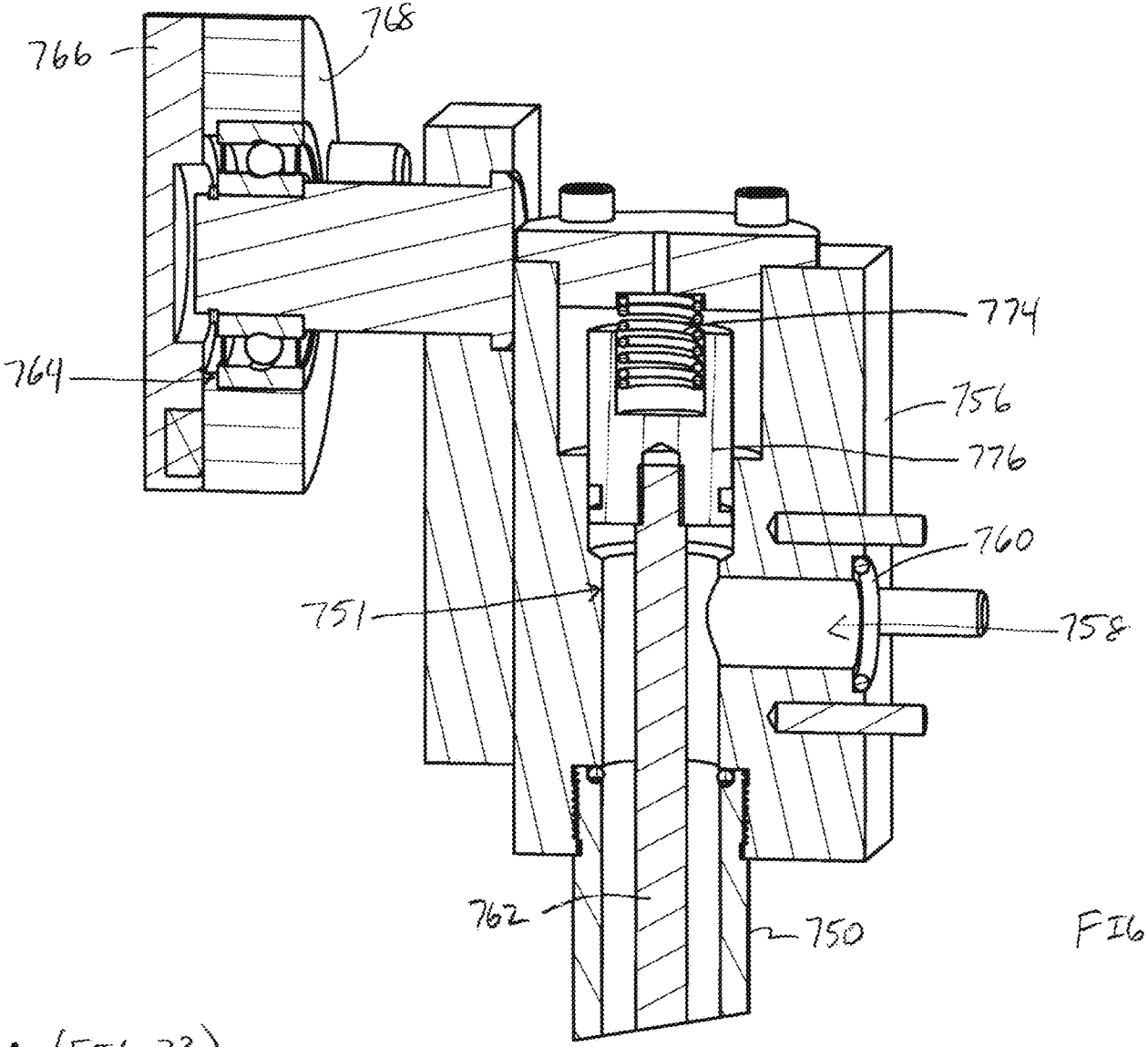

Referring now to FIGS. 23 and 24, cross-sectional views of the nozzle assembly 702 are illustrated according to one embodiment. In this embodiment, the nozzle assembly 702 includes a first disk plate 766 configured to be coupled to the wheel assembly 701. A ball-bearing assembly 768 is coupled to the first disk plate 766, and a nozzle axis 754 is coaxially coupled to the ball-bearing assembly 768 as illustrated, so that the wheel assembly 701 can rotate while the nozzle assembly 702 maintains a substantially vertical orientation.

In this embodiment, the nozzle assembly 702 includes a coupling body 756 and a hollow nozzle shaft 750 extending therefrom as illustrated. The coupling body 756 further includes an orifice 758 which is coupled to, and in fluid communication with output passage 729. An O-ring 760 provides a seal between the output passage 729 and orifice 758.

In this embodiment, orifice 758 leads to the hollow interior of the nozzle shaft 750. Nozzle shaft 750 houses an elongate, shiftable piston 762 which can translate along the long axis of the shaft 750, e.g., in the +/−z directions to control output flow of oil from the nozzle tip 773. The distal end portion of the shaft 771 has a taper that is complimentary to a nozzle tip taper 772, such that when the tapered end of the shaft confronts the tapered end of the nozzle tip, oil is substantially prevented from exiting the nozzle. Conversely, oil can flow from the nozzle when the distal end portion of the shaft is not in contact with the nozzle tip taper.

In this embodiment, a spring 774 provides a constant urging of the shaft tip (771) toward the nozzle tip (772) to keep the nozzle "closed" until the nozzle is in the proper orientation with respect to the bag to dispense oil. The proximal end of the shiftable piston 762 is coupled to a second piston 776, which itself confronts spring 774. When oil is expelled from cylinder 710, the interior of the nozzle shaft experiences an increase in pressure; this pressure increase causes piston 776, and thereby lifts shiftable piston 762, overcoming the force of the spring 774 and opening the nozzle to allow oil to be dispensed therefrom.

In this embodiment, after oil is expelled from the nozzle, piston 730 is drawn back slightly to provide a slight negative pressure, thereby relieving the inner-shaft pressure of the nozzle and allowing the spring to seat the tapered end of the shaft 771 against the nozzle tip taper 772 in a closed-nozzle configuration. This configuration reduces the likelihood of oil leaking or dripping from the nozzle during operation.

Figure 24A:
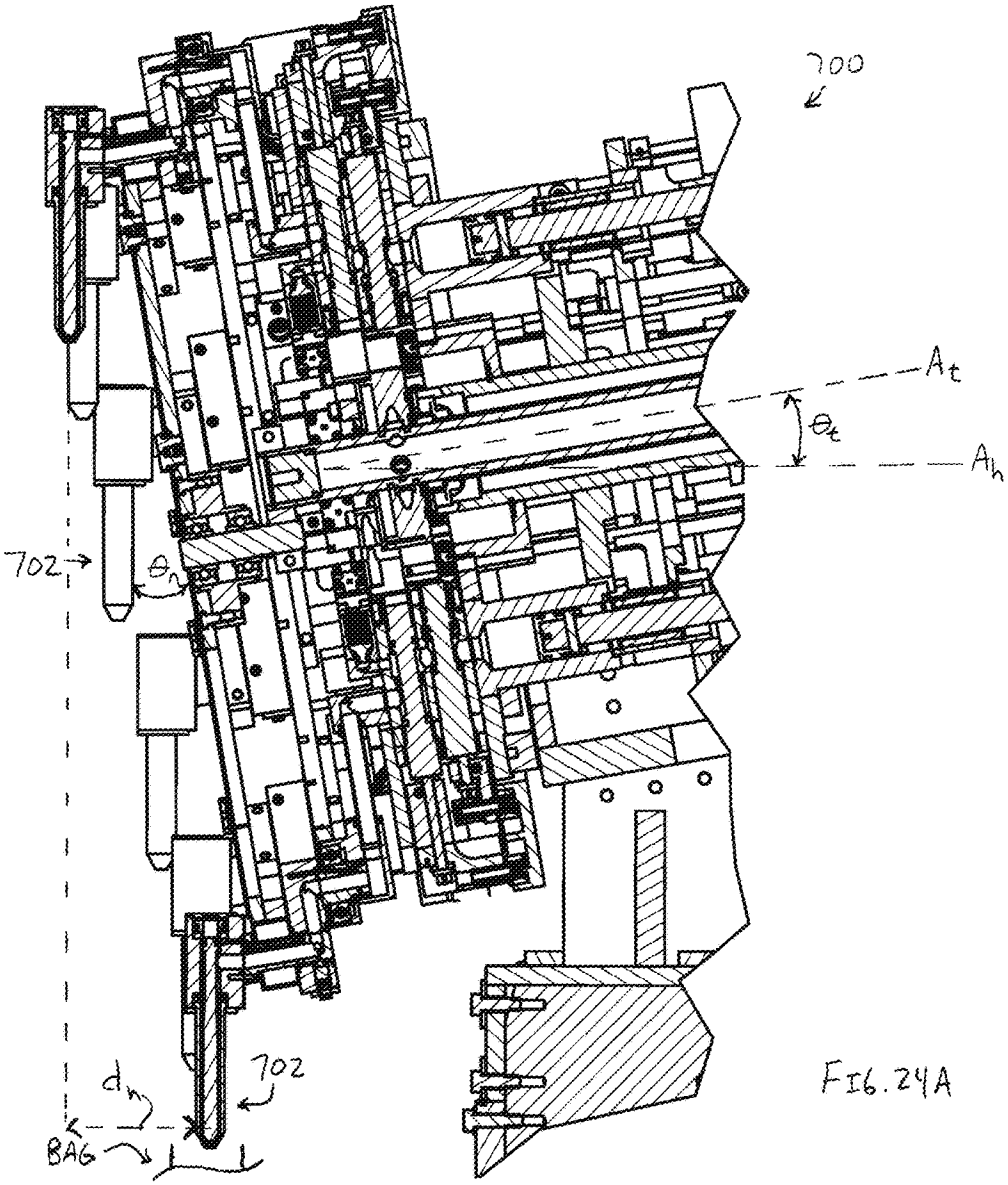
FIGS. 24A-24B illustrate an alternative embodiment of the oil injection system shown in FIG. 24A.
Figure 24B:
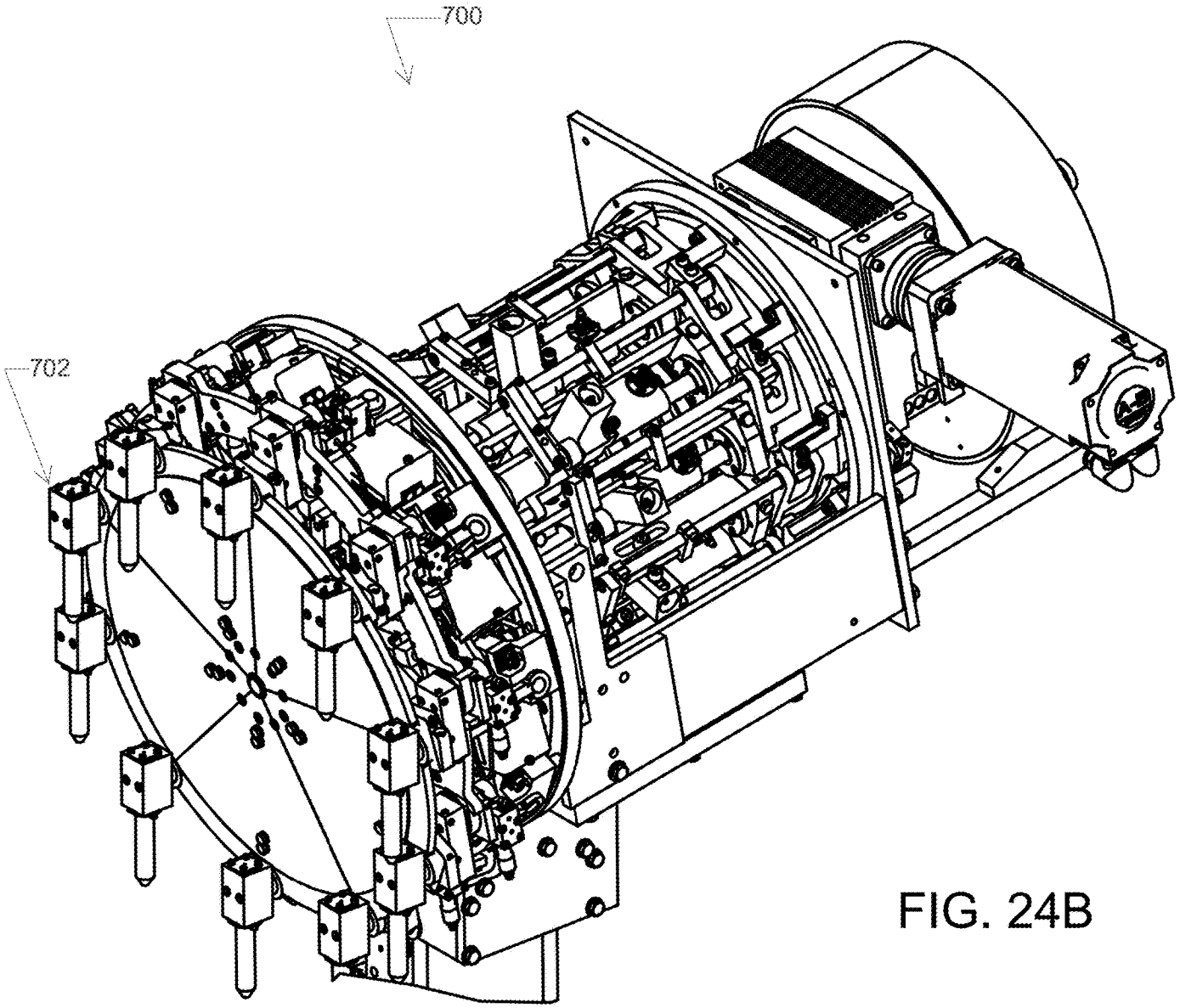
Figure 24C:
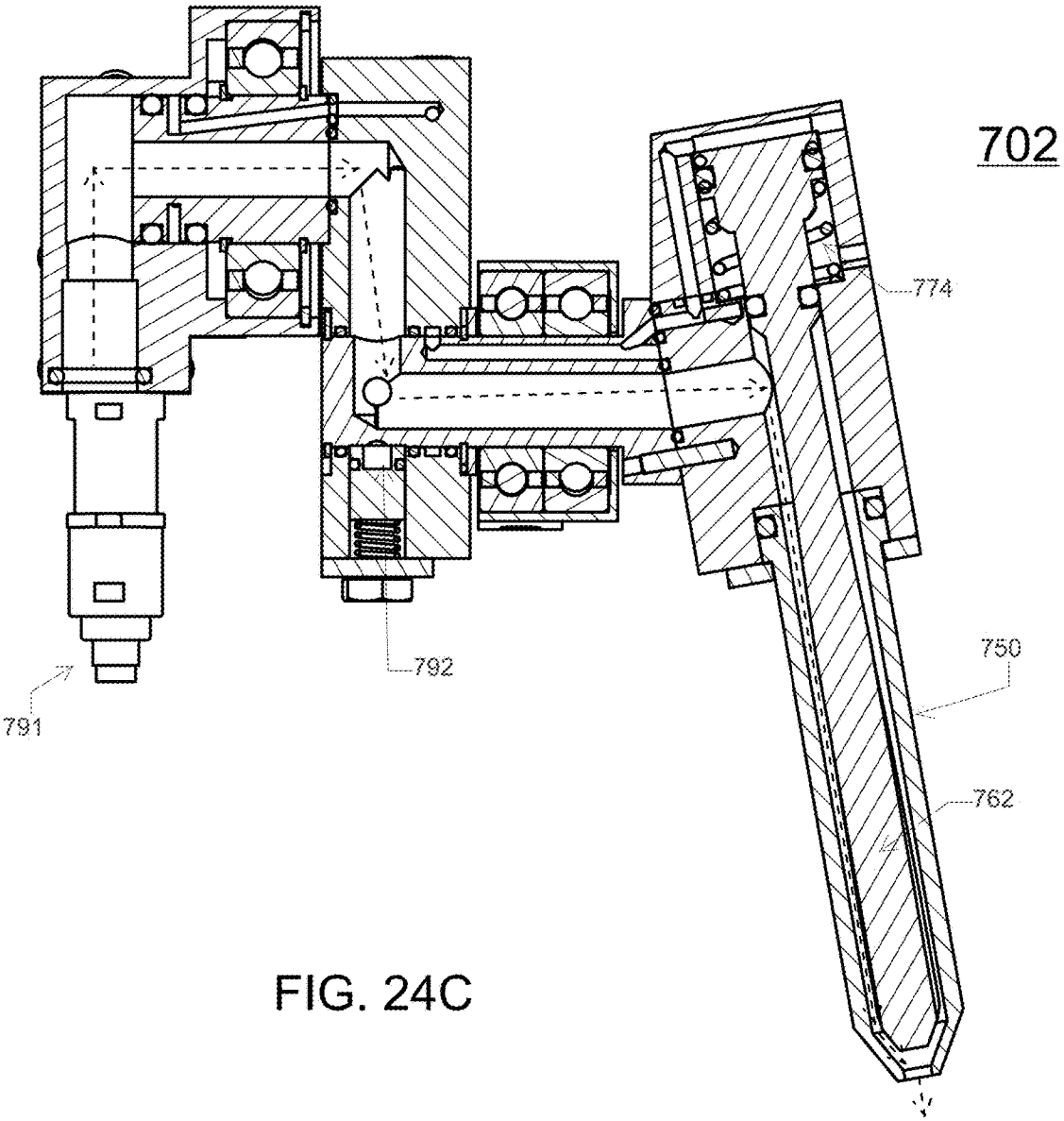
FIG. 24C shows an alternative embodiment of a nozzle assembly.

Referring now to FIGS. 24A-24C, in an alternative embodiment, nozzles 702 can be disposed on the outside of wheel assembly 701 for the purpose of reducing the likelihood of grease or other mechanical lubricants from inadvertently falling into a bag. In this embodiment, the function of nozzles 702 is as previously described.

In another alternative embodiment, the oil injection system 700 can be oriented at a tilt angle $\beta_t$, measured from a horizontal axis $A_h$ to a tilt axis $A_t$, as illustrated. (FIG. 24A illustrates only a front portion of the oil injection system 700 for clarity of the figure, as indicated by the jagged line.) In this embodiment, each nozzle 702 is correspondingly angled outwardly by angle $\theta_n$ as illustrated. In this embodiment, the oil injection system 700 is configured and oriented such nozzles are substantially oriented over a bag at the lowest point of their circular trajectory. As the nozzle continues to along its circular trajectory, it is shifted a distance $d_n$ with respect to the lowest point, outside of the area where bags receive the oil injection. The advantage of such a configuration is that oil can be injected directly into a bag when the nozzle is at or near the lowest point on its circular trajectory; however, if the previous oil injection was incomplete, or residual oil remained on the previous nozzle, the oil may inadvertently drip onto a different nozzle, e.g., a neighboring nozzle. Over time, these drips could build up and cause cleanliness or performance issues. Tilting the oil injection system 700 as illustrated reduces the likelihood of this occurrence, since nozzles other than the one at the lowest point are displaced away from the filling area. It should be understood that both features of the two aforedescribed alternative embodiments can be combined, as illustrated, e.g., in FIG. 24A. In this embodiment, each nozzle assembly is configured to rotate via a ball detent in the event of a nozzle crash to reduce damage.

Referring specifically to FIG. 24C, an alternative embodiment of nozzle 702 is illustrated according to one embodiment. In this embodiment, the nozzle 702 is configured with a plurality of ball detents, e.g., ball detent 792, which cooperate to allow the nozzle 702 to rotate in the event of an inadvertent crash with a funnel, e.g., funnel 554. In this embodiment, the nozzle assembly 702 includes a Mac valve 791 configured to control an applied air pressure from an air pressure source to piston 762. Air pressure can engender controlled, reversible shifting of piston 762 which is normally biased in an upward direction (nozzle open) by spring 774 such that nozzle flow can be turned on and off pneumatically. The flow of oil through nozzle 702 is illustrated in FIG. 24C by the dashed arrows.

In this and other embodiments, considerations to reduce the likelihood of oil build-up within the oil injection system 700 can include, e.g., applying heating elements to oil conduits and other plumbing throughout the system 700, applying heat to the nozzles 702, or other approaches as necessary.

Sealing Assembly 800

Figure 25:
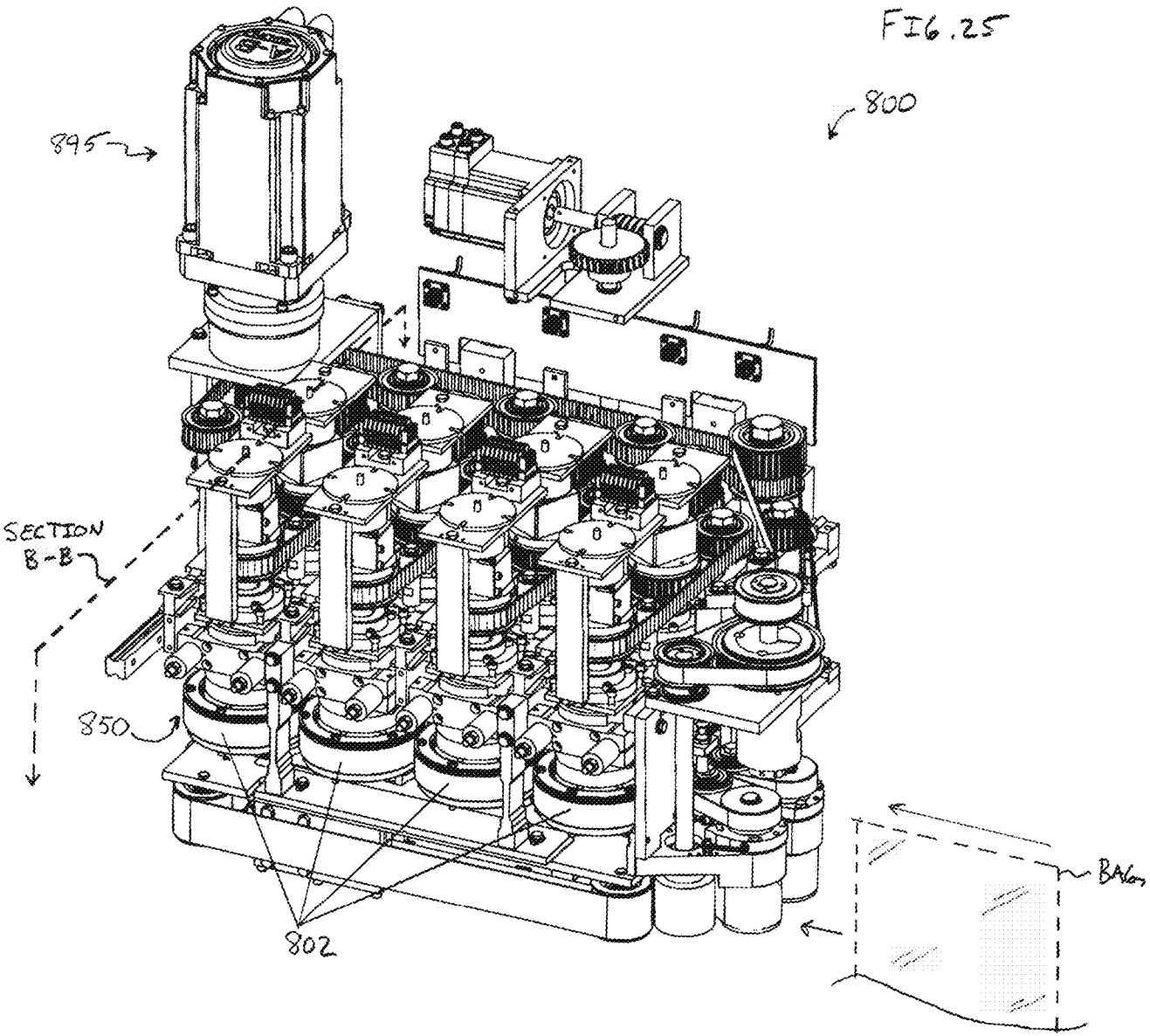
FIGS. 25-27 show various views and components of a sealing assembly, according to one embodiment.
Figure 26:
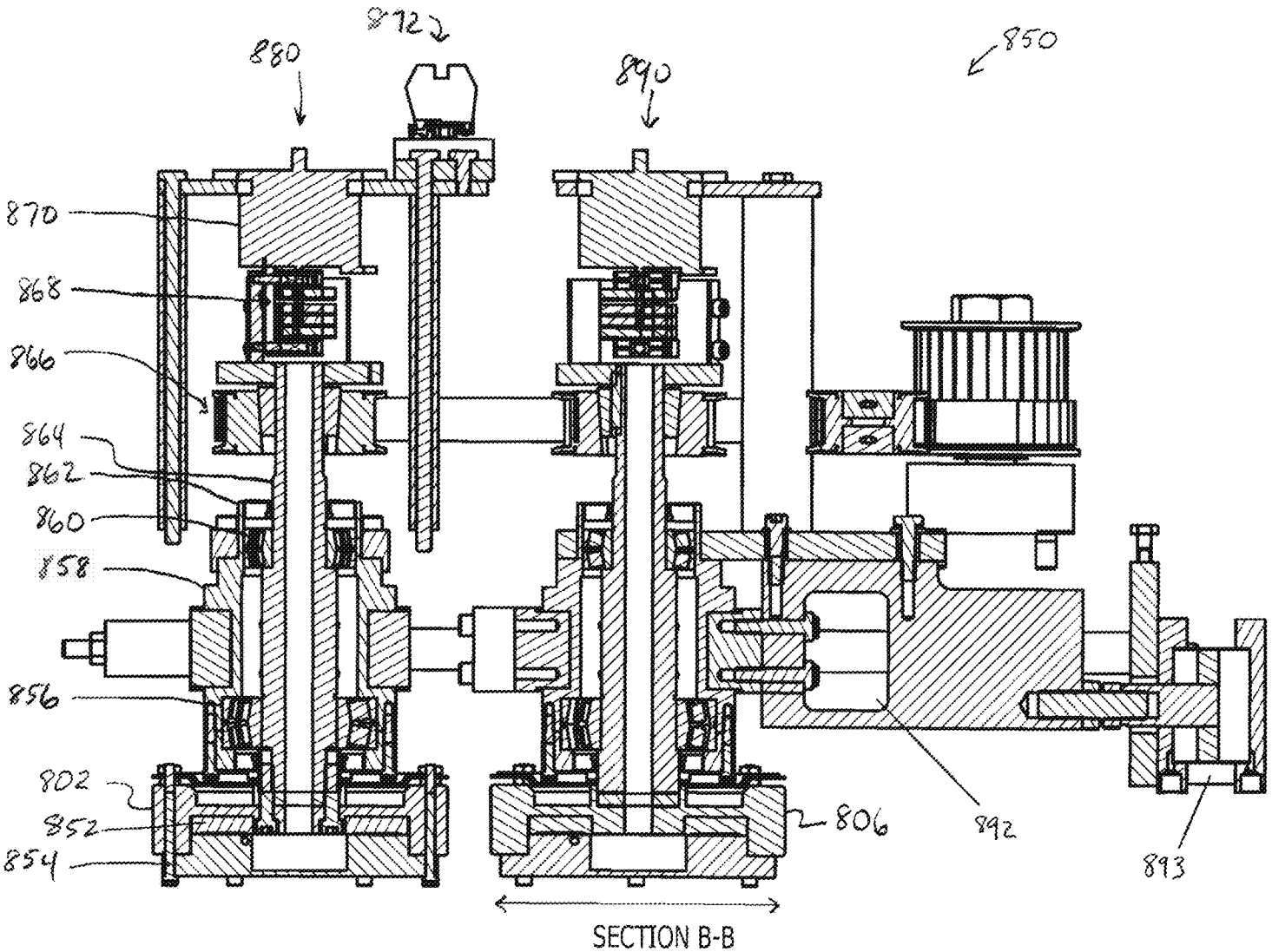
Figure 27:
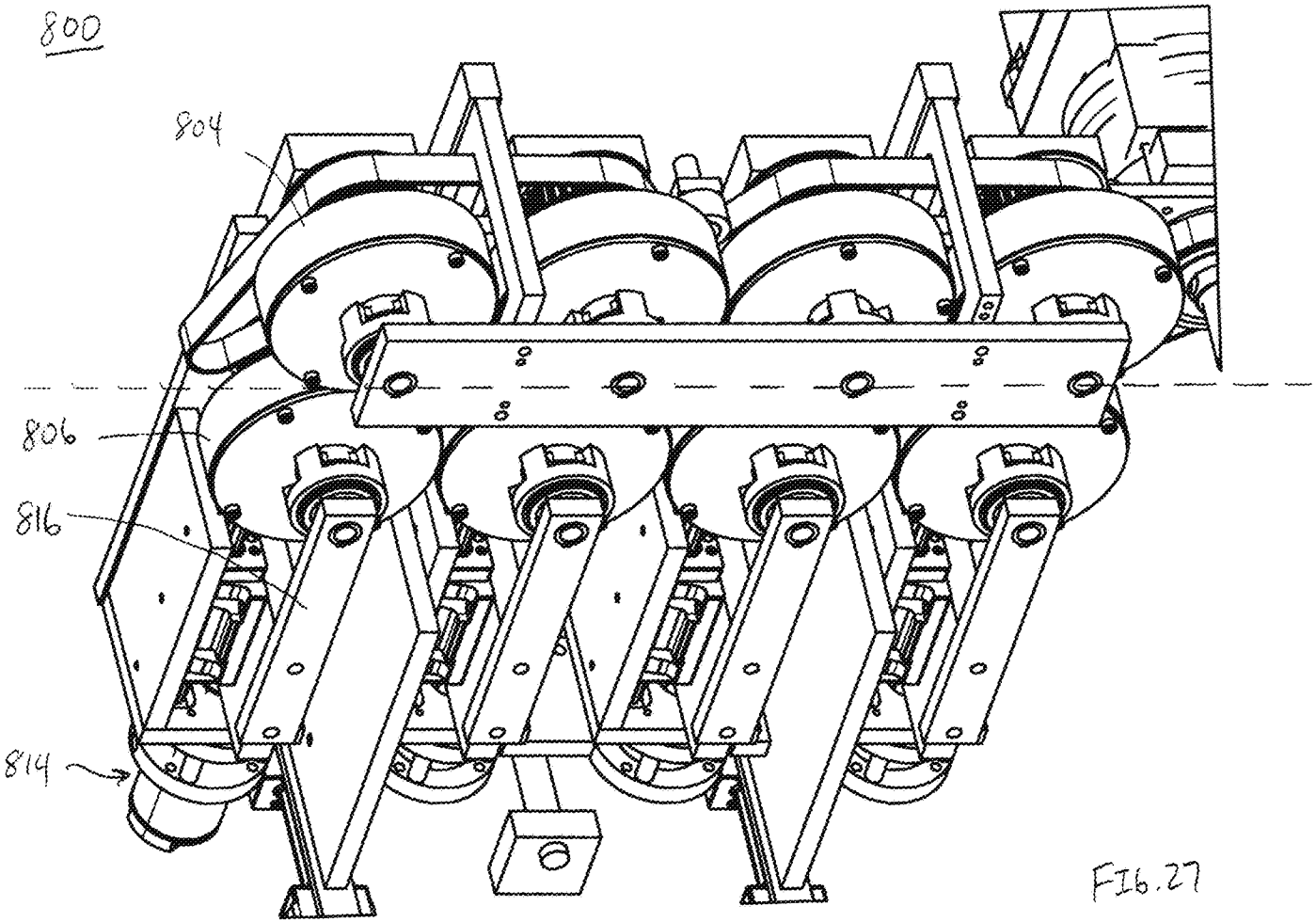

Referring now to FIGS. 25-27, the sealing assembly 800 is illustrated according to one embodiment. In this system 1100 embodiment, the bag is conveyed by carriage 302, still in a vertical orientation, to the sealing assembly 800 where a top seal is provided on the bag after receiving oil from the oil injection system 700.

In this embodiment, the sealing assembly 800 includes four serially-aligned sealer veins. For the sake of figure clarity, FIG. 25 references one sealer vein 850 (shown alone in FIG. 25A) on the left-most portion of sealing assembly 800, through which section B-B runs to illustrate a vein cross section in FIG. 26. In this embodiment, each sealer vein 850 includes a pair of opposingly disposed heated rollers; e.g., referring to FIG. 26, sealer vein 850 includes roller 802 and 806. In this embodiment, the sealing assembly 800 includes four pairs of rollers, two per vein, linearly aligned and configured to receive the top portion of the bag between rollers in each pair; however, any number of roller pairs can be used according to preference or other considerations in alternative embodiments.

Figure 25A:
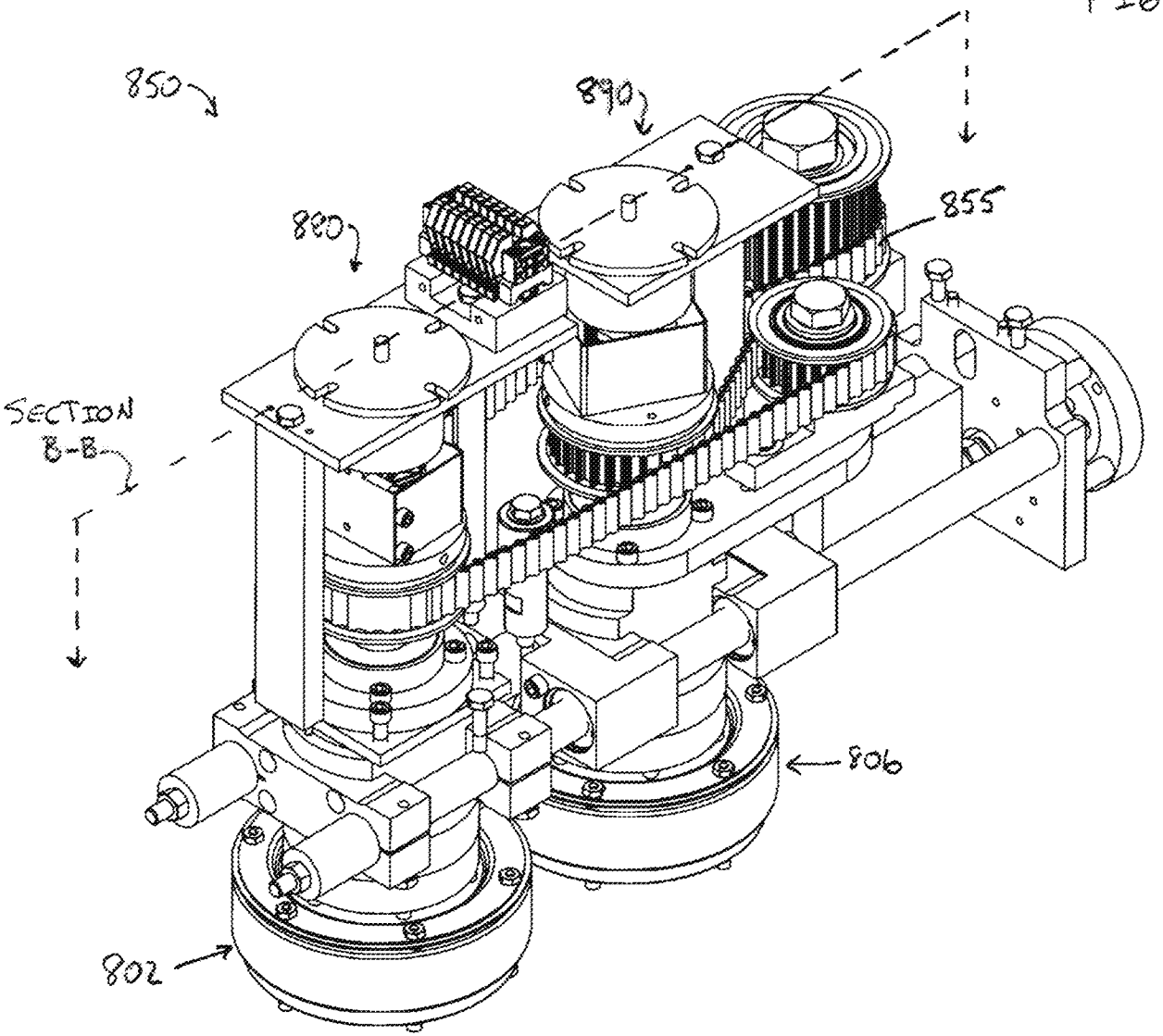

FIG. 26 illustrates a cross-section view of vein 850 through the B-B plane as illustrated in FIGS. 25 and 25A, according to one embodiment. In this embodiment, the vein 850 includes a pair of roller assemblies 880, 890 which drive rollers 802, 806, respectively. Each roller assembly includes a heater 852 configured in a proximal location to roller 802 so that heat is transferred from the heater 852 to the roller 802. A seal roller heater retainer 854 retains the heater 852 in place as illustrated. Motor 895 (FIG. 25) rotationally drives a shaft engaged with pulley 855 (FIG. 25A) which, in turn is engaged with drive pulley 866. Drive pulley 866 is coupled to drive shaft 864 which itself is configured to engender rotation of roller 802.

Drive shaft 864 extends through a first seal (862) and bearing assembly 860, through hub 858, and further through a second bearing assembly 856, each of which serves to provide a stable framework and rotational capability of the drive shaft 864. A slip ring assembly 870 is configured to provide electrical and power signals to heater 852.

In this and other embodiments, the distance between roller assemblies 880, 890 can be adjusted to achieve a desired separation between rollers 802 and 806. This separation can be tuned to provide desired sealing pressure onto the top of a bag as it traverses through the rollers 802, 806. In this embodiment, roller assembly 890 is coupled to a linear bearing rod 892 which provides for lateral shifting (in the direction of the double-headed arrow beneath roller assembly 890). Shifting of roller assembly 890 can be controlled, e.g., using a pneumatic control in communication with air cylinder 893. Positioning of roller assembly 890 can be accomplished by other methods, including, e.g., a dedicated, motor-driven gear assembly.

Referring specifically to FIG. 27, the underside of the sealing assembly 800 is illustrated according to one embodiment. Here, the pathway of the bag is illustrated by the dashed line intersecting the confronting surface of each roller pair, e.g., rollers 802 and 806. As is known in the art, an optimal combination of applied heat and pressure can be required to form adequate seals in different kinds of bags, or bag used for different purposes. Thus, in this embodiment, one roller of each roller pair is disposed on a translatable linear bearing assembly 816 which is shiftably controllable by an adjustable air cylinder assembly 814. For example, the pressure between rollers 804 and 806 of roller pair 802 can be adjusted by controlling the output pressure of cylinder 814, which causes linear bearing assembly 816 to urge roller 806 against 804. Terminal strips 868, 870 provide electrical connections for various heating control and other electromechanical elements. Thus, in this embodiment, the seal applied to the top of the bag can be adjusted as necessary by controlling the applied heat and pressure to the bag top as described.

Crimping Assembly 900

Figure 28:
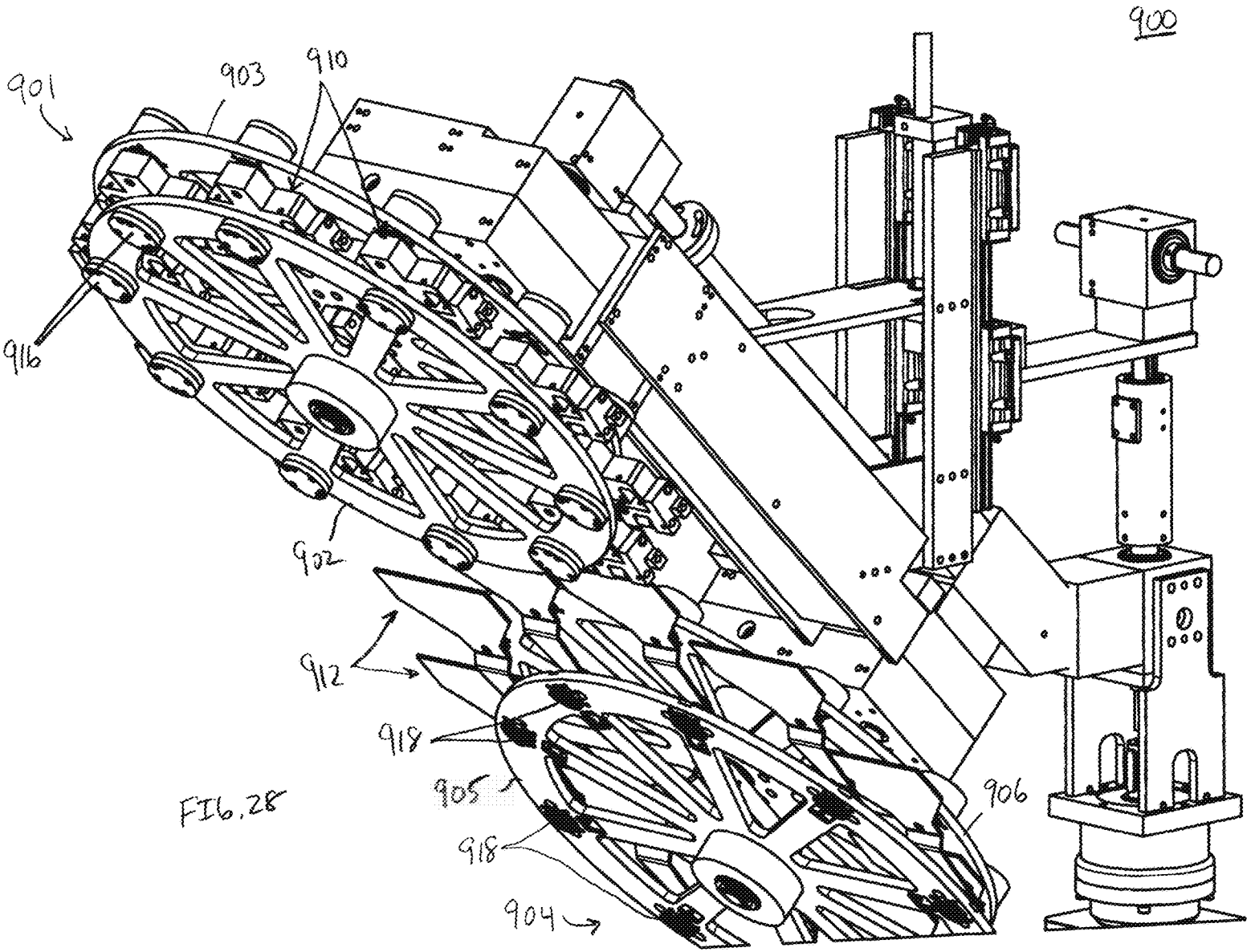
FIGS. 28-30A show various views and components of a crimping assembly, according to one embodiment.
Figure 29:
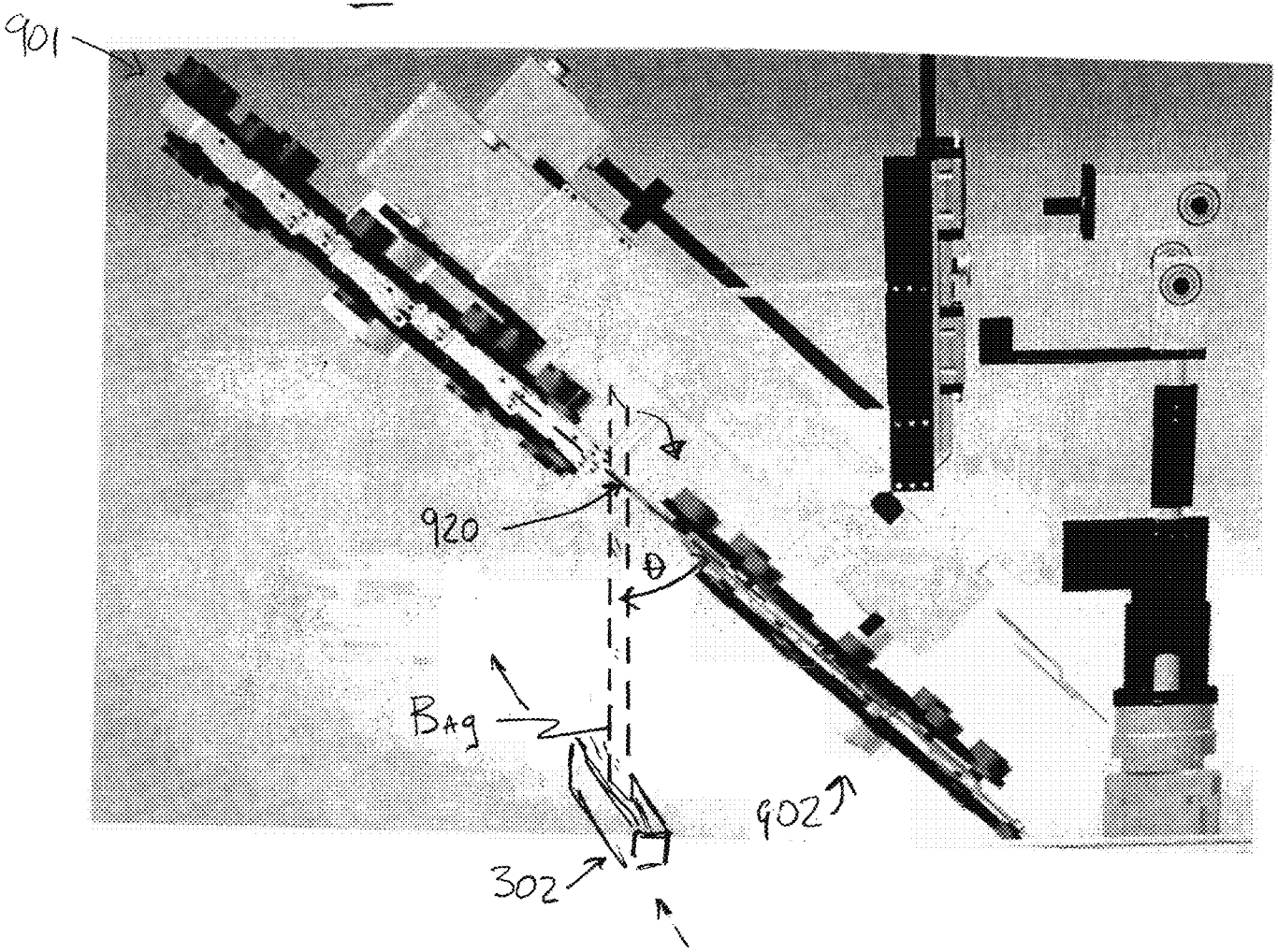
Figure 30:
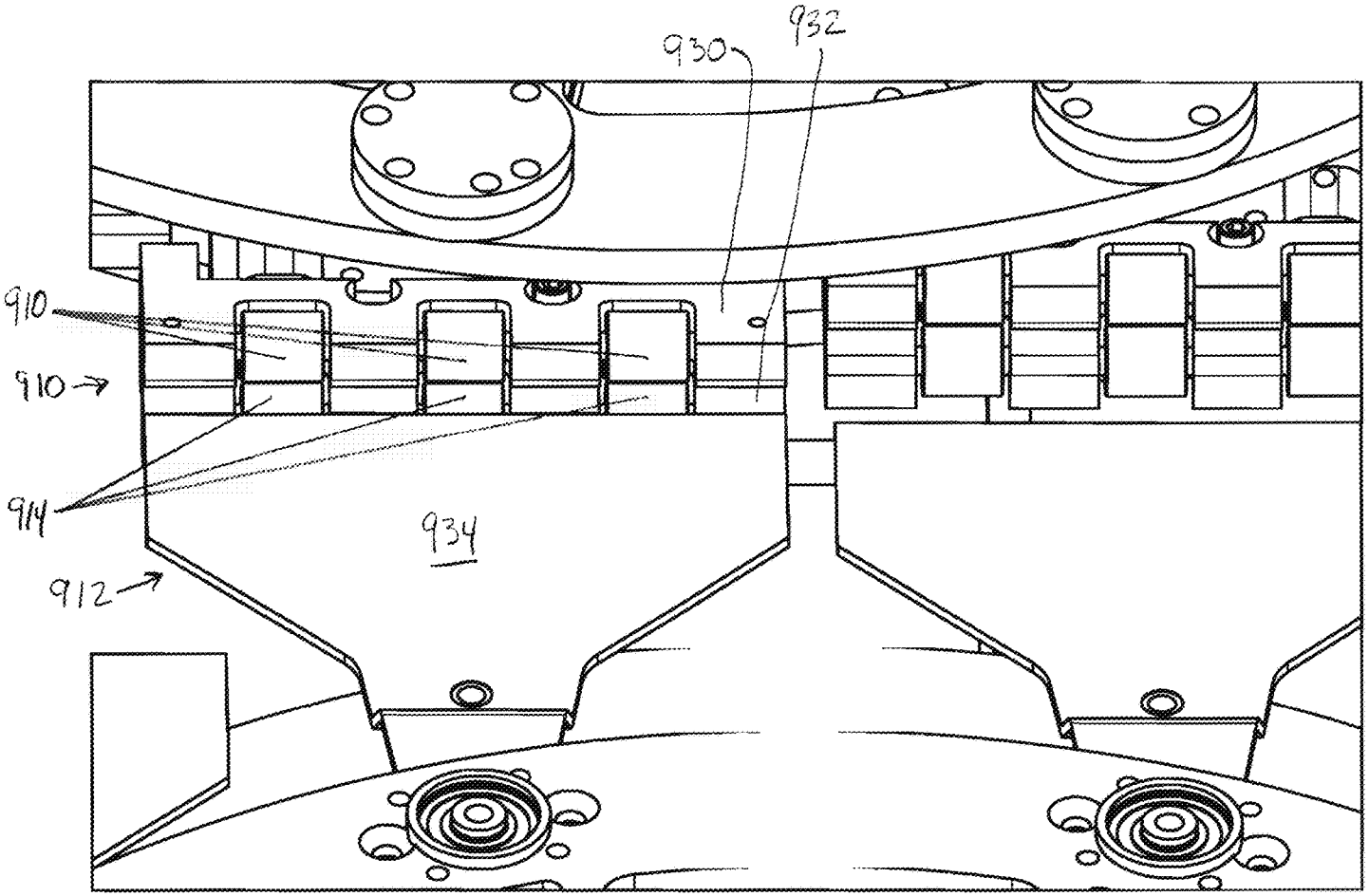

Referring now to FIGS. 28-30, the crimping assembly 900 is illustrated according to one embodiment. In this system 1100 embodiment, the crimping assembly 900 places a final fold in the bag after the contents have been placed therein and the bag has been sealed by the sealing assembly 800.

In this embodiment, the crimping assembly 900 includes a first rotatable wheel assembly 901 and a second rotatable wheel assembly 904, wherein each wheel assembly is configured to rotate in opposite directions, e.g., one clockwise, the other counter-clockwise. The first wheel assembly 901 includes two wheel members 902, 903 spaced apart so as to accommodate a plurality of circumferentially-disposed plunger assemblies 910. The second wheel assembly 904 similarly includes two wheel members 905, 906 spaced apart so as to accommodate a plurality of blade members 912.

In this embodiment, wheel members 902, 903 are coupled via plunger axes 916 which extend through each plunger assembly 910. This configuration allows the orientation of the plungers 910 to remain fixed, e.g., with rollers pointing toward the bag, as described below, as the wheel rotates. Similarly, wheel members 905 and 906 are coupled via blade axes 918 which support the blades and provide for their orientation to remain constant, e.g., pointing toward the bag, as the second wheel assembly 904 rotates.

Referring in particular to FIG. 29, the carriage 302 conveys the bag through a downstream plane that bisects the intersection 920 of the first (901) and second (904) wheel assemblies at an angle θ as illustrated. Referring now to FIG. 30, each plunger assembly 910 includes a top plate 930 and a bottom plate 932 which are normally urged into a confronting relationship by spring loading. As the first and second wheel assemblies counter-rotate, the plunger assembly 910 confronts the blade assembly 912 which causes the top (930) and bottom (932) plates to separate. Rollers 912, 914 on top and bottom plates 910, 912, respectively, cooperate to facilitate separation of the plates.

In this embodiment, the rotation of the first and second wheel assemblies is configured and timed so that as the bag bisects the intersection 920 of the two wheel assemblies 901, 904, the plunger assembly 910 and the blade assembly 912 are substantially centered within the width of the bag. As the bag passes through the intersection 920, the plunger assembly is urged toward the blade; the bag is correspondingly folded by the action of the top plate 930 extending over the top surface 934 of the blade 912, and the bottom plate 932 similarly extending across the bottom, opposite portion of the blade. In this manner, crisp, repeatable folds can be disposed on the bag at desired locations, e.g., by raising or lowering the assembly 900.

Figure 30A:
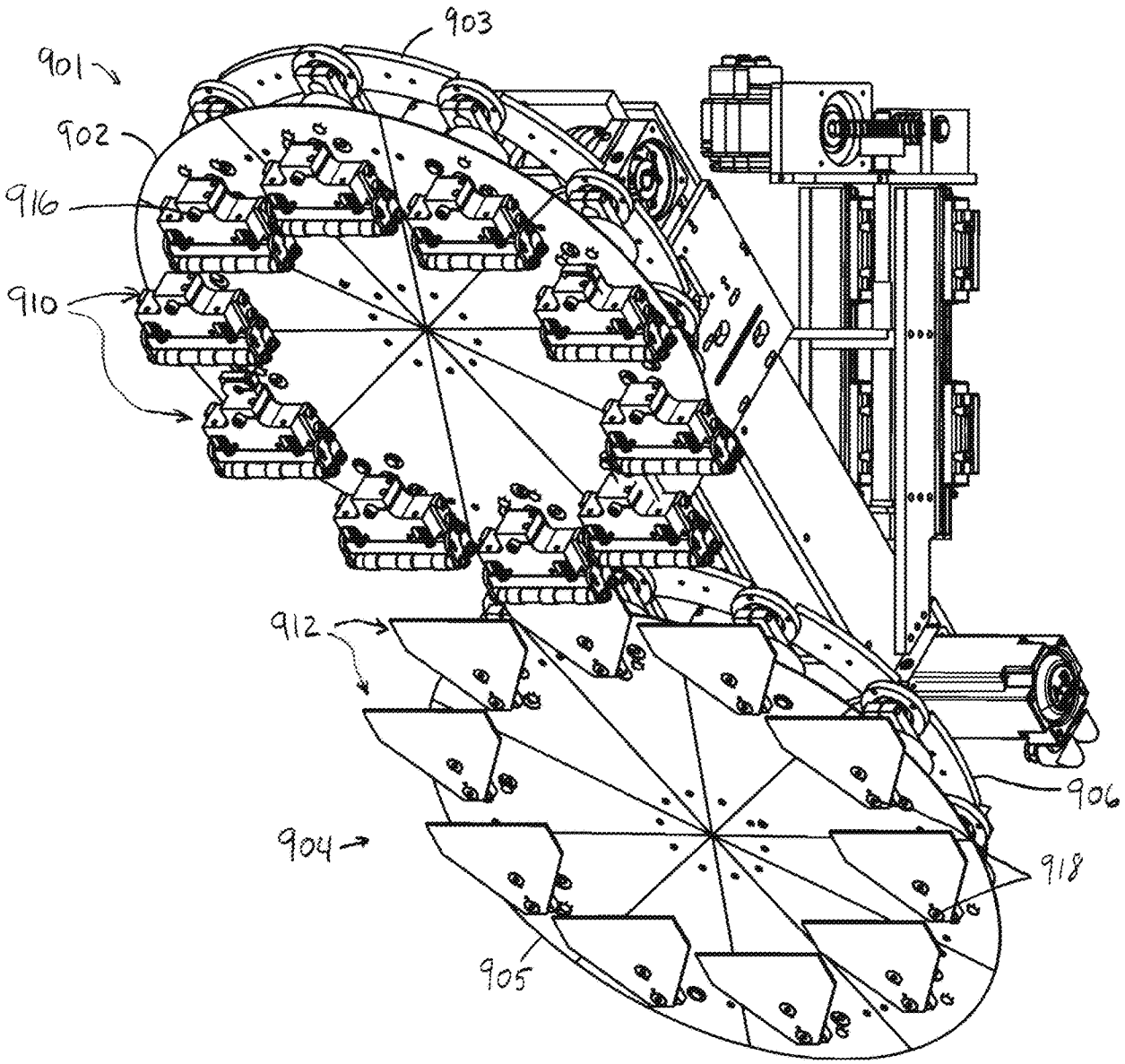

Referring now to FIG. 30A, in one alternative embodiment, each of the plunger assemblies 910 and the blade members 912 can be disposed on an outer side of wheel members 902 and 905, respectively. This configuration provides for reduced likelihood of bearing grease or other substances from dripping or falling into or onto the bag from any of the mechanical components off the crimping assembly as it passes therethrough.

Offloading Assembly 1000

Figure 31:
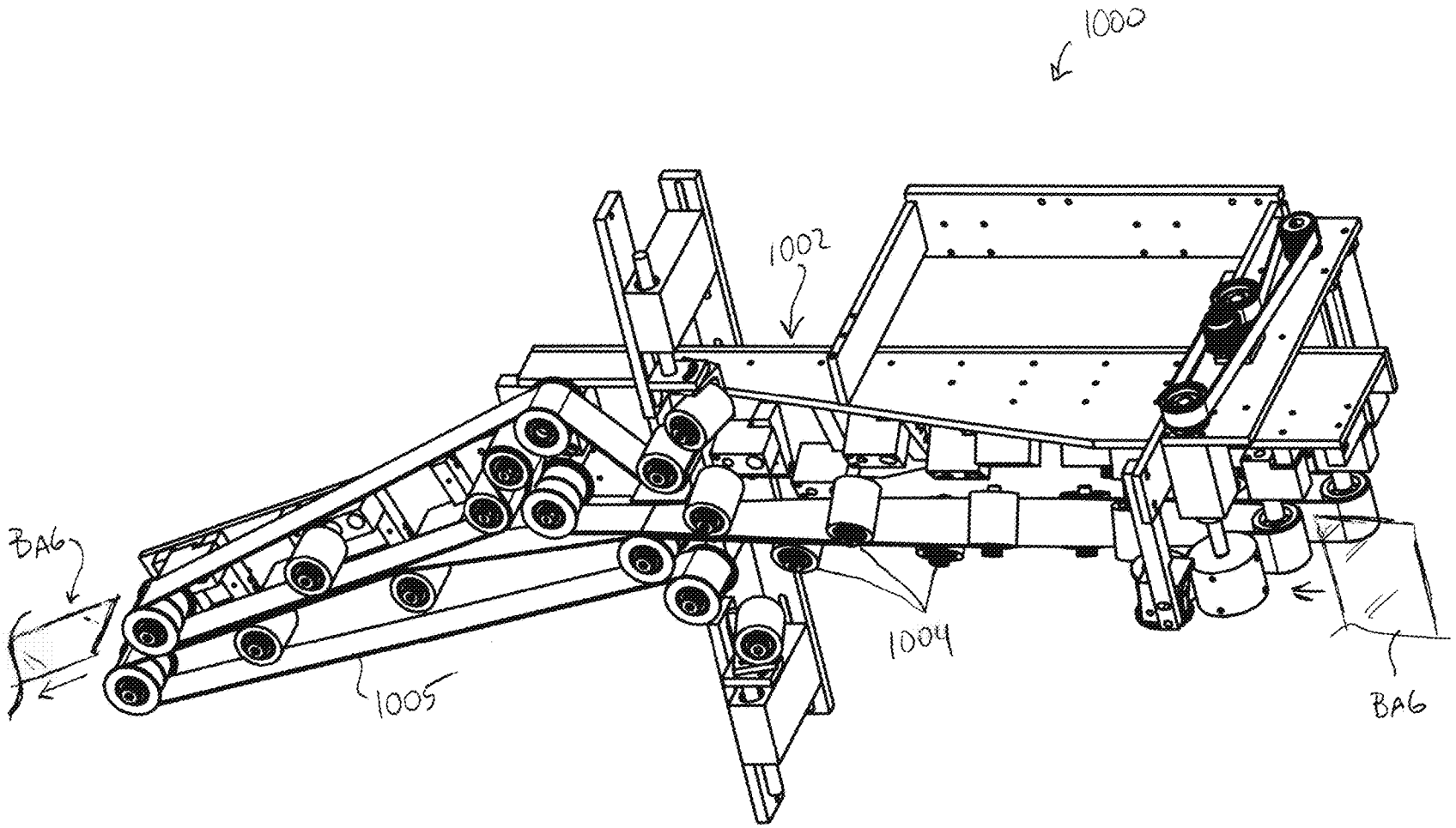
FIG. 31 illustrates an offloading assembly, according to one embodiment.

Referring now to FIG. 31, the offloading assembly 1000 is illustrated according to one embodiment. In this system 1100 embodiment, the offloading assembly includes a frame 1002 configured to support a plurality of rollers, e.g., rollers 1004 around which a continuous belt 1005 passes. The belt and rollers can be configured as desired to receive the finished packaged food product from the crimping assembly 900, orient it in a desired orientation, and transport it to, e.g., a storage container. In this embodiment, the assembly 1000 receives the bag in a substantially vertical orientation after the bag has been folded by the crimping assembly 900. The pathway of the belt 1005 rotates the bag to a substantially planar-horizontal orientation and feeds each bag to a packaging assembly (not shown).

FIGS. 33-36 illustrate an offloading assembly 1200 according to one alternative embodiment. In this embodiment, the offloading assembly 1200 includes an oval-shaped barrel cam track assembly 1210 configured for supporting a plurality of movable carriages 1205 as illustrated. The movable carriages 1205 are driven around the barrel cam track assembly 1210 by a motor-driven sprocket assembly 1220; each of the carriages 1205 is coupled to a chain which the sprocket assembly 1220 engages as it turns.

Figure 34:
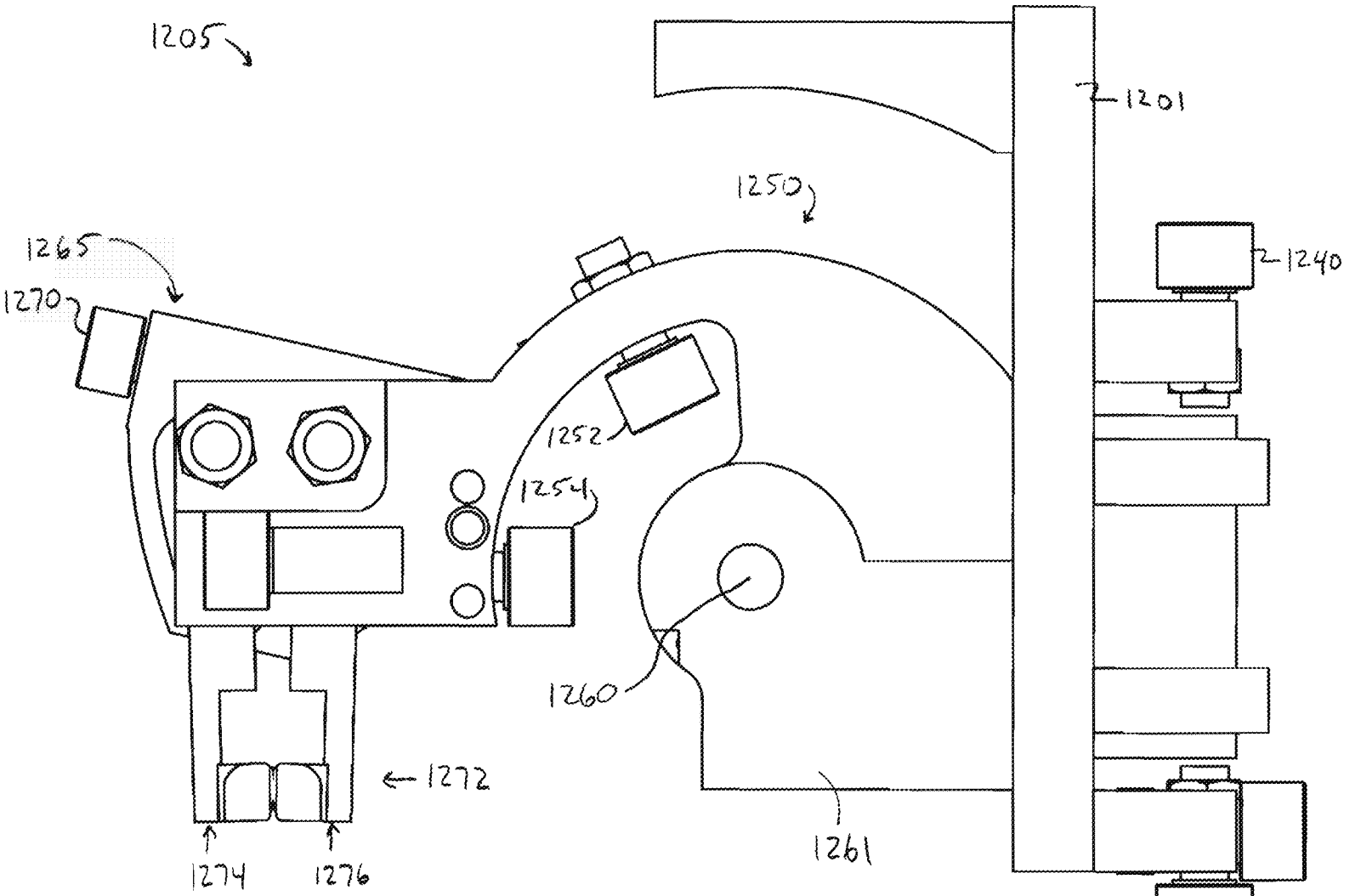
Figure 35:
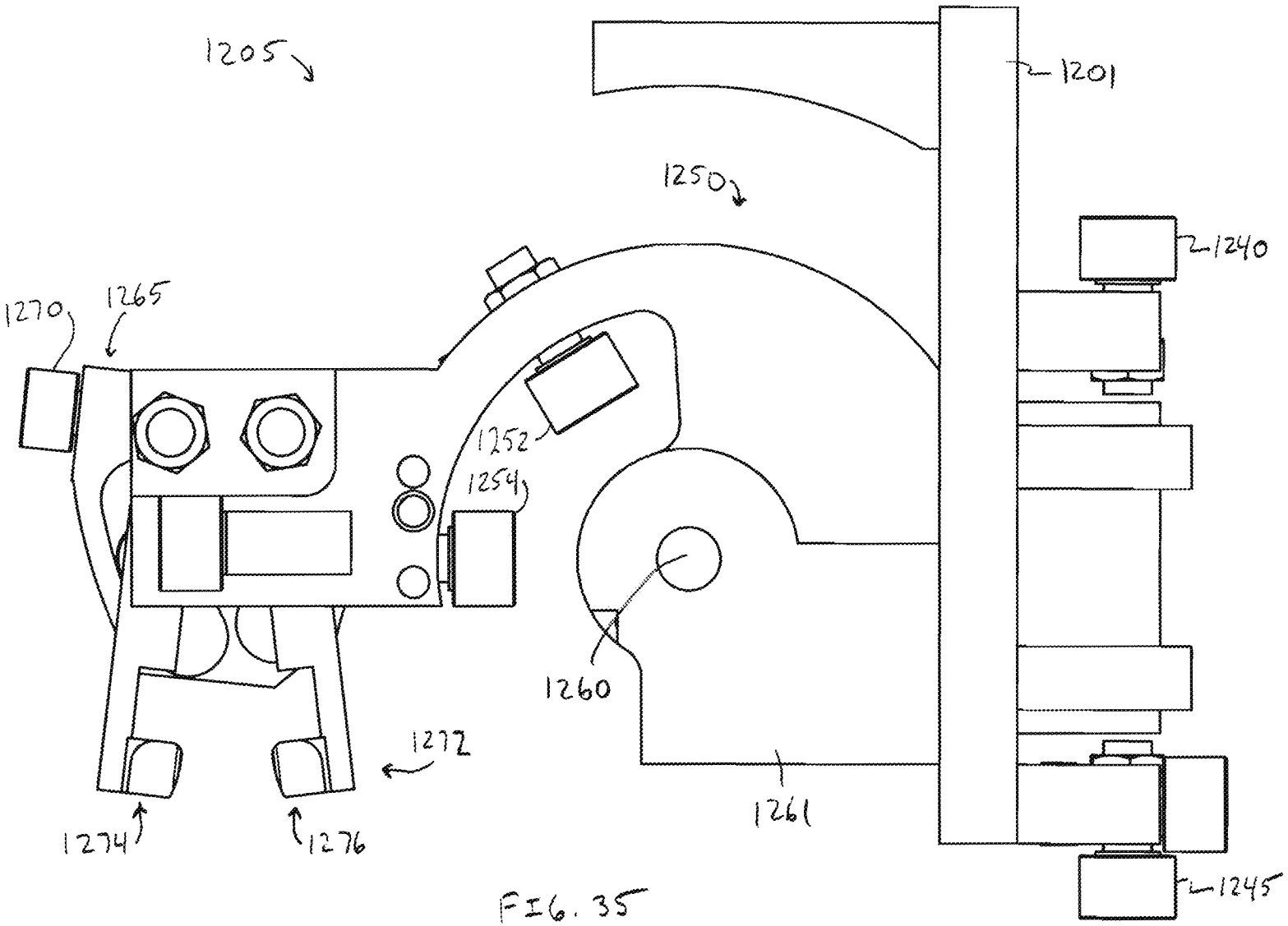
Figure 36:
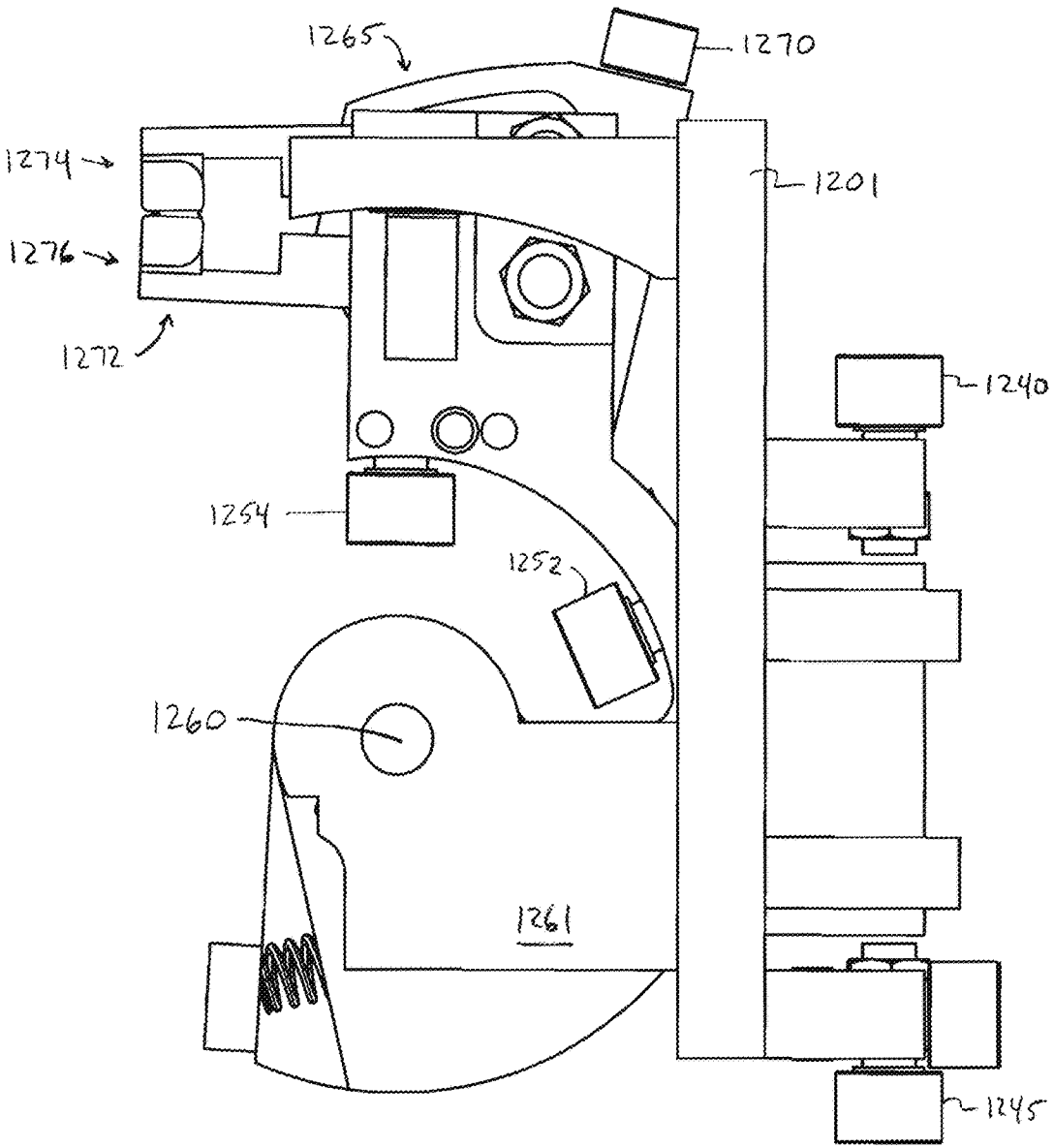

Referring to FIGS. 34-36 in particular, in this embodiment, each carriage 1205 includes a frame member 1201 integral with a shoulder member 1261. Arm member 1250 is rotatably coupled to shoulder member 1261 via hinge pin 1260. Arm member 1250 includes a gripping assembly 1272 that includes first (1274) and second (1276) gripping members which are capable of reversibly shifting between closed (as illustrated in FIG. 34) and open (as illustrated in FIG. 35) configurations. Shift arm 1265 is configured such that shifting the arm from a first position (illustrated in FIG. 34) to a second position (illustrated in FIG. 35) engenders shifting of the gripping assembly 1272 between closed and open configurations and vice-versa.

In this embodiment, the barrel cam track assembly 1210 includes an inner barrel cam track 1211 and an outer barrel cam track 1212. The inner barrel cam track 1211 is configured to receive cam followers 1240 and 1245 of frame member 1201 which allows carriages 1205 to circumnavigate the barrel cam track assembly 1210. In this embodiment, the orientation of frame member 1201 remains substantially the same as the carriages circumnavigate the barrel cam track assembly 1210, e.g., in an upright configuration as illustrated in FIGS. 34-36.

The outer barrel cam track 1212 is configured to receive cam followers 1252 and 1254 and provides a pathway which engenders shifting of arm member 1250 between gripping assembly-down (FIG. 34) and gripping assembly-up (FIG. 35) configurations. Shifting between these two configurations is provided by a deflection in the outer barrel cam track 1212 illustrated on the front (facing) side of the offloading assembly 1200 in FIG. 33. At deflection area 1225, the outer barrel cam track 1212 begins a downward path until it reaches inflection point 1230; a carriage moving from deflection area 1225 to inflection point 1230 would shift arm member 1250 from vertical (gripping assembly-up, FIG. 35) to horizontal (gripping assembly-down, FIG. 36) configurations. As the carriage continues to move (clockwise, in the example of FIG. 33), the outer barrel cam track 1212 deflects upward, which engenders arm member 1250 to shift back to a vertical configuration.

In this embodiment, the offloading assembly 1200 is configured and positioned proximal to crimping assembly 900, so that after a bag has been crimped, it is translated by carriage 302 with a bag in a vertical orientation. The offloading assembly 1200 is synchronized with the carriage conveyor system 300 such that as the arm member 1250 of a carriage 1205 is urged to a gripping assembly-down configuration, gripping members 1274 and 1276 are positioned on opposite sides of the top of the bag. At this point, shift arm 1265 is urged, e.g., by a stationary arm member or a dedicated barrel cam track (not illustrated), in a direction to cause gripping assembly 1272 to close, thereby gripping the bag top and lifting it from carriage 302. The bag can be translated further downstream to a selected location whereat shift arm 1265 can be urged to cause the gripping assembly to open, thereby depositing the bag in the selected location, e.g., a shipping container. In this embodiment, shift arm 1265 can be urged to case gripping assembly 1272 to open and close via cam follower 1270, which can ride, e.g., in a dedicated barrel cam track or, in another example, engage a fixed arm member along the general path of carriage 1205 about the barrel cam track assembly 1210. In the latter case, the fixed arm can be actuated in and out of the path of cam follower 1270 by, e.g., a controllable piston. In one embodiment, the controllable piston can be controlled by a quality control system configured to detect bags that are outside the parameters of a selected quality control factor, e.g., as described in the following section.

Fault Monitoring

In this and other embodiments, various fault-monitoring methods can be used for determining deviations from the operations as generally described herein. Such methods include optical monitoring assemblies, scanners, and other systems which may be commercially available and adaptable to the processes and functions described herein.

In one embodiment, fault monitoring is accomplished as follows. First, a retro-reflected sensor assembly disposed near the proximal end 322 of the carriage conveyor system 300 is configured to determine whether or not a bag has been inserted into a carriage 302. That binary data is entered into a shift register. A laser assembly is disposed near the bag top opener assembly 400 and is configured to determine whether the bag has been successfully opened on front and back sides immediately after the bag passes through the opener 400. In this embodiment, the laser assembly is configured as a distance measuring system that measures a distance from the output of the laser to a side of the bag and can determine, based on the measured value, whether a side has been opened or not. Such binary data is added to the shift register.

Figure 32:
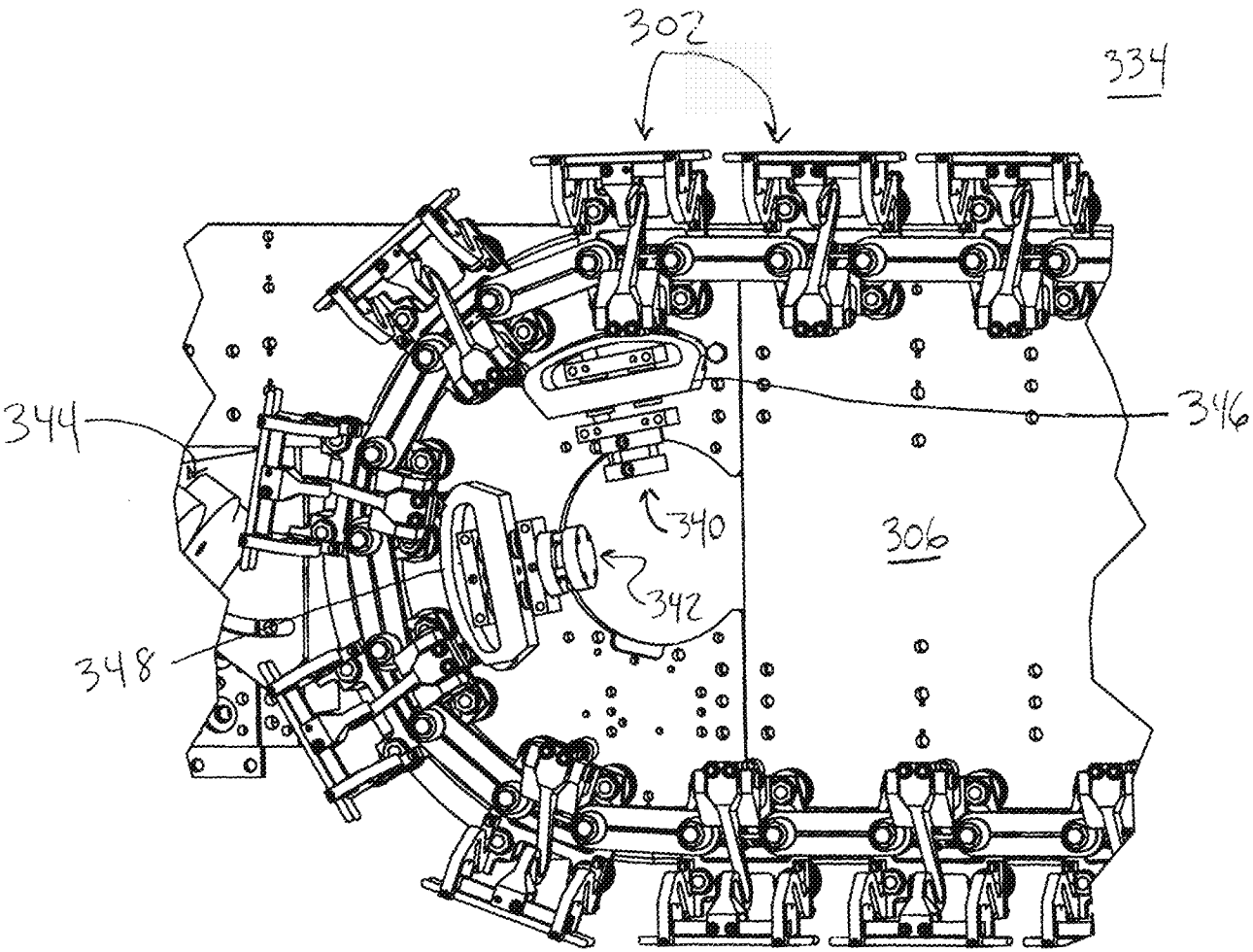
FIG. 32 shows components of a distal end portion of a carriage conveyor system, according to one embodiment.
Figure 33:
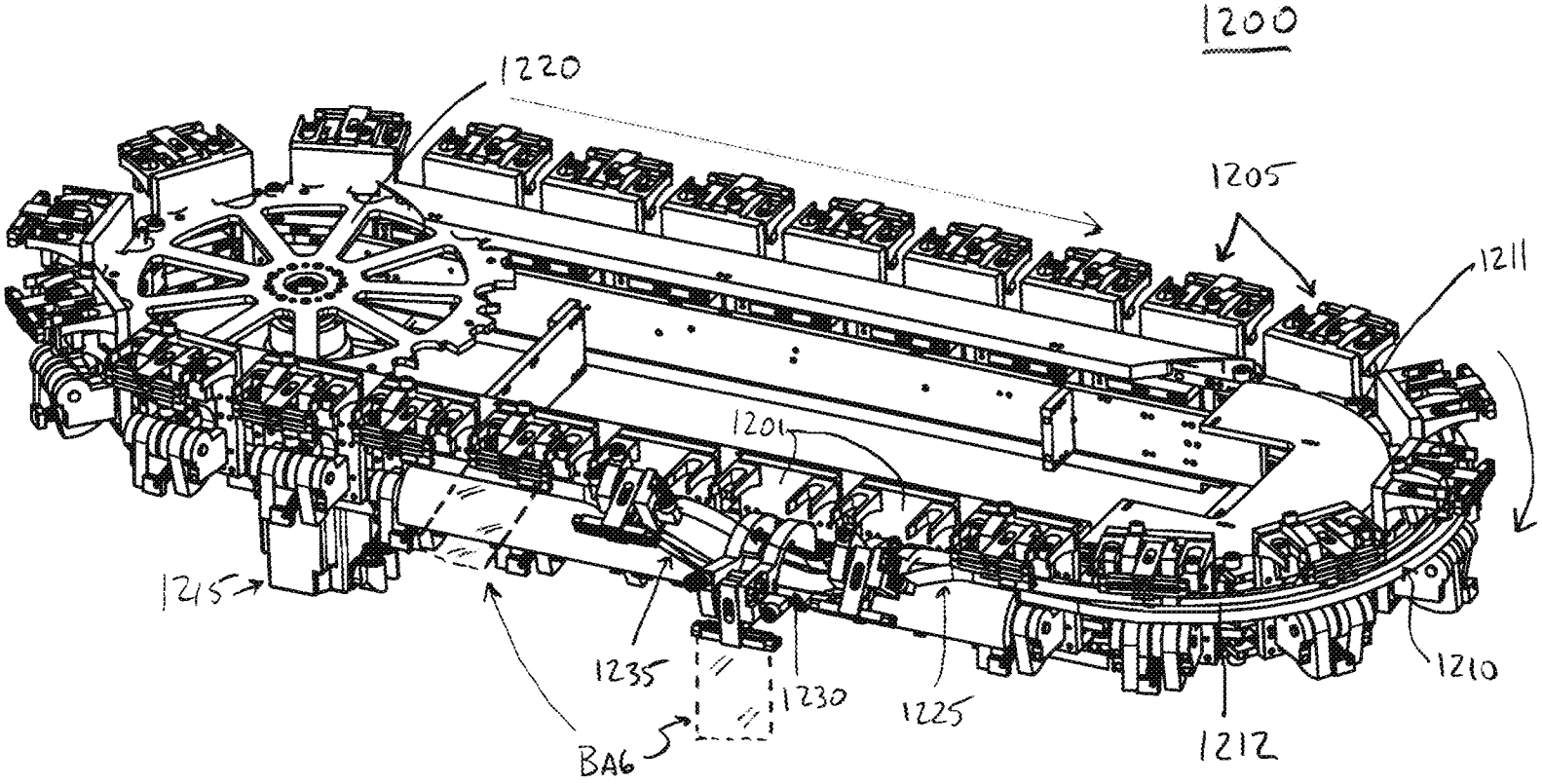
FIGS. 33-36 illustrate views and components of an offloading assembly, according to one alternative embodiment.

Referring now to FIG. 32, in this embodiment, the shift register data is used in cooperation with a cylinder control module to control cylinders 340 and 342 on the distal end portion 334 of the carriage conveyor system 300. During normal operation, e.g., when a carriage has a bag and no faults have been detected, the cylinder is in an "up" configuration which causes cam 346 to intersect the path of cam follower 326 of the carriage 302 (FIG. 5); this causes the carriage to open, allowing the bag to be removed from the carriage and received by the offloading assembly.

In the event of a shift register fault, however, e.g., if the bag didn't open correctly or wasn't properly filled, the system 1100 keeps track of the fault carriage and, at the appropriate time when the bag reaches the distal end portion 334 of the carriage conveyor, the cylinder control module actuates the first cylinder 340 to remove the cam 346 from the path of the cam follower 326. The cam follower 326 of the carriage then misses the cylinder and the carriage remains closed, retaining the bag beyond the point at which it would normally be offloaded into the offloading assembly. Next, the cylinder control module actuates the second cylinder 342 to cause cam 348 to intersect the cam follower 326, causing the carriage to open. As the bag rotates downward, a pair of counter-rotating ejector rollers grabs the bag and dispenses it into, e.g., a separate container for faulty bag products.

A number of illustrative embodiments have been described. Nevertheless, it will be understood that various modifications may be made without departing from the spirit and scope of the various embodiments presented herein. For example, while the foregoing description has largely focused on producing microwavable popcorn bag products, the systems and methods described herein can be adapted for packaging other products, including food- and non-food items. Accordingly, other embodiments are within the scope of the following claims.

What is claimed is:

1. An automated food packaging system, comprising:

a) an automated bag forming system configured to produce a plurality of individual bags in sequence;

b) a bag rotator configured to receive and rotate said individual bags for individual placement into one of a plurality of carriages of a carriage conveyor system;

wherein said carriage conveyor system comprises a continuous beam member having a circumferential track on an outermost surface;

wherein each of said carriages is configured to travel continuously around said circumferential track;

wherein each carriage of said plurality of carriages further comprises an engagement surface and an engagement side portion, wherein said engagement surface is shiftable relative to said engagement side portion to open and close said carriage, and wherein shifting of said engagement surface to close said carriage is driven by a linkage arm coupled to a cam follower configured to engage a cam bar disposed on or in engageable proximity to said beam member;

c) a blade wheel assembly configured to urge a bottom portion of said bag between said engagement surface and said engagement side portion of said carriage when said carriage is in said open configuration;

d) a bag top opener assembly configured to open a top portion of said bag;

e) a funnel positioning system configured to position one of a plurality of funnels over said bag after opening;

f) a hopper system configured to deliver a selected quantity of a foodstuff into said bag;

g) an injection system configured to deliver a selected quantity of a flowable substance into said bag;

h) a sealing station configured to seal said top portion of said bag;

i) a crimping assembly configured to place one or more folds in said bag; and j) an offloading assembly configured to receive and transport said bag to a selected location;

wherein said carriage conveyor system is configured to convey said bag sequentially from components b-j, supra.

2. The system of claim 1, wherein said bag rotator comprises first and second tapered rollers configured such that at least one tapered surface portion of said first tapered roller confronts at least one tapered surface portion of said second tapered roller; and wherein said bag rotator is configured to receive a leading corner portion of said bag from said automated bag forming system in a flat configuration to engender in-plane rotation of said bag.

3. The system of claim 1, wherein said blade wheel assembly comprises a plurality of circumferentially-disposed blade members about a rotatable blade wheel that are configured to plunge said bottom portion of said bag between a first bar member proximal to said engagement surface and a second bar member proximal to said engagement side portion.

4. The system of claim 1, wherein said bag top opener assembly comprises:

a rotatable wheel frame assembly comprising a plurality of circumferentially-disposed opener assemblies in communication with a vacuum source, wherein each of said opener assemblies is configured to urge a top portion of said bag into an open configuration through vacuum force.

5. The system of claim 4, wherein said bag top opener assembly comprises two of said rotatable wheel frame assemblies configured in a mirrored-plane orientation with respect to each other; wherein said bag top opener assembly is configured to receive said top portion of said bag oriented substantially coplanar with said mirror plane.

6. The system of claim 4, wherein each of said opener assemblies is coupled to said wheel frame assembly by a frame coupling member, and further configured to be reversibly shiftable with respect to said frame coupling member within a plane of said wheel frame.

7. The system of claim 4, wherein each of said opener assemblies comprises one or more suction cups in communication with said vacuum source and configured to confront said top portion of said bag.

8. The system of claim 1, wherein said funnel positioning system comprises:

a substantially oval-shaped track comprising an upper and a lower cam pathway;

a plurality of linked funnels carriages, each carriage comprising:

a carriage frame coupled with a lower cam follower that rides in said lower cam pathway; and a reversibly vertically-shiftable funnel coupled to a support arm which itself is coupled to an upper cam follower that rides in said upper cam pathway;

wherein a portion of said upper cam pathway comprises a transition to a lowered pathway portion which urges said support arm to a lowered configuration.

9. The system of claim 1, wherein said flowable substance is oil.

10. The system of claim 1, wherein said injection system comprises:

a plurality of injection nozzles circumferentially disposed about a rotatable wheel assembly;

wherein said wheel assembly is configured to rotate at an angular velocity such that passage of said carriage holding said bag coincides with a nozzle being in a substantially lower-most configuration on said wheel assembly.

11. The system of claim 10, wherein injection of said flowable substance into said bag occurs when said wheel is in said substantially lower-most configuration on said wheel assembly.

12. The system of claim 10, wherein each nozzle is in fluid communication with a variable displacement pump assembly configured to both fill a nozzle cylinder with said flowable substance, and expel said flowable substance from said cylinder.

13. The system of claim 12, wherein said injection system further comprises:

a cylinder cam assembly having a plurality of surfaces on which a cam follower coupled to an intake/expulsion piston is configured to ride and which is configured to engender shifting motion of said piston.

14. The system of claim 13, wherein said cylinder cam assembly further comprises:

a position-adjustable drawback cam having a surface configured to shift said piston so as to draw said flowable substance into said cylinder;

a stationary expulsion cam having a surface configured to shift said piston so as to expel said flowable substance from said cylinder into said nozzle; and a stop-limit cam configured to prevent said piston from shifting on an intake stroke beyond a selected limit.

15. The system of claim 12, wherein said variable displacement pump assemblies are configured to circumnavigate said cylinder cam.

16. The system of claim 1, wherein said sealing assembly comprises one or more roller assemblies, each roller assembly comprising a pair of heated rollers and configured to receive a top portion of said bag therebetween for engendering a seal to said top portion of said bag.

17. The system of claim 1, wherein said crimping assembly comprises:

a first rotatable wheel assembly having a plurality of plunger assemblies circumferentially disposed thereupon; and a second rotatable wheel assembly having a plurality of circumferentially-disposed blade members thereupon;

wherein said first rotatable wheel and said second rotatable wheel are configured such that as both of said wheels rotate, a portion of each of said blade members is reversibly urged into a portion of a complimentary one of said plunger assemblies.

18. The system of claim 17, wherein said crimping assembly is configured to receive a selected portion of said bag between each blade member and a complimentary plunger assembly as said bag bisects said first and said second rotatable wheel assembly to engender a fold in said bag.

19. A method of producing a packaged product in an automated process, comprising:

a) forming a plurality of individual bags using an automated bag forming system;

b) receiving individual bags from said automated bag forming system by a bag rotator and rotating said individual bags for placement onto a carriage of a bag conveyor system;

wherein said carriage comprises a first bar and a second bar, wherein said second bar is configured to shift between open and closed configurations within a horizontal plane;

c) urging a bottom portion of said bag between said first and second bars of said carriage using a blade wheel assembly, wherein each blade of said blade wheel assembly translates in a plane that is perpendicular to said horizontal plane defined by said first and said second bars;

d) opening a top portion of said bag using a bag top opener assembly;

e) positioning one of a plurality of funnels over said bag after said bag has been opened using a funnel positioning system;

f) delivering a selected quantity of said product into said bag using a hopper system;

g) delivering a selected quantity of a flowable substance into said bag using an injection system;

h) sealing a top portion of said bag using a sealing station;

i) placing one or more folds in said bag using a crimping assembly; and j) receiving and transporting said bag to an selected location using an offloading assembly;

wherein said carriage conveyor system is configured to convey said bag, in the following order: from said bag top opener assembly to said funnel positioning system; to said hopper system; to said injection system; to said sealing station; to said crimping assembly; to said offloading assembly.

20. An automated packaging system, comprising:

an automated bag forming system configured to produce a plurality of individual bags in sequence; and bag processing means for filling said bags with a selected product and placing a bag seal on the bag to store said contents therewithin.

* * * * *